US012774569B2

(12) United States Patent
Sperling et al.

(10) Patent No.: US 12,774,569 B2
(45) Date of Patent: Oct. 27, 2026

(54) RAIL GRINDING MACHINE AND METHOD THEREOF

(71) Applicant: Sperling Railway Services, Inc., Canton, OH (US)

(72) Inventors: Fred S. Sperling, Canton, OH (US); Chad H. Sperling, North Canton, OH (US)

(73) Assignee: SPERLING RAILWAY SERVICES, INC., Canton, OH (US)

( * ) Notice: Subject to any disclaimer, the term of this patent is extended or adjusted under 35 U.S.C. 154(b) by 342 days.

(21) Appl. No.: 18/606,636

(22) Filed: Mar. 15, 2024

(65) Prior Publication Data

US 2025/0290254 A1 Sep. 18, 2025

(51) Int. Cl.
*E01B 31/17* (2006.01)
*E01B 11/44* (2006.01)
*E01B 29/42* (2006.01)

(52) U.S. Cl.
CPC ..... *E01B 31/17* (2013.01); *E01B 11/44* (2013.01); *E01B 29/42* (2013.01)

(58) Field of Classification Search
CPC ..... E01B 31/17; B24B 19/004
See application file for complete search history.

(56) References Cited

U.S. PATENT DOCUMENTS 1,067,624 A 7/1913 Simard et al.
1,340,991 A * 5/1920 Tabor ..... E01B 31/17 451/152
1,405,019 A 1/1922 Simard
1,412,715 A 4/1922 Siefertson
1,562,558 A 11/1925 Hobson
1,735,693 A * 11/1929 Pitman ..... E01B 31/17 451/365
2,073,816 A 3/1937 Talboys
2,118,621 A 5/1938 Perazzoli
2,324,263 A 7/1943 Lowe
2,378,512 A 6/1945 Talboys et al.
2,748,540 A 6/1956 St George
(Continued)

FOREIGN PATENT DOCUMENTS

WO WO-2012146540 A1 * 11/2012 ..... E01B 31/17
WO 2013049916 A1 4/2013
(Continued)

*Primary Examiner* — Joel D Crandall
(74) *Attorney, Agent, or Firm* — Sand, Sebolt & Wernow Co., LPA

(57) ABSTRACT

A rail grinding machine is composed of a rail cart that moves along a rail of a railway via self-propelled locomotion or by being towed. A grinding assembly may simultaneously grind both sides of a vertical web of the rail via respective grinding surfaces that create a ground surface on each side of the vertical web prior to welding one end of one rail to another end of an adjacent rail. The ground surface created by the respective grinding surfaces receives a metallic plate in a subsequent welding process performed by a different welding machine. The grinding assembly is moveable to displace the respective grinding surfaces from engagement with the rail when the rail cart moves along the rail and is moveable to engage the respective grinding surfaces with the vertical web of the rail when the rail cart is maintained in a stationary position relative to the rail.

20 Claims, 25 Drawing Sheets

(56) References Cited

U.S. PATENT DOCUMENTS 3,358,406 A * 12/1967 Speno, Jr. ..... E01B 31/17 451/347
3,377,751 A 4/1968 Schnyder
3,738,066 A 6/1973 Panetti
3,821,840 A 7/1974 Kershaw
3,823,455 A 7/1974 McIlrath et al.
3,882,645 A 5/1975 Duecker
3,883,323 A * 5/1975 Cooley ..... E01B 31/17 451/347
3,918,215 A 11/1975 Scheuchzer
3,945,749 A 3/1976 Mcilrath
3,974,594 A 8/1976 Urbank
3,976,239 A 8/1976 Finck
4,020,599 A * 5/1977 Panetti ..... E01B 31/17 299/41.1
4,050,196 A * 9/1977 Theurer ..... E01B 31/17 451/72
4,178,724 A 12/1979 Bruno
4,189,873 A * 2/1980 Panetti ..... E01B 31/17 451/347
4,309,846 A 1/1982 Theurer et al.
4,347,688 A 9/1982 Scheuchzer et al.
4,365,918 A 12/1982 Theurer
4,473,971 A 10/1984 Mischler et al.
4,492,059 A 1/1985 Panetti
4,615,150 A 10/1986 Panetti
4,729,196 A 3/1988 Chaseling
4,751,794 A * 6/1988 Clem ..... B24B 23/08 451/158
4,779,384 A 10/1988 Shoenhair et al.
4,829,723 A 5/1989 Bull et al.
RE32,979 E 7/1989 Panetti
4,908,993 A 3/1990 Fritz
4,993,193 A * 2/1991 Panetti ..... E01B 31/17 451/347
5,359,815 A 11/1994 Schrunk, III et al.
5,575,709 A 11/1996 Hertelendi et al.
5,735,734 A 4/1998 Hertelendi
5,997,391 A 12/1999 Jaeggi
6,033,166 A 3/2000 Hampel
6,123,606 A 9/2000 Hill et al.
6,663,476 B1 12/2003 Story et al.
6,669,533 B2 12/2003 Huboud-Peron
6,805,621 B2 10/2004 Hertelendi et al.
7,156,723 B2 1/2007 Natarajan et al.
7,442,115 B1 10/2008 Brenny et al.
D651,223 S 12/2011 Grund et al.
8,367,960 B2 2/2013 Keefe
9,073,164 B2 7/2015 Skoblenick
9,073,167 B2 7/2015 Skoblenick
9,416,498 B2 8/2016 Knoll
10,286,460 B2 5/2019 Murphy
10,427,271 B2 10/2019 Bluhme
10,814,453 B2 10/2020 Skoblenick et al.
11,668,055 B2 6/2023 Schrunk
2003/0083001 A1* 5/2003 Natarajan ..... E01B 31/17 451/65
2004/0002294 A1* 1/2004 Hertelendi ..... E01B 31/17 451/347
2009/0298402 A1 12/2009 Guillen Cobos et al.
2013/0090041 A1 4/2013 Skoblenick
2013/0090046 A1 4/2013 Skoblenick
2013/0318762 A1 12/2013 Knoll
2018/0111250 A1 4/2018 Bluhme
2019/0368132 A1 12/2019 Widlroither
2020/0240088 A1 7/2020 Barezzani et al.

FOREIGN PATENT DOCUMENTS

WO 2013049917 A1 4/2013
WO WO-2014063771 A1 * 5/2014 ..... E01B 31/17
WO WO-2015198206 A1 * 12/2015 ..... E01B 31/17
WO 2022179963 A1 9/2022

* cited by examiner

FIG.7
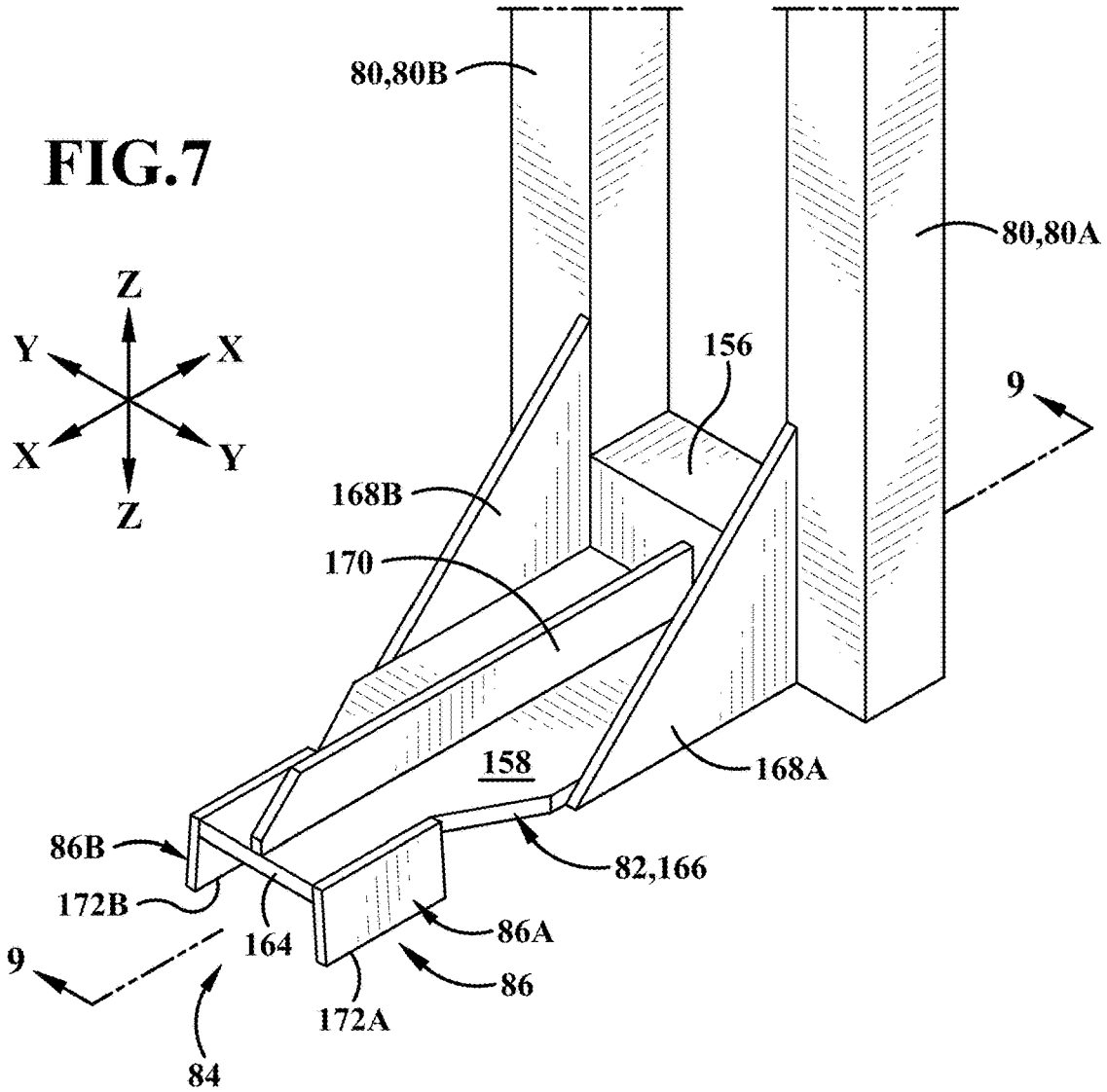
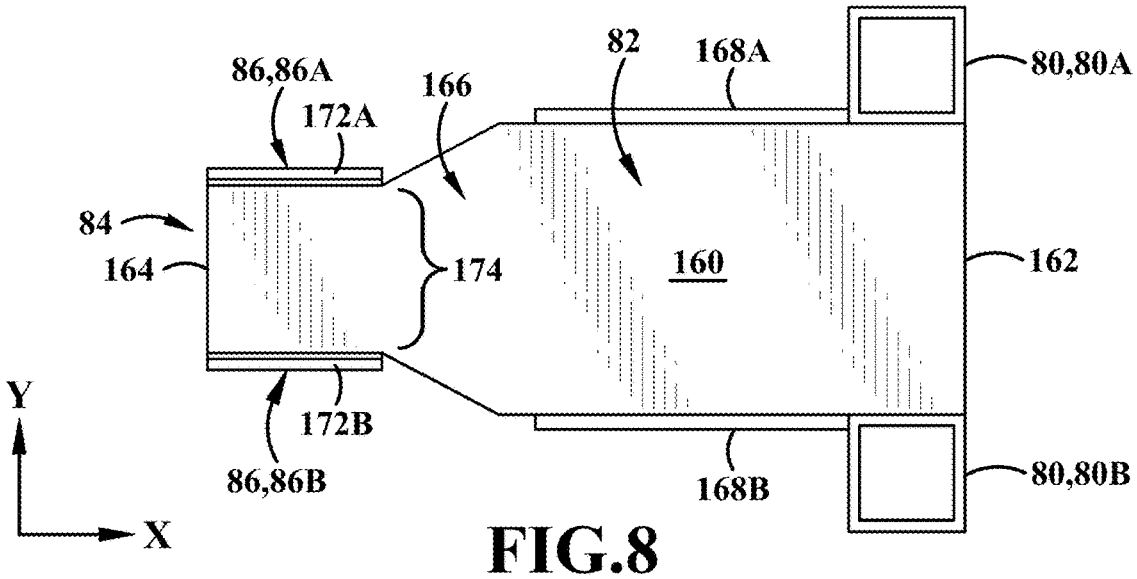
FIG.8

RAIL GRINDING MACHINE AND METHOD THEREOF

TECHNICAL FIELD

This disclosure is directed to a web grinding machine for railroad rails.

BACKGROUND ART

When railroads are replacing strings of welded rail (which may be approximately 1440 feet long) they often utilize an electric induction welding system mounted on a truck to weld the strings of rail together as a part of the rail laying process. Because of the high amperage required to weld the strings together, the web of each rail being joined must be ground to a bright surface to remove all rust and provide good electrical conduction for the welder or plates that electrically couple to the welder. The web must be ground approximately 27" from the end of each rail on both sides.

A rail web grinding machine is a specialized piece of equipment used in the maintenance and repair of a railroad composed of two rails. The "web" of a rail refers to the vertical section between the top surface (head) and the bottom surface (base or foot) of the rail. Previously, rail web grinding machines have been designed to grind the vertical web of the rail to remove rust and prepare the surface of the web for welding. However, these are walk-behind manually operated machines that require significant human involvement and labor. Other grinding machines have been provided for grinding the surface of the rail after welding, which is different than pre-welding or surface preparation grinding.

The pre-welding grinding process removes rust and other surface contaminants from the rail, exposing a clean metal surface. When rails are joined together, the ends of the rails are welded to create a continuous rail. Grinding the vertical web allows for a smooth and clean surface, which is necessary for the electrical circuit for high-quality rail welding. The absence of rust and other imperfections enhances the effectiveness and strength of the rail weld. The grinding process is typically carried out using abrasive grinding wheels or stones that are designed for rail maintenance. These machines are often equipped with at least one grinding head.

In one particular example, a butt or flash welding technique is a method for welding the abutted ends of two rails together, creating a continuous rail. The process involves high electrical currents and pressure to establish a robust metallurgical bond between the rail ends. Butt or flash welding requires that a metal plate, such as a copper plate be applied to each vertical web to connect with the webs of the rail.

The flash welding process begins with preparing the rail ends, ensuring that the two rail sections to be joined are abutted or brought together in proper alignment. Before the application of copper plates, the vertical web of each rail end is ground or machined. This grinding step ensures a smooth and uniform surface on the vertical web. Currently, this grinding occurs by hand or with a walk-behind manually operated grinding machine. Following the manual grinding process, copper plates are applied to the prepped vertical web of each rail end. These copper plates serve as conductors for the electric current during welding and help manage the heat generated. The rail ends, along with the copper plates, are securely clamped together. Preheating may be applied to raise the temperature of the rail ends, making them more receptive to the subsequent welding process. The flash butt welding process involves applying a high electrical current to the rail ends. The electric current generates intense heat, causing the rail ends to melt and become molten. Pressure may be applied to force the molten metal to fuse, creating a solid and continuous weld. After welding, excess molten metal (flash) may be removed. This excess material is typically expelled from the weld area due to the pressure applied during the welding process. The welded joint undergoes thorough inspection to ensure the weld quality meets the required standards. Various testing methods, such as ultrasonic testing and visual inspection, may be employed.

There are various types of rail grinding machines designed for different purposes and applications in rail maintenance. Some examples of different types of rail grinders include mobile rail grinding machines to remove the flash after a weld is completed, fixed rail grinding machines to remove the flash after a weld is completed, and walk-behind rail grinding machines. Mobile rail grinding machines are self-propelled machines that can be moved along the rails to perform grinding operations to remove the flash after a weld is completed. Fixed rail grinding machines are stationary and are installed at specific locations along the rail network to remove the flash after a weld is completed. Walk behind gasoline powered mechanical grinding machines typically have a powered 6"×1" grinding stone which must be manually moved up and down while pressing against the web and advanced along the rail by moving it along the rail.

SUMMARY OF THE INVENTION

While rail web grinding machines are beneficial for maintaining and enhancing the condition of railroad rails, there are certain deficiencies or challenges associated with their use. They often have many mechanical components that lead to highly repetitive and manual work. Thus, a need exists to provide an improved rail web grinding machine that is able to eliminate some of this highly repetitive and manual work through its structural configuration and operation. Embodiments of the present disclosure provide a rail web grinding machine that may provide higher productivity than previous techniques and may eliminate highly fatiguing repetitive work for preparing the vertical web of a rail prior to being welded.

Accordingly, one exemplary embodiment of the present disclosure provides a rail grinding machine that travels along the railroad rails utilizes a work head to grind the rail, and more particularly grind the vertical web of the rail, wherein the work head is hydraulically powered. When a claim is clamped onto the rail, an operator may initiate a grinding cycle which causes the two grinding stones, each with its own grinding surface, to start rotating and moving up/down prior to engaging the rail. Then, the grinding surfaces move from their open and disengaged position to their closed and rail-engaging position. Then, the grinding stones continue to rotate and move vertically up and down, while rotatably contacting the vertical web of the rail. Then, the grinding wheels advance along the rail. Advancing along the rail can occur by just moving the work head or can occur by moving the entire rail grinding machine, or combination of both. When the full length of the grind is complete, the stones stop cycling, and open (i.e., return to the disengaged position). This cycle fully grinds the end of one rail. The operator can then unclamp the work head and move it to the adjacent rail to then grind it. In some exemplary embodiments, the end of both adjacent rails is not ground in one operation or cycle because the rails are not always aligned. However, in other embodiments when the ends of both adjacent rails are directly aligned, the grinding of the two aligned rails may occur in one single operation or cycle.

In this exemplary embodiment, or another exemplary embodiment, the work head is mounted on or carried by a frame. There may be an engine, such as a diesel powered engine, that powers hydraulics to control the work head as well as moving the machine between work points along the railroad. The operator may ride on the machine in a standing position while operating, however clearly a seat may be provided as well. This embodiment or another exemplary embodiment may include a dog clutch so that the travel system may be disconnected for high speed towing when the gang is getting on or off the active rail.

In another exemplary embodiment, a rail grinding machine is composed of a rail cart that moves along a rail of a railway via self-propelled locomotion or by being towed. A grinding assembly may simultaneously grind both sides of a vertical web of the rail via respective grinding surfaces that create a ground surface on each side of the vertical web prior to welding one end of one rail to another end of an adjacent rail. The ground surface created by the respective grinding surfaces receives a metallic plate in a subsequent welding process performed by a different welding machine. The grinding assembly is moveable to displace the respective grinding surfaces from engagement with the rail when the rail cart moves along the rail and is moveable to engage the respective grinding surfaces with the vertical web of the rail when the rail cart is maintained in a stationary position relative to the rail.

In yet another aspect, another exemplary embodiment of the present disclosure may provide a rail grinding machine comprising: a rail cart having a cart frame including a forward end and a rear end defining a longitudinal direction therebetween, a first side and a second side defining a lateral direction therebetween, and an upper end and a lower end defining a vertical direction therebetween, wherein the longitudinal direction, lateral direction and vertical direction collectively define three cartesian directions; a plurality of wheels operatively coupled to the cart frame, wherein the plurality of wheels permit the rail cart to travel along rails of a railway; a grinding assembly moveably carried by the cart frame, wherein the grinding assembly includes a first grinding surface, wherein the first grinding surface performs a grinding operation that grinds a first surface of a rail to expose a portion of that rail for future connection with a welding component when an end of the rail is to be welded with another end of an adjacent rail, wherein creation of a ground surface on the rail by the grinding assembly occurs prior to welding; wherein the grinding assembly is linearly moveable relative to the cart frame in at least two of the three cartesian directions; and wherein the first grinding surface of the grinding assembly is rotationally moveable around a pivot axis that extends parallel to the longitudinal direction and the first grinding surface is rotationally moveable about a drive axis for the first grinding surface. This exemplary embodiment or another exemplary embodiment may further include a trolley moveably connected to the cart frame, wherein the trolley moves in at least the lateral direction and the vertical direction relative to the cart frame. This exemplary embodiment or another exemplary embodiment may further include a clamp assembly on the trolley to maintain the trolley in a stationary position relative to the rail during the grinding operation. This exemplary embodiment or another exemplary embodiment may further provide that the clam assembly is located closer to the rear end of the cart frame than the first grinding surface. This exemplary embodiment or another exemplary embodiment may further include a carriage moveable connected to the trolley, wherein the carriage moves in at least the longitudinal direction relative to the trolley; wherein the grinding assembly is connected to and suspended downward from the carriage. This exemplary embodiment or another exemplary embodiment may further include a shoe plate on the trolley that couples with the rail to align the grinding assembly with the rail. This exemplary embodiment or another exemplary embodiment may further include an eccentric disc that is driven by a motor, wherein rotation of the eccentric disc imparts to the first grinding surface repeated oscillatory movement. This exemplary embodiment or another exemplary embodiment may further provide that the oscillatory movement occurs in the vertical direction. This exemplary embodiment or another exemplary embodiment may further include an arm having a first end and a second end, wherein the first end of the arm is connected to the eccentric disc and the second end of the arm is located below the first end of the arm, wherein the second end of the arm is connected to a lower member of the grinding assembly. This exemplary embodiment or another exemplary embodiment may further include at least one vertical member that interacts with rollers that permit movement of the first grinding surface in the vertical direction. This exemplary embodiment or another exemplary embodiment may further include at least one spring at least partially disposed within a bore defined by the at least one vertical member, wherein the at least one spring assists with uptake of the grinding assembly in the vertical direction during oscillatory movement. This exemplary embodiment or another exemplary embodiment may further include a lower end of the at least one spring located within the bore and coupled to the at least one vertical member. This exemplary embodiment or another exemplary embodiment may further include an upper end of the at least one spring that is coupled to an anchor and not connected to the at least one vertical member. This exemplary embodiment or another exemplary embodiment may further include a lower end of the at least one vertical member that is positioned vertically higher than the pivot axis about which the first grinding surface rotates. This exemplary embodiment or another exemplary embodiment may further include an upper end of the at least one vertical member that is positioned vertically below the carriage by a distance greater than or equal to half an amount of total vertical travel during oscillatory movement of the first grinding surface. This exemplary embodiment or another exemplary embodiment may further include at least one actuator that is moveable to effectuate pivoting movement of the first grinding surface about the pivot axis, wherein the actuator is located between two vertical members that are parallel to each other and aligned in the vertical direction. This exemplary embodiment or another exemplary embodiment may further include at least one gas shock adjacent the at least one actuator, wherein the at least one gas shock applies an engaging force to the first grinding surface in response to selected pivoting movement of the first grinding surface about the pivot axis. This exemplary embodiment or another exemplary embodiment may further include a first grinding wheel, wherein the first grinding surface is on the first grinding wheel; a motor mount connected with a motor to rotate the first grinding wheel about the drive axis; a bearing mount connected to the motor mount; a driveshaft extending through the bearing mount and the motor mount; wherein the first grinding wheel, the motor mount and connected motor, the bearing mount, and the driveshaft collectively define a first grinding wheel assembly; wherein the first grinding wheel assembly is pivotable about the pivot axis. This exemplary embodiment or another exemplary embodiment may further include a second grinding surface, wherein the second grinding surface is configured to grind a second surface of the rail to expose another portion of that rail for future connection with another welding component when the end of the rail is to be welded with the adjacent rail; wherein the second grinding surface of the grinding assembly is rotationally moveable relative to two axes. This exemplary embodiment or another exemplary embodiment may further provide that the first grinding surface and second grinding surface are moveable between a disengaged position and an engaged position, wherein when the first and second grinding surfaces are in the disengaged position, the first and second grinding surfaces are spaced apart from each other a first distance and the rail is interposed between the first and second grinding surfaces, and wherein when the first and second grinding surfaces are in the engaged position, the first and second grinding surfaces are spaced apart from each other a second distance that is less than the first distance and the rail is interposed between the first and second grindings and in contact with the first and second grinding surfaces. This exemplary embodiment or another exemplary embodiment may provide that the first grinding surface and the second grinding surfaces pivot relative to one another between an open and disengaged position and a closed and engaged position, wherein the grinding assembly grinds the rail surface in the closed and engaged position. This exemplary embodiment or another exemplary embodiment may further include a guide tube on the web-grinder frame, wherein the guide tube has a first end and a second end, wherein a length of the guide tube is defined between the first end and the second end of the guide tube and the length of the guide tube is oriented parallel to the longitudinal direction; a trolley having a trolley frame, the trolley in operative connection with the guide tube, wherein the trolley includes at least one wheel that operatively engages the guide tube to move the trolley along the guide tube parallel to the longitudinal direction, and trolley includes at least one other wheel that is oriented to permit rotational movement that effectuates vertical translational movement in contact with the at least one other wheel; a tubular mount that extends downward from the trolley and operatively engages the at least one other wheel, wherein the tubular movement moves in upward and downward in the vertical direction while in contact with the at least one other wheel; and the grinding assembly is carried by the trolley, wherein the trolley moves in a direction parallel to a length of the rail to move a grinding surface parallel to the length of the rail. This exemplary embodiment or another exemplary embodiment may provide that the grinding assembly is linearly moveable relative to the cart frame in all three cartesian directions.

In yet another aspect, an exemplary embodiment of the present disclosure may provide a rail grinding machine composed of a rail cart that moves along a rail of a railway via self-propelled locomotion or by being towed, the rail cart carrying a grinding assembly that simultaneously grinds both sides of a vertical web of the rail via respective grinding surfaces that create a ground surface on each side of the vertical web prior to welding one end of one rail to another end of an adjacent rail, wherein the ground surface created by the respective grinding surfaces is adapted to receive a metallic plate in a subsequent welding process performed by a different welding machine following the rail grinding machine along the railway, wherein the grinding assembly is moveable to displace the respective grinding surfaces from engagement with the rail when the rail cart moves along the rail and is moveable to engage the respective grinding surfaces with the vertical web of the rail when the rail cart is maintained in a stationary position relative to the rail.

In yest another aspect, another exemplary embodiment of the present disclosure may provide a computer program product including least one non-transitory computer readable storage medium in operative communication with a processor, the storage medium having instructions stored thereon that, when executed by the processor, implement a method to grind a vertical web surface on a rail, wherein the instructions comprise: instructions to position a grinding assembly near an end of a rail that is aligned with another rail prior to welding the ends of the rails together; instructions to move a first grinding surface and a second grinding surface of the grinding assembly toward a vertical web of the rail; instructions to contact the first grinding surface and the second grinding surface with the vertical web, thereby grinding the vertical web; instructions to oscillate the first grinding surface and the second grinding surface repeatedly relative to a vertical direction while grinding the vertical web; and instructions to move the first grinding surface and the second grinding surface along the length of the rail while oscillating the first grinding surface and the second grinding surface. This exemplary embodiment or another exemplary embodiment may further include instructions to move the grinding assembly along the length of the rail after a trolley carrying the grinding assembly is clamped to the rail. This exemplary embodiment or another exemplary embodiment may further include instructions to move a carriage relative to the trolley along the length of the rail after the trolley is clamped to the rail, wherein the grinding assembly is connected to and suspended downward from the carriage. This exemplary embodiment or another exemplary embodiment may further include instructions to position a shoe plate over or adjacent to the rail in response to lowering the grinding assembly toward the rail. This exemplary embodiment or another exemplary embodiment may further include instructions to rotate an eccentric disc with a motor, wherein rotation of the eccentric disc imparts to the first grinding surface repeated oscillatory movement. This exemplary embodiment or another exemplary embodiment may further include instructions to actuate at least one actuator located between two vertical members that are parallel to each other and aligned in the vertical direction, wherein actuation of the at least one actuator effectuates pivoting movement of the first grinding surface about the pivot axis. This exemplary embodiment or another exemplary embodiment may further include instructions to rotate a first grinding wheel, wherein the first grinding surface is on the first grinding wheel; instructions to initiate a motor connected with a motor mount to rotate the first grinding wheel about a drive axis; and instructions to pivot the grinding wheel and the motor about the pivot axis.

In yet another aspect, an exemplary embodiment of the present disclosure may provide a method comprising: positioning a grinding assembly near an end of a rail that is aligned with another rail prior to welding the ends of the rails together; moving a first grinding surface and a second grinding surface of the grinding assembly toward a vertical web of the rail; contacting the first grinding surface and the second grinding surface with the vertical web, thereby grinding the vertical web; oscillating the first grinding surface and the second grinding surface repeatedly relative to a vertical direction while grinding the vertical web; moving the first grinding surface and the second grinding surface along the length of the rail while oscillating the first grinding surface and the second grinding surface; and grinding the vertical web with the first grinding surface and the second grinding surface to create a ground surface that receives a metal plate prior to a welding operation. This exemplary embodiment or another exemplary embodiment may further include moving the grinding assembly along the length of the rail after a trolley carrying the grinding assembly is clamped to the rail. This exemplary embodiment or another exemplary embodiment may further include moving a carriage relative to the trolley along the length of the rail after the trolley is clamped to the rail, wherein the grinding assembly is connected to and suspended downward from the carriage. This exemplary embodiment or another exemplary embodiment may further include positioning a shoe plate over or adjacent to the rail in response to lowering the grinding assembly toward the rail. This exemplary embodiment or another exemplary embodiment may further include rotating an eccentric disc with a motor, wherein rotation of the eccentric disc imparts to the first grinding surface repeated oscillatory movement. This exemplary embodiment or another exemplary embodiment may further include actuating at least one actuator located between two vertical members that are parallel to each other and aligned in the vertical direction, wherein actuation of the at least one actuator effectuates pivoting movement of the first grinding surface about the pivot axis. This exemplary embodiment or another exemplary embodiment may further include rotating a first grinding wheel, wherein the first grinding surface is on the first grinding wheel; initiating a motor connected with a motor mount to rotate the first grinding wheel about a drive axis; and pivoting the grinding wheel and the motor about the pivot axis.

BRIEF DESCRIPTION OF THE DRAWINGS

One or more exemplary embodiment(s) of the present disclosure is set forth in the following description, is shown in the drawings and is particularly and distinctly pointed out and set forth in the appended claims. The accompanying drawings, which are incorporated in and constitute a part of the specification, illustrate various example configurations and methods, and other example embodiments of various aspects of the invention. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

FIG. 7 is a top, rear, first side perspective view of the shoe and lower member.

FIG. 8 is a bottom plan view of the shoe and lower member.

Similar numbers refer to similar parts throughout the drawings.

DETAILED DESCRIPTION

Figure 1:
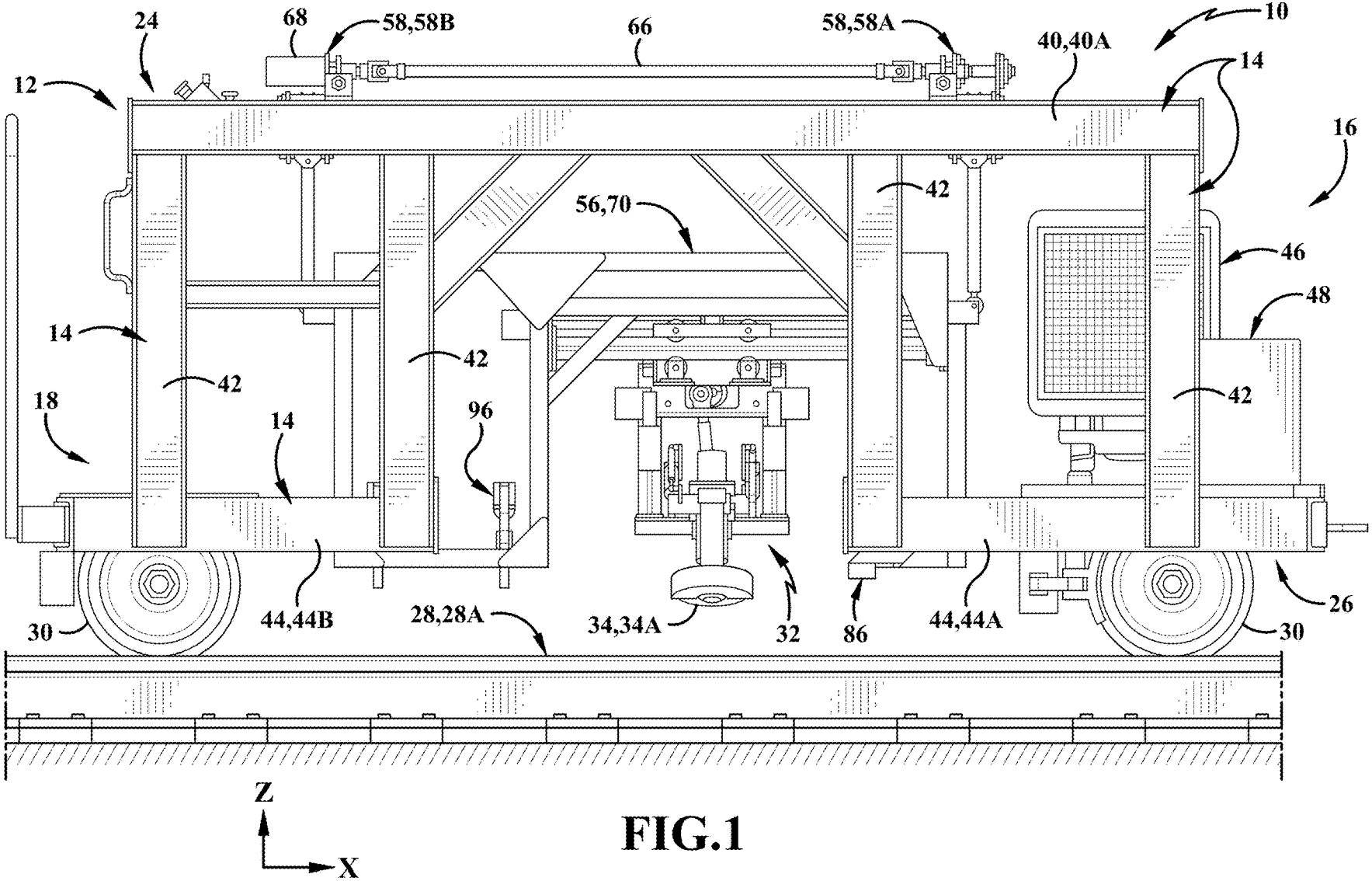
FIG. 1 is a first side elevation view of a rail grinding machine according to one exemplary embodiment of the present disclosure.

According to one exemplary embodiment shown throughout the Figures, a rail grinding machine 10 may include a rail cart 12 having a cart frame 14 including a forward end 16 and a rear end 18 defining a first or longitudinal direction X therebetween, a first side 20 and a second side 22 defining a second or lateral direction Y therebetween, and an upper end 24 and a lower end 26 defining a third or vertical Z direction therebetween, wherein the longitudinal direction, lateral direction and vertical direction collectively define three directions that are orthogonal to each other as cartesian coordinates/cartesian directions. Reference will be made to various components of rail grinding machine relative to other components utilizing these directions. The longitudinal direction X is associated with the forward and rear drive directions of the rail grinding machine 10.

Rail grinding machine 10 is configured to traverse or move along a railway 28 having two spaced apart rails, namely, a first rail 28A and a second rail (not shown, but understood to be located on the other side of the railway from first rail 28A). In one embodiment, each rail is substantially the same as the other and the rails are spaced apart by a lateral distance as one having ordinary skill in the railroad industry or railway art would easily understand. Each rail includes a head, a web or vertical webbing, and a base or foot. The head is located above the vertical webbing, and the vertical webbing is located above the foot. As understood in the art, the rail is a monolithic unibody member extending end-to-end in the longitudinal direction X defining a longitudinal length of the rail. Each rail has a vertically aligned center line that divides the rail between the gauge side and the field side of the rail. The head of the rail includes a top running surface or rail crown. On each respective side of the rail crown or running surface is a corner region. On each rail, there is a gauge corner region and a field corner region. Extending downward from the gauge corner region is the gauge face of the head. Extending downward from the field corner region is the field face of the head. On the gauge side of the face or the gauge face is a finishing surface that extends downwardly and inwardly towards the vertical web. Similarly, on the field side of the face or the field face is a finishing surface that extends downwardly and inwardly towards the vertical web. Each respective finishing surface transitions at the head-to-web transition corner. The web extends downwardly from the head. The web has a vertical first face and a vertical second face. In one particular embodiment the vertical first face is associated with and faces the gauge side and the vertical second side is associated with and faces the field side. Adjacent to the lower end of each face of the vertical web is a web-to-foot transition or fillet. The foot extends outwardly toward the field side and the gauge side, respectively. The foot terminates at a field side foot and a gauge side foot. On rail grinding machine 10, there are a plurality of wheels 30 operatively coupled to the cart frame 14. The plurality of wheels 30 permit the rail cart 12 of the machine 10 to travel, traverse or otherwise move along rails of railway 28.

Rain grinding machine 10 includes a grinding assembly 32 moveably carried by the cart frame 14. The grinding assembly 32 may also be referred to as a "working head." The grinding assembly 32 includes at least one grinding surface 34. In one particular embodiment, there is a first grinding surface 34A and a second grinding surface 34B. The first grinding surface 34A is configured to grind a first surface of a rail, such as the first rail 28A, to expose a portion of that rail for future connection with a welding component (e.g., a first copper or metal plate) when an end of the rail is to be welded with another end of an adjacent rail. The second grinding surface 34B is configured to grind a second surface of the rail, such as rail 28A, to expose another portion of that rail (i.e., first rail 28A) for future connection with another welding component (e.g., a second copper or metal plate) when the end of the rail is to be welded with the adjacent rail.

In one particular embodiment, the grinding assembly 32 (and thereby the first grinding surface 34A and the second grinding surface 34B) is linearly moveable relative to the cart frame 14 in all three directions X, Y, and Z. The first grinding surface 34A of the grinding assembly 32 is rotationally moveable around a pivot axis 36A that extends parallel to the longitudinal direction X and the first grinding surface 34A is rotationally moveable about a rotational drive axis 38A for the first grinding surface 34A. The second grinding surface 34B of the grinding assembly 32 is rotationally moveable relative to two axes. The second grinding surface 34B is rotationally moveable about a rotational drive axis 38B. Additionally, the second grinding surface 34B is rotationally moveable around a pivot axis. In the shown embodiment, the second grinding surface 34B is rotationally moveable around a second pivot axis 36B. However, in another embodiment, it is possible for the two grinding surfaces to share the same pivot axis such that the second grinding surface pivots about the first pivot axis 36A.

FIG. 1 depicts that cart frame 14 includes a plurality of rigid members connected together form an overall structure or frame that supports other components of the rail grinding machine 10. The rigid members that define cart frame 14 are typically formed from metal, such as steel, to impart sufficient structural and operational strength to the rail grinding machine 10. However, it is to be understood that other materials could be used so long as they have the strength necessary to perform the operations and functions detailed herein.

Figure 2:
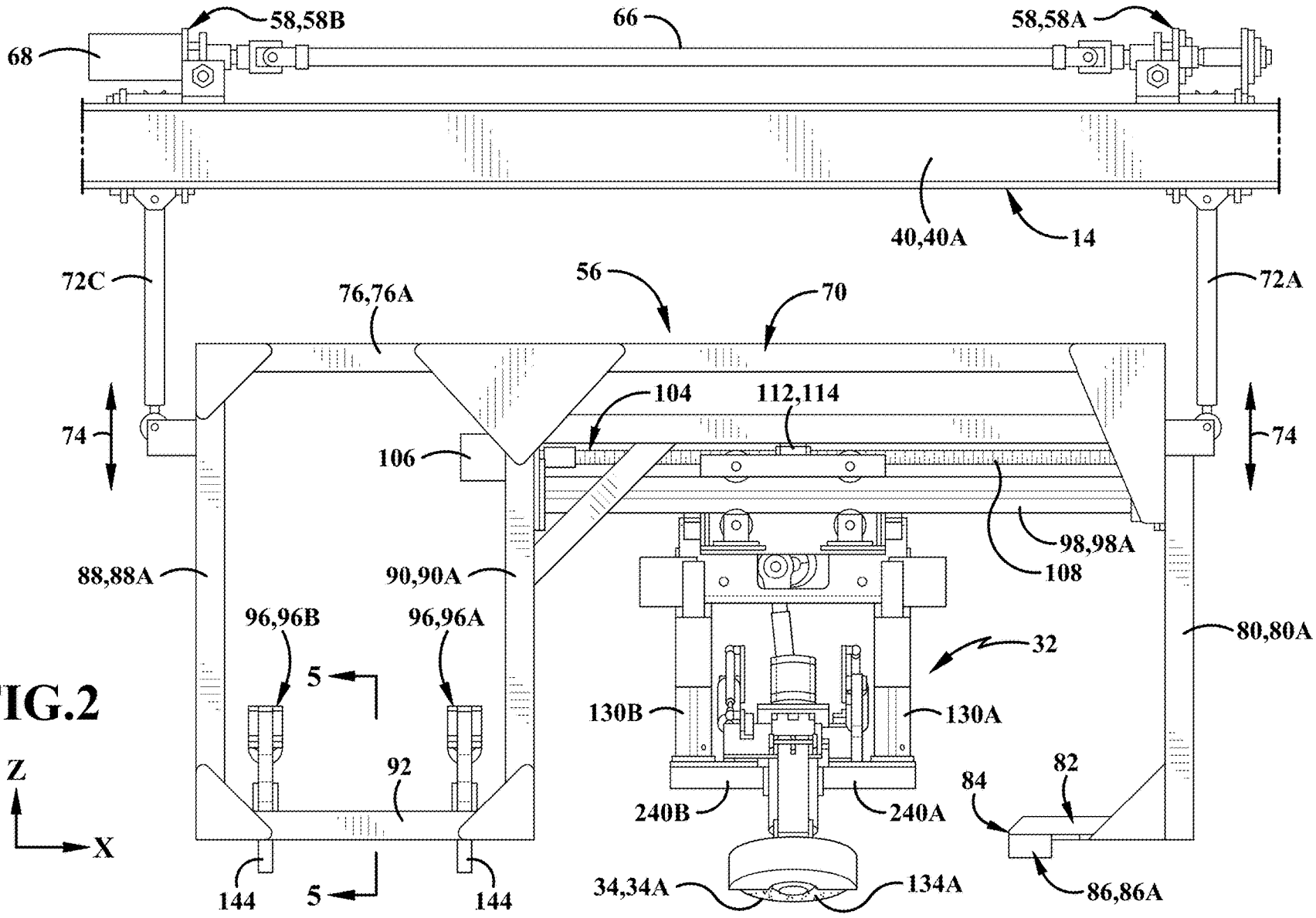
FIG. 2 is an enlarged first side elevation view of a trolley and a grinding assembly on the rail grinding machine.
Figure 3:
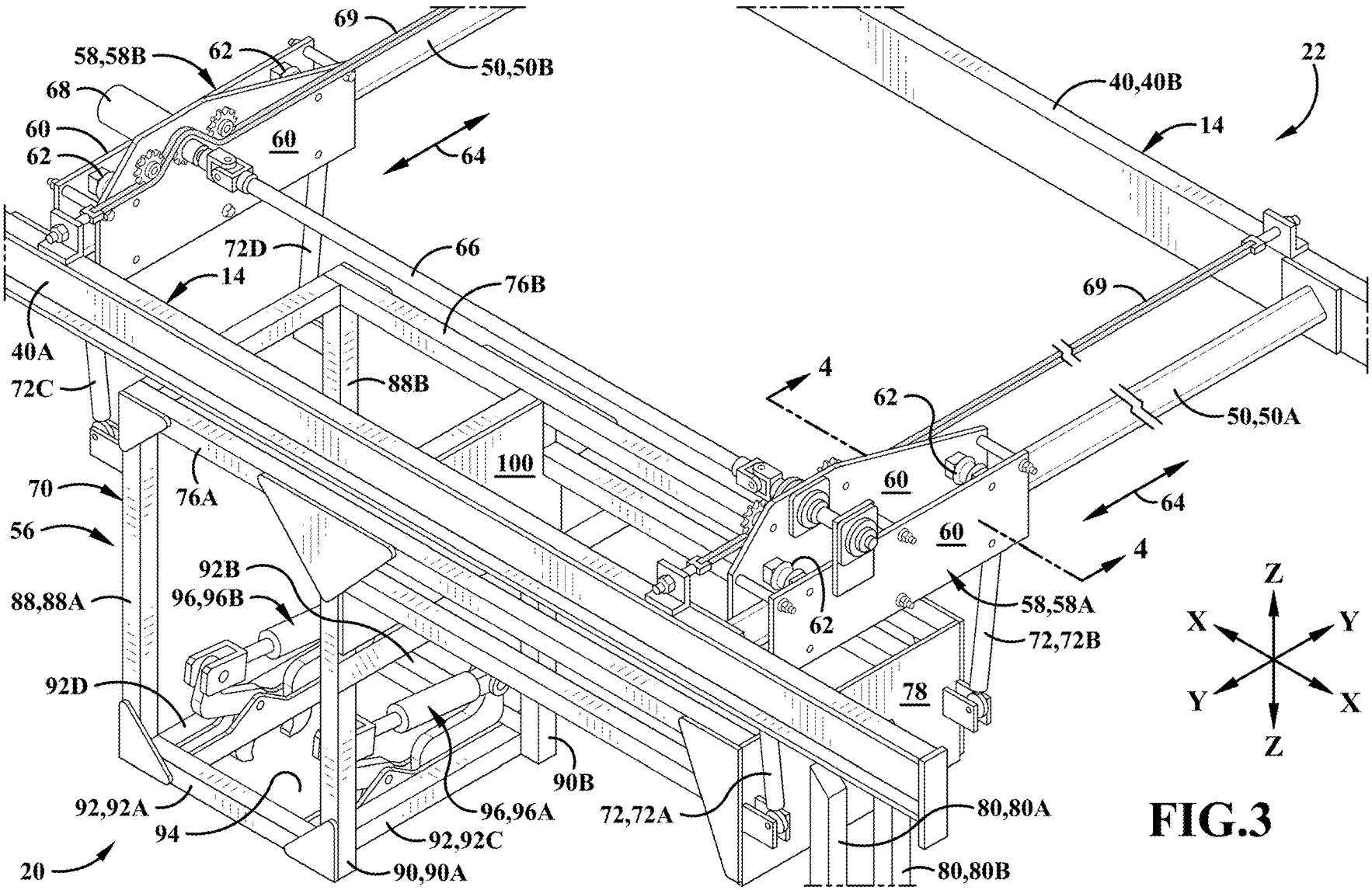
FIG. 3 is an enlarged top first side perspective view of the trolley and its lateral movement relative to a cart frame.

FIG. 1-FIG. 3 depict that in one exemplary embodiment, cart frame 14 includes at least one upper member 40, namely, a first side upper member 40A and a second side upper member 40B. The first side upper member 40A and the second side upper member 40B extend from a forward end to a rear end and are spaced apart relative to each other. The length of each respective upper member 40 is oriented in the longitudinal direction X and are spaced apart from each other relative to the lateral direction Y. Upper members 40A, 40B may have any structural configuration that supports the other members of the frame 14. In the shown embodiment, the upper members 40A, 40B are I-beams. The first side upper member 40A and the second side upper member 40B may be oriented at the same vertical height relative to vertical direction Z. There may be a plurality of vertically aligned support members 42 that extend downwardly from the lower surface of each upper member 40. Vertically aligned support members 42 may also be embodied as I-beams, but they may have other configurations. The lower end of each vertical support member 42 may be connected with at least one lower member 44. In one particular embodiment, there is a forward first side lower member 44A and a rear first side lower member 44B. There may also be a forward second side lower member (not shown) and a rear second side lower member (not shown). The manner in which the support members of cart frame 14 are connected may be accomplished in any manner known in the art such as, welding or bolt connections or the like. The manner in which the cart frame 14 is constructed can be optimized in a manner that enhances rigidity and structural support of the cart frame while minimizing weight without compromising the required physical strength requirements needed to perform the operations of grinding one of the surfaces on the first rail 28A or the second rail of railway 28.

Cart frame 14 may support other components and structures of the rail grinding machine 10. For example, the cart frame 14 may support an engine 46. In one particular embodiment, engine 46 is a diesel engine that is configured to power and drive the rail grinding machine 10 along the railway 28. Accordingly, engine 46 is in operative communication with at least one of the wheels 30 coupled to the cart frame 14. In another embodiment, the diesel engine 46 may be substituted for an electric motor capable of driving the wheels 30. When engine 46 is embodied as a diesel engine, the cart frame 14 may also support a dog clutch that is in operative communication with the engine 46. A dog clutch is a mechanical device used for connecting and disconnecting two rotating shafts. In the context of rail grinding machine 10 with a diesel engine 46, the dog clutch is employed to enable the machine 10 to switch between being towed and engaging in self-propelled locomotion. When the dog clutch is disengaged or in the "open" position, the connection between the rotating shafts is severed. In the case of towing, the machine is disconnected from the diesel engine 46. This allows the machine 10 to be freely towed by another vehicle or means without the diesel engine 46 providing power to the machine's drivetrain. To transition into self-propelled locomotion, the operator engages or closes the dog clutch. This action brings the rotating shafts into alignment and connects them. In the closed or engaged position, the dog clutch enables the transmission of power from the diesel engine 46 to the machine's drivetrain thereby effectuating rotation of wheels 30. The dog clutch may have at least two parts, each attached to one of the rotating shafts that need to be connected. These parts have teeth or projections, often referred to as "dogs," which interlock when the clutch is engaged. When the clutch is disengaged, these dogs remain separated, allowing for independent rotation of the shafts. The engagement and disengagement of the dog clutch may be controlled by the machine's operator or may be controlled via an electronic control unit (ECU) located on the machine 10 or located remotely from machine 10. This control can be manual or automated, depending on the design of the machine 10. In a manual setup, the operator may use a lever or a similar control mechanism to move the clutch into the desired position. In automated systems, the engagement may be controlled electronically or hydraulically. The ability to disengage the dog clutch is particularly useful when the machine 10 needs to be transported or towed along railway 28 without using its own power. When the dog clutch is engaged, the rotational power generated by the diesel engine 46 is transmitted through the connected shafts to the machine's transmission and drivetrain. This allows the machine 10 to move under its own power.

Cart frame 14 may also support a hydraulic assembly 48 or a hydraulic source 48 that is in operative communication with portion of the grinding assembly 32 to move the components thereof about the respective axis or to move the components thereof in all three directions as referenced herein. In the shown example, the engine 46 and the hydraulic source 48 are shown as being supported by the cart frame near the forward end 16 thereof. However, it is to be understood that the location of the engine 46 and the hydraulic source 48 may be at any location on the cart frame as one having ordinary skill in the art would understand without departing from the scope of the present disclosure. An exemplary hydraulic assembly or system carried by a grinding machine 10 includes various components designed to actuate and control different actuators on the machine 10. There may be a hydraulic power unit (HPU) having a hydraulic pump, a reservoir for hydraulic fluid, and a motor to drive the pump. The HPU pressurizes the hydraulic fluid and provides the energy needed to operate the hydraulic system. The reservoir stores hydraulic fluid, usually hydraulic oil. This fluid is circulated through the system to transfer power and lubricate various components. The reservoir also helps dissipate heat generated during hydraulic operations. The hydraulic pump is generally responsible for generating the flow of hydraulic fluid. It converts mechanical energy from the motor into hydraulic energy. Common types of hydraulic pumps which could be utilized include gear pumps, vane pumps, and piston pumps. Various actuators, some of which are referenced herein, are devices that convert hydraulic energy into mechanical motion. In some embodiments of grinding machine 10, various actuators may be present to control movements such as the positioning of grinding wheels, the adjustment of grinding pressure, and the movement of the grinding head. Hydraulic cylinders are exemplary components for translating hydraulic pressure into linear or rotary motion. In some embodiments of grinding machine 10, hydraulic cylinders may be employed to control the linear or rotational movement of the working head or grinding assembly 32. They are typically composed of a piston, rod, and cylinder barrel. The hydraulic system may also include a plurality of control valves that regulate the flow and direction of hydraulic fluid within the system. They determine the actuator's movement by directing the fluid to specific chambers in the hydraulic cylinders. Directional control valves, pressure control valves, and flow control valves are examples of valves used in hydraulic systems. Hydraulic hoses transmit pressurized hydraulic fluid from the power unit to various actuators on the grinding machine. They are made of flexible materials to accommodate movement. Fittings connect hoses to components like cylinders and valves. There may also be an accumulator that stores hydraulic energy to provide a temporary power source in case of sudden increases in demand. It helps maintain consistent pressure and can act as an emergency power source during peak loads. Additionally, there may be pressure relief valves that prevent system overpressure by releasing excess hydraulic fluid back to the reservoir. This safeguards the hydraulic components from damage. A hydraulic filtration system, including filters and strainers, helps extend the life of hydraulic components and ensures smooth operation.

Figure 4:
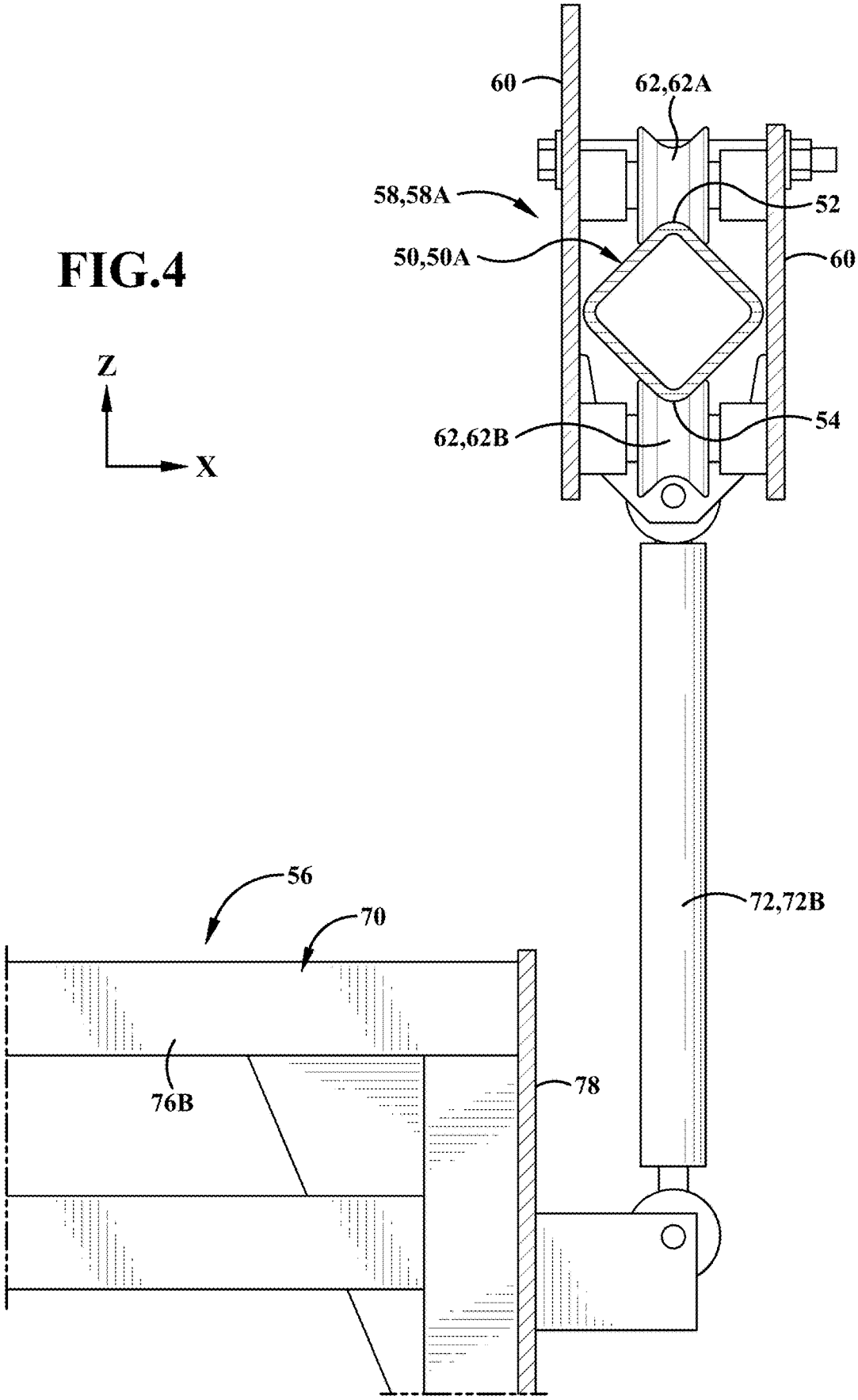
FIG. 4 is an elevational cross section view of the rolling mount taken along line 4-4 in FIG. 3.

FIG. 1-FIG. 4 depict that there is at least one transverse beam 50 extending in the lateral direction between the first side upper member 40A and the second side upper member 40B of the cart frame 14. In one particular embodiment, there is a forward transverse beam 50A and a rear transverse beam 50B. These transverse beams 50A, 50B may be identical or nearly identical to one another or have different shapes or configurations relative to one another without departing from the scope of the present disclosure. Transverse beams 50A, 50B are rigid members that are structurally supporting components of the rail grinding machine 10 as detailed herein. In one particular embodiment, each transverse beam 50A, 50B is a tubular member. In one particular embodiment, the tubular member defining each transverse beam 50A, 50B is a square tube as best seen in FIG. 4. The square tube that defines the transverse beam 50A is oriented such that a corner 52 of beam 50A is oriented as its vertical uppermost point and another corner 54 is oriented as its lowermost vertical point. In one particular embodiment, the square tube has walls or surfaces that extend downwardly at a 45 degree angle relative to the vertical direction Z from the uppermost corner 52 and walls that extend upwardly at approximately a 45 degree angle from the lowermost corner 54.

A trolley assembly or trolley 56 is supported by the transverse beams 50. Trolley 56 comprises at least one rolling mount 58. In one particular embodiment, there may be a forward rolling mount 58A and a rear rolling mount 58B. The forward rolling mount 58A may comprise one or more support plates 60 that are located on each side of the forward transverse beam 50A. Between the support plates 60 are at least one roller wheel 62 configured to engage with the transverse beam 50A. In one particular embodiment, there is an upper roller wheel 62A and a lower roller wheel 62B. The surface of each respective roller wheel 62A, 62B may complement the exterior surface of the forward transverse bean 50A. A similar configuration may be applied to the roller wheels located on the rear rolling mount 58B to allow the rear rolling mount 58B to roll along the rear transverse support beam 50B. The upper roller wheel 62A engages the upper corner 52 of beam 50A spanning the upper corner and extending downward along each side of the beam 50A. Similarly, the lower roller wheel 62B engages the lower corner 54 of the transverse beam 50A and extends upwardly along each side thereof. Each of the rollers 62 may freely rotate or spin along a roller axis that is aligned parallel to the longitudinal direction X. Rotational movement of the roller effectuates linear movement of the rolling mounts 58 in the lateral direction Y thereby imparting linear lateral movement for the trolley 56 and the grinding assembly 32 as indicated by arrows 64.

In this particular embodiment, the forward rolling mount 58A and the rear rolling mount 58B are operatively connected via a drive shaft 66 that is driven by a motor 68. Motor 68 may be an electric motor, a hydraulic motor or any other motor or engine capable of effectuating rotational movement of the drive shaft 66 around a draft shaft axis that is oriented parallel to the longitudinal direction X. The drive shaft 66 may include sprockets that are in operative communication with a chain or belt 69 that allow the sprockets to engage the chain or belt 69 to drive the rolling mounts 58 in the lateral direction Y as indicated by arrows 64. The control of the motor 68 to move the rolling mounts 58 and ultimately the trolley 56 in the lateral direction indicated by arrows 64 may be accomplished by the ECU comprising at least one non-transitory computer readable storage medium having instructions encoded there on that when executed by at least one processor perform operations to move the trolley in the lateral direction Y by powering the electric motor 68 to impart a rotational-to-linear movement from the draft shaft to the rolling mount 58.

With continued reference to the chain or belt 69 shown in FIG. 3, a symbolic break line is shown to represent that the belt 69 may have any length that sufficiently spans the lateral distance between the first side upper frame member 40A and the second side upper frame 40B. Similarly, forward beam 50A and rear beam 50B are shown with a symbolic break line representing that the beam may have any length that sufficiently spans the lateral distance between first side upper member 40A and second side upper member 40B.

Other portions of the trolley 56 hang down or are suspended from the rolling mounts 58. In one particular embodiment, a trolley frame 70 is suspended or hangs down from the rolling mounts 58. The trolley frame 70 may be suspended downwardly from the rolling mounts 58 via at least one actuator 72 having an upper end mounted to one of the rolling mounts 58 and a lower end mounted to a portion of the trolley frame 70. In the shown embodiment there are four actuators 72. More particularly, there is a first forward actuator 72A, a second forward actuator 72B, a first rear actuator 72C, and a second rear actuator 72D. The upper end of first forward actuator 72A is coupled adjacent to the first side of the forward rolling mount 58A. The upper end of the second forward actuator 72B is coupled to the second side of the forward rolling mount 58A. The upper end of the first rear actuator 72C is coupled to the first side of the rear rolling mount 58B. The upper end of the second rear actuator 72D is coupled to the second side of the rear rolling mount 58B. The lower ends of these four actuators 72A-72D couple with the trolley frame 70 to support the trolley frame 70 at least four connection points.

FIG. 2 depicts that the actuators 72A-72D may expand/extend and contract/collapse to impart linear movement in the vertical direction Z to the trolley frame 70 which carries the grinding assembly 32, which is indicated by arrow 74. The operation of the actuators 72A-72D to linearly extend and linearly contract thereby impart vertical movement to the trolley frame 70 may be controlled by the ECU. Alternately, in lieu of computer controlled movement of the actuators 72A-72D, hand controls could be employed, such as a crank assembly or another device that imparts vertical movement to the trolley frame 70.

With continued reference to FIG. 1-FIG. 4, trolley frame 70 is a rigid assembly defined by a plurality of components or constituent rigid parts connected together that structurally support or carry the grinding assembly 32. The trolley frame 70 is smaller and is carried by the cart frame 14. Thus, the trolley frame 70 can be considered as a sub-frame relative to the cart frame 14. Trolley frame 70 will move in the longitudinal direction X when the rail cart 12 (and its cart frame 14) is moving along the railway 28 and the trolley frame 70 will move in the lateral direct Y as previously discussed herein. Similarly, the trolley frame 70 may move linearly in the vertical direction Z in response to actuation of actuators 72. The components that form or define trolley frame 70 may take any shape or structural configuration that effectuates or otherwise accomplishes the operation of the grinding assembly 32 as further detailed herein. The components that form or define trolley frame 70 should have sufficient strength while trying to reduce weight to maintain optimal efficiency of grinding machine 10.

In the shown embodiment, the trolley frame 70 includes at least one upper member 76 that has a length oriented in the longitudinal direction X. In one particular embodiment, the at least one upper member 76 includes a first side upper member 76A and a second side upper member 76B. The upper members 76A, 76B extend forward-to-rearward parallel to the longitudinal direction X and are offset spaced apart from each other relative to the lateral direction Y. The upper members 76A, 76B may be defined by rigid beams capable of supporting and providing sufficient strength for the operation of the grinding assembly 32. Adjacent to the forward end of the upper members 76A, 76B is a forward brace or bracket 78 that extends in the lateral direction Y to connect the forward ends of the upper member 76A, 76B together. At least one forward vertical member 80 is connected with the bracket 78 and extends downwardly therefrom. In the shown embodiment, there is a first side forward vertical member 80A and a second side forward vertical member 80B. In one embodiment, the forward lower member 82 is rigidly connected to the lower end of at least one of the vertical members 80. The forward lower member extends rearward from the vertical member 80. The forward lower member 82 includes a rear terminal end 84 that is a free end such that the forward lower member 82 is cantilevered rearwardly in the longitudinal direction X relative the vertical member 80. Extending downward from the cantilevered rear terminal end 84 is a shoe 86 defined by a first side shoe plate 86A and a second side shoe plate 86B.

Trolley frame 70 further includes at least one rear vertical member 88 that extends downwardly from a connection with the rear end of one of the upper members 76. In one embodiment, there is a first side rear vertical member 88A and a second side rear vertical member 88B, wherein the first side rear vertical member 88A extends downwardly from the rear end of the first side upper member 76A and the second side rear vertical member 88B extends downwardly from the rear end of the second side of the upper member 76B. The rear vertical members 88A, 88B are offset parallel to each other relative to the vertical direction Z and extend downwardly, each terminating at a lower end.

Trolley frame 70 may also include intermediate vertical members 90A, 90B that are associated with the first side and second side respectively. The intermediate vertical members 90A, 90B are located between the rear vertical members 88 and the forward vertical members 80 relative to the longitudinal direction X. Trolley frame 70 may further include lower members 92 that are secured in a generally square or rectangular configuration between the rear vertical members 88 and the intermediate vertical members 90. More particularly, a first lower member 92A and a second lower member 92B may extend in the longitudinal direction X between the rear vertical members 88 and the intermediate vertical members 90. Lower members 92C, 92D may extend in the lateral direction Y between the first and second sides of the lower members 92A, 92B. Lower members 92 in the rectangular or square configuration define or bound an opening 94. The lower members 92A-92D also support at least one rail clamp assembly 96 to clamp the cart 12 to the rail to thereby reduce vibrations occurring during the grinding operation and maintain alignment with the rail during the grinding operation. In one particular embodiment, there is a forward first rail clamp assembly 96A and a rear second rail clamp assembly 96B.

Figure 6:
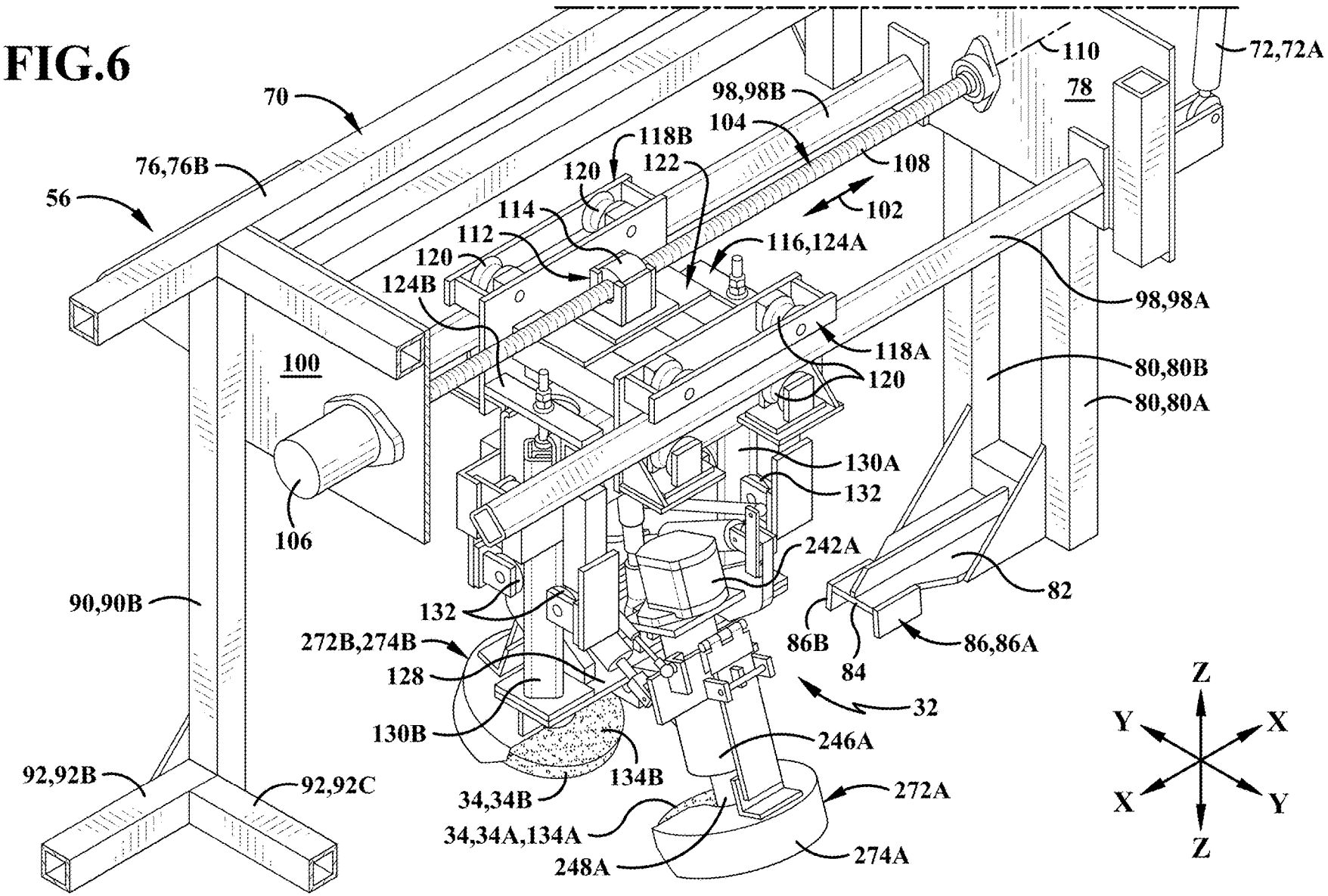
FIG. 6 is a top, rear, first side perspective view of the grinding assembly and portions of the trolley.

With continued reference to FIG. 2, as well as FIG. 6, trolley frame 70 further includes at least one guide beam or guide tube 98. In one particular embodiment, there is a first side guide tube 98A and a second side guide tube 98B. The at least one guide tube 98, or both guide tubes 98A, 98B, extend in the longitudinal direction X between the intermediate vertical members 90A, 90B and the forward vertical members 80A, 80B. In one particular embodiment, the forward end of guide tubes 98A, 98B are rigidly connected with bracket 78 and the rear end of the guide tubes 98A, 98B are connected with a plate or bracket 100 attached to the intermediate vertical members 90. As will described in greater detail herein, the guide tubes 98 are utilized as guides to allow the grinding assembly 32 to linearly move in the longitudinal direction X as indicated by arrow 102. Guide tubes 98 may have a similar construction as the transverse beams 50, having a generally square or rectangular cross-section so as to receive roller wheels there along for linear movement of the grinding assembly 32 in the longitudinal direction.

A linear actuator 104 has a motor 106 and a threaded shaft 108. Actuation of the linear actuator 104 imparts linear translation movement in the longitudinal direction X to the grinding assembly 32 in response to rotational movement of the threaded shaft 108 by motor 106 about a drive axis 110 that is located between guide tubes 98A, 98B and oriented parallel to the longitudinal direction X. Threaded shaft 108 is in operative communication with a nut 114 that complements the thread in the threaded shaft 108. The motor 106 is in operative communication with the ECU to receive instructions to effectuate or otherwise cause the rotation of the threaded shaft 108 that extends through the received 112. Rotation of the shaft 108 about axis 110 causes the nut 114 to interact with the threads to thereby impart movement in the direction of arrow 102 to move the grinding assembly 32, further detail of which is provided herein. The screw in the lead screw linear actuator has the threaded shaft 108 that cooperates with a nut 114 that is held in place by the receiver 112. Receiver 112 retains the nut 114 in a position such that rotation movement of the shaft 108 about the axis 110 imparts linear motion to the grinding assembly 32 as indicated by arrow 102. While the linear actuator 104 has been described as a lead screw linear actuator it is possible for other types of linear actuators to be used. For example, a linear actuator may include a ball screw linear actuator.

Now referring to the grinding assembly 32, the grinding assembly 32 operates to move the first grinding surface 34A and the second grinding surface 34B in a scissoring or pivoting action between an open position and a closed position. When the grinding surfaces 34A, 34B are in the closed position, the grinding surfaces are configured to grind the vertical web of the rail 28A of railway 28.

Grinding assembly 32 includes a carriage 116. The carriage 116 includes an upper first side roller mount 118A and an upper second side roller mount 118B. Each roller mount 118A, 118B comprises a plurality of rollers to allow movement of the carriage 116 in the longitudinal direction X as indicated by arrow 102. In some exemplary embodiments, the dimension of linear travel in the longitudinal direction X indicated by arrow 102 is in a range from about 12 inches to about 48 inches. In one particular embodiment, the dimension of linear travel in the longitudinal direction X indicated by arrow 102 is a range from about 27 inches to about 30 inches. The upper roller mount 118A includes rollers 120 that engage the first guide tube 98A. The upper second side roller mount 118B includes rollers 120 that engage the second guide tube 98B. A carriage central connector 122 is rigidly secured and extends between roller mount 118A and roller mount 118B. The receiver 112 is connected to and extends upwardly from the carriage central connector 122. The receiver being rigidly connected with the central connector that receives the nut 114 that is in operative communication with the thread shaft 108 of the linear actuator 104. Thus, actuation of the threaded shaft 108 effectuates movement of the carriage 116 and ultimately movement of the entire grinding assembly 32 in the longitudinal direction X as indicated by arrow 102. The central connector 122 has various components that hang downwardly or are suspended therefrom. More particularly, central carriage connector 122 may include a forward support plate 124A and a rear support plate 124B. Various components of the grinding assembly 32 are connected to the forward support plate 124A and rear support plate 124B.

The upper second side roller mount 118B carries an electric motor 126. In one particular embodiment, the motor 126 is supported below the roller 120 in the upper second side roller mount 118B. As such, the motor 126 is positioned vertically below the central connector 122 or the carriage 116. As will be described in greater detail below, the motor includes a drive shaft that rotates about an axis oriented in the lateral direction Y to impart oscillatory movement or repeated up-and-down movement to the first grinding surface 34A and the second grinding surface 34B. An alternative embodiment can have the motor 126 on the upper first side roller mount 118A.

The grinding assembly 32 includes a lower support plate 128. The length of the lower support plate, which is its maximum dimension, is oriented in the longitudinal direction X. Adjacent the forward end of the lower support plate 128 is a forward vertical guide tube 130A and adjacent the rear end of the lower support plate 120A is a rear vertical guide tube 130B. The guide tubes 130A, 130B extend vertically upward in the vertical direction Z from rigid connections with the upper surface of the lower support 128. In one particular embodiment, the forward guide tube 130A is directly below the forward support plate 124A and the rear vertical guide tube 130B is directly below the rear support plate 124B.

The first side roller mount 118A includes a plurality of lower rollers 132 that are configured to rotate about roll axes that are oriented parallel to the longitudinal direction X which permit vertical movement of the guide tubes 130A, 130B there along. Similarly, the second side roller mount 118B includes lower rollers 132 that also engage the vertical guide tubes 130A, 130B. The operation of which is provided in greater detail herein.

In one embodiment, the first grinding surface 34A is provided on a first grinding wheel 134A and the second grinding surface is provided on a second grinding wheel 134B. While the grinding surfaces 34A, 34B are shown in the exemplary embodiment as being embodied as or part of grinding wheels 134A, 134B, it is to be understood that the grinding surfaces 34A,34B can be alternatively shaped structures without departing from the scope of the present disclosure so long as the grinding surface 34A, 34B experience movement in three linear dimensions and pivoting or scissoring movement about at least one axis.

Figure 5:
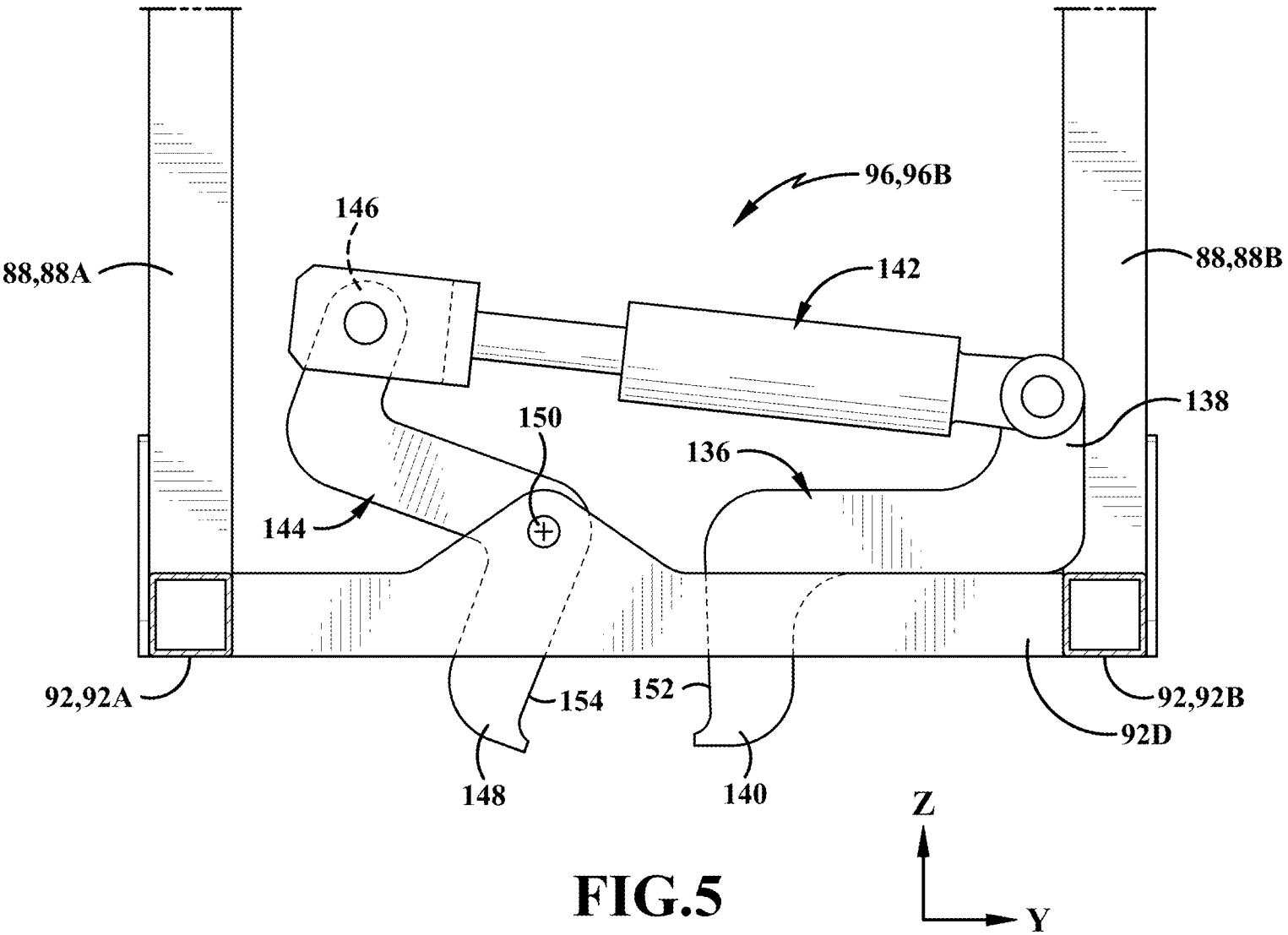
FIG. 5 is an elevational cross section view of a clamp assembly taken along line 5-5 in FIG. 2.

FIG. 5 depicts one of the rail clamp assemblies, namely, the second rail clamp assembly 96B, that is located within the area or space 94 defined by the lower members 92. It is to be understood that the first rail clamp assembly 96A works in conjunction or cooperates with the second rail clamp assembly 96B to clamp the cart onto the rail in unison as controlled by the ECU. In one particular embodiment, the rail clamp assembly 96A is identical to the second rail clamp assembly 96B and for brevity it is to be understood that the components discussed with respect to the second rail clamp assembly 96B are duplicated on the first rail clamp assembly 96A. Rail clamp assembly 96B includes a fixed jaw 136 having an upper end 138 and a lower end 140. The upper end 138 is connected with an end of an actuator 142, which may be, according to one exemplary embodiment, a hydraulic actuator. The upper end 138 may be connected with the cylinder end of actuator 142. Actuator 142 may further include a piston end that is opposite the cylinder end, wherein the piston moves inward and outward relative to the cylinder in response to hydraulic actuation by the ECU. Clamp assembly 96B further includes a moveable jaw 144 having an upper end 146 and a moveable lower end 148. Intermediate the upper end 146 and the lower end 148 is a pivot connection 150 defining a pivot axis that extends parallel to the longitudinal direction X (into the page as shown in FIG. 5). The pivot axis defined by the pivot connection of the movable jaw 144 to the lower member 92D enables the lower end 148 to pivot between an open position (i.e., disengaged) and a closed position (i.e., clamped; a clamped position). FIG. 5 depicts the jaw in the open position. To move the jaw to the closed position, the actuator 142 will be controlled by the ECU to extend the piston relative to the cylinder. Extension of the cylinder causes the moveable jaw 144 to pivot about the pivot axis defined by the pivot connection 150 in the counterclockwise direction when looking rearward. The lower end 148 on the moveable jaw is brought closer to the fixed lower end 140 on the fixed jaw 136.

As shown in FIG. 5, the lower ends 148 and 140 extend downwardly below the lowermost surface of lower member 92, namely, member 92D. The lower ends of the jaws are shaped in a manner that allows them to grip the head of the rail to secure the cart 12 to the railway 28 and the grinding operation, which will be described in greater detail herein, occurs. Each clamp 136, 144 includes a flat rail engaging surface. More particularly, there is a flat surface 152 on the fixed jaw 136 and a flat surface 154. Each of these flat surfaces 152, 154 are configured to engage the head of the rail, such as first rail 28A, when the clamp is moved from its open position to the closed/clamped position. The lower tip of each lower end 140, 148 is flared or establishes a tooth-like structure to assist with gripping the rail when the clamp assembly 96 is in the closed position.

Figure 9:
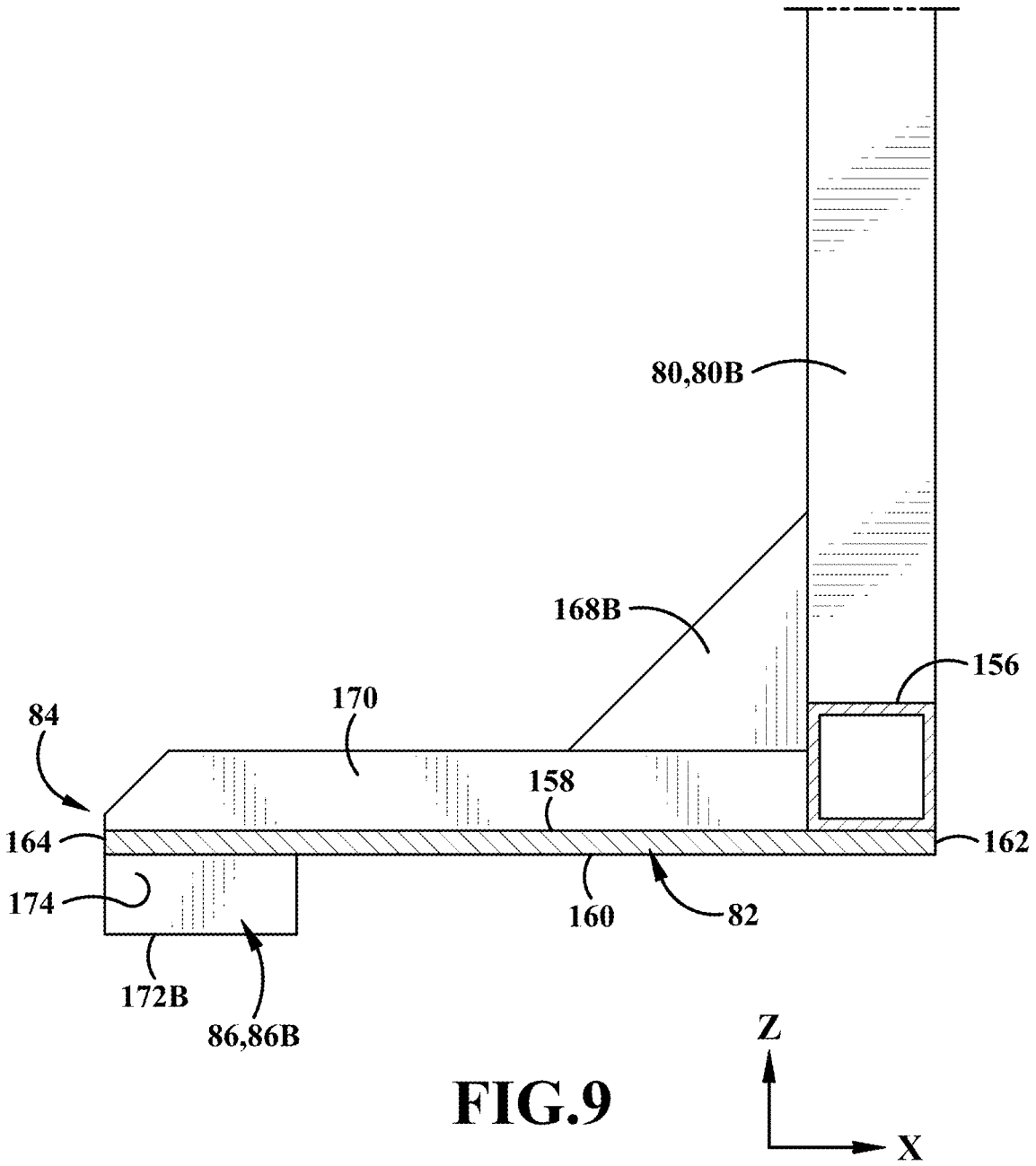
FIG. 9 is a cross section view of the shoe taken along line 8-8 in FIG. 7.
Figure 10:
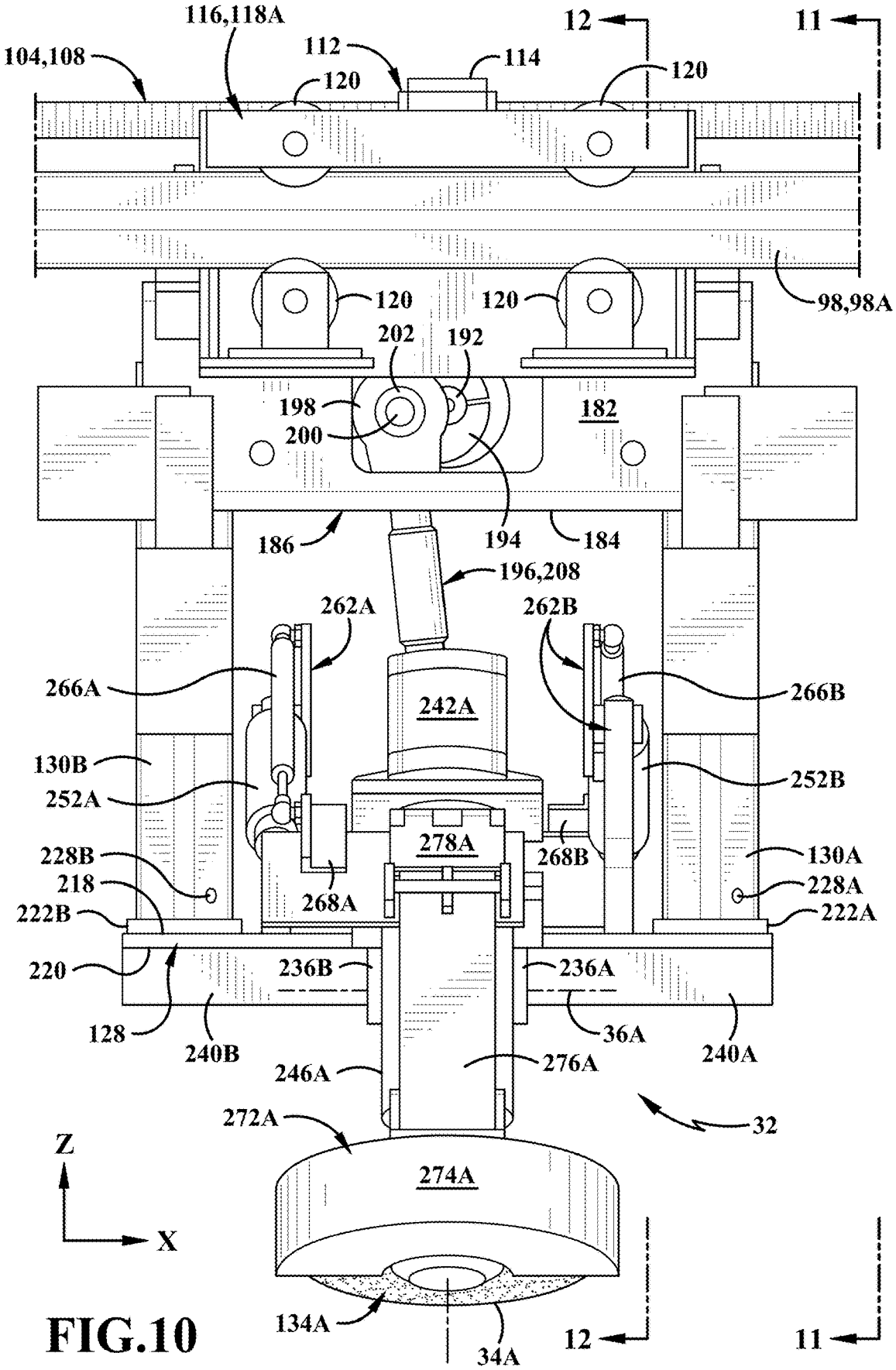
FIG. 10 is a first side elevation view of the grinding assembly.

FIG. 7-FIG. 9 depict the configuration of the structure, or shoe 86, that assists with aligning the grinding assembly 32 relative to one of the rails, such as first rail 28A, for the grinding operation. Between the first vertical member 80A and the second vertical member 80B is a cross member 156. The cross member 156 extends in the lateral direction Y between the inner faces of the vertical members 80A, 80B. Cross member 156 is positioned atop the upper surface 158 of the forward lower member 82. The upper surface 158 faces upwardly and is opposite a downwardly facing lower surface 160. Lower member 82 includes a forward end 162 and a rear end 164. The lower member 82 has a greater width measured in the lateral direction Y than the rear end 164. Namely, there is a neck region 166 on the lower member 82 wherein the outer edges of the lower member 82 taper inwardly and rearward toward the rear end 164. The lower member 82 may be supported with a number of support flanges. For example, a first side gusset 168A may connect the first side edge of the lower member 82 with the first vertical member 80A. A second side gusset 168B may connect the second side edge of the lower member 82 with the second vertical member 80B. The side edges that connect with the gussets 168*a*, 168B are linear and located forward of the neck region 166. A support flange 170 may extend upwardly from the upper surface 158 of lower member 82. Support flange 170 may have a forward end that is connected with the cross member 156 and a rear end that terminates at or adjacent the rear end 164 of the lower member 182. The support flange 170 may be centered relative to the lower member and extend parallel to the longitudinal direction X. FIG. 7 additionally shows that the shoe 86 is formed as plates that extend downwardly from the side edges of the lower member and are located closer to the rear end 164 of the lower member 82 than the neck region 166. The vertical height of the plates defining the shoe plates 86A, 86B may be greater than the vertically aligned thickness dimension of the head of the rail such that the lower end 172A of the first shoe plate 86A and the lower end 172B of the second shoe plate 86B are disposed below the head of the rail adjacent the gauge face or the field face of first rail 28A. As will be described in greater detail below the rail region 174 is defined between the first shoe plate 86A and the second shoe plate 86B. The rail region 174 has a dimension oriented in the lateral direction Y that is equal to or greater than the width dimension of the head of the rail measured from the gauge face to the field face. This allows the rail region 174 to received the head of the rail such as first rail 28A, to allow the lower member to seat with or sit atop the running surface or rail crown of the head of the rail. This configuration allows the engagement of lower member with the rail during the grinding operation, which will be described in greater detail herein.

FIG. 10-FIG. 13 depict the configuration and operation of the grinding assembly 32 in greater detail. As previously discussed, the carriage 116 moves in the longitudinal direction X along guide tubes 98A, 98B. The rollers 120 may engage the square guide tubes 98 in a manner similar to that which was discussed with respect to the trolley 56.

The central connector 122 may comprise a plate 176 that spans across two cross members 178A, 178B. Cross members 178A, 178B are supported by and connect with a plate 180 positioned below the cross members 178A, 178B. A vertical plate 182 extends downwardly from plate 180 to a lower plate 184. Collectively, the top plate 180, the two vertical plates 182, and the lower plate 184 define a box frame 186 that is connected to the lower end of cross members 178A, 178B. The box frame defines an aperture 188 by and edge 190. The edge 190 is formed in the vertical plate 182 of box frame 186. The motor 126 is mounted on one of the vertical plates 182 that form sidewalls of the box frame 186. A crank shaft 192 of motor 126 extends through the aperture 188. An eccentric disc or eccentric sheave 194 is connected to the crank shaft 192 of the motor 126. The crank shaft 192 drives the eccentric disc 194. The eccentric disc 194 is connected with an arm 196. More particularly, an upper end 198 of arm 196 is connected with an eccentric connection point 200 on the eccentric disc 194 via a bearing 202. Arm 196 extends through a hole or aperture 185 defined in the lower plate 184. Operation of the motor 126 causes the crank shaft 192 to rotate the eccentric disc 194 about the axis defined by the crank shaft 192. The eccentric connection point 200 revolves about the crank shaft axis as indicated by arrow 204. The rotation of the upper end 198 about the crank shaft axis results in an oscillatory or oscillation movement of the arm 196 in the vertical direction as indicated by arrow 206. The oscillation movement or oscillatory movement of the arm, 196 effectuates an up-and-down movement to the grinding surface 34A, 34B based on the connection of the arm 196 to the lower framework of the grinding assembly 32. Details of the lower framework of the grinding assembly 32, which include the lower support 128 are described in greater detail herein.

The arm 196 includes a generally cylindrical body 208 extends from the upper end 198 to a lower end 210 through the aperture 185 in the lower plate 184 of box frame 186. The body 208 can be structured in any rigid manner. As depicted throughout the Figures, the body has varying diameters having circular profiles narrowing from the upper end towards the lower end 210. However, the body 208 of the arm 196 may have a uniform diameter or uniform thickness depending on the application specific needs of the grinding assembly 32. The lower end 210 of the arm 196 may be pivotably connected with an anchor 212 via a bearing 214. The anchor 212 can extend upwardly from the upper surface of the lower support 128. The anchor 212 may be defined by a pair of opposing flanges that extend upwardly from the lower support 128 and receive a laterally aligned pin 216 therethrough. The pin 216 is inserted through the bearing 214 to effectuate pivotably connected movement of the second end 210 of the arm 196 about an axis extending in the lateral direction Y defined by the pin 216. The pivoting connection of the lower end 210 of the arm 196 cooperates with the oscillatory movement or oscillation movement of the upper end 198 of the arm 196 as indicated by arrow 206 when the eccentric sheave eccentric disc 194 rotates as indicated by arrow 204.

The lower support 128 includes an upwardly facing top surface 218 and a downwardly facing bottom surface 220. The top surface 218 of the lower support 128 supports a forward base plate 222A and a rear base plate 222B. The forward base plate 222A supports the vertical guide tube 130A and the rear base plate 222B supports the rear vertical guide tube 130B. Each guide tube 130A, 130B extends upwardly in the vertical direction Z from their respective base plates. Further, each guide tube is hollow and is configured to receive a spring therein. Namely, a forward spring 224A is disposed within a bore defined by the forward vertical guide tube 130A and a rear vertical spring 224B is disposed within a bore defined by the rear vertical guide tube 130B. Forward spring 224A includes a lower end 226A that is mounted, connected or fixed to the guide tube 130A via an anchor 228A. The second spring 224B includes a lower end 226B that is mounted, connected or fixed connected with the second or rear vertical guide tube 130B via an anchor 228B. Alternatively, the lower ends of the first and second springs 224A, 224B may be connected to another portion of the assembly 32 such as the respective base plates 222A, 222B so as to establish a rigid connection between the lower ends of the springs 224A, 224B with the lower support 128. Each spring 224A, 224B has an upper end 230A, 230B, respectively. The upper end of the springs is connected with suspended anchors. Namely, a forward suspended anchor 232A is connected with the upper end 230A of the first spring 224A. A rear suspended anchor 232B is connected with the upper end 230B of the rear vertical spring 224B. Each of the suspended anchors 232A, 232B are connected with the box frame 186 by extending through the top plate 180 of the box frame 186. The forward anchor 232 is positioned forward of the cross member 178A, 178B, and the rear anchor 232B is positioned rearward of the cross members 178A, 178B. A portion of each of the suspended anchors 232A, 232B is disposed within the interior bore of the vertical guide tubes 130A, 130B, respectively.

Each guide tube has an exterior surface that contact rollers 132 to permit vertical movement in the vertical direction Z as the motor oscillates the grinding assembly 32. More particularly, the springs 224A, 224B assist with the vertical upward movement or uptake movement of the grinding assembly, namely, the first and second grinding surfaces 34A, 34B as grinding surfaces are moved or oscillated up-and-down as indicted by arrow 234 in response to movement of the arm 236 as indicated by arrows 204 and 206.

Below the lower surface 220 of the lower support plate 128 is a pair of mounting plates, namely, a forward mounting plate 236A and a rear mounting plate 236B. The mounting plates 236A, 236B extend downwardly from a rigid connection with the lower surface 220 of the lower support plate 128. The mounting plates 236A, 236B extend laterally in the lateral direction Y across the width of the lower support plate 128. A first side rod member 238A extends between the mounting plates 236A, 236B and defines first pivot axis 36A. A second rod member 238B extends between the mounting plates 236A, 236B and defines the second pivot axis 36B. The rods 238A, 238B that define the pivot axes 36A, 36B, respectively, are oriented in the longitudinal direction X and allow the grinding surfaces 34A, 34B to pivot thereabout.

A forward support flange 240A is rigidly connected with the lower surface 220 of the lower support member 228. The forward support flange has a rear end that is rigidly connected with the forward facing surface of the first plate 236A. A rear support flange 240B is rigidly connected with the lower surface 220 or the lower support member 128. The rear support flange 240B has a forward end the is rigidly secured with the rear facing surface of the rear plate 236B. Support flanges 240A, 240B provide structural rigidity to the lower support member and the grinding assembly 32 as it moves up-and-down as indicated by arrows 228 and as the grinding surfaces 34A, 34B pivot about axes 36A, 36B, respectively.

With continued reference to FIG. 11A-FIG. 13, the grinding assembly 32 further includes a first side motor 242A and a second side motor 242B. First side motor 242A is connected with a motor mount 244A. The second side motor 242B is connected with a second side motor mount 244B. The first side motor mount 244A is connected with a first side bearing mount 246A. The second side motor mount 244A is connected with a second side bearing mount 246B. A first side drive shaft 248A defines drive axis 38A and is located within the first side bearing mount 246A. The second side drive shaft 248B defines drive axis 38B and is located within the second side bearing mount 246B. The grinding wheel 134A is connected to drive shaft 248A and rotates about axis 38A in response to being driven by the first motor 242A. The second grinding wheel 134B is connected to drive shaft 248B and rotates about axis 38B in response to being driven by second motor 242B.

Collectively, the first motor 242A, motor mount 244A, bearing mount 246A, drive shaft 248A, and grinding wheel 134A collectively define a first side grinding wheel assembly 250A. Further, collectively, the second motor 242B, motor mount 244B, bearing mount 246B, drive shaft 248B, and grinding wheel 134B define a second side grinding wheel assembly 250B. The grinding wheel assemblies 250A, 250B are configured to pivot or scissor relative to one another between open and closed positions to effectuate the grinding action of the vertical web of the rail 28. In another embodiment, at least one of the grinding wheel assemblies 250A or 250B is pivotable relative to the other. Stated otherwise, one embodiment could have a configuration in which one grinding wheel assembly, such as the second grinding wheel assembly 250B remains stationary and the first grinding wheel assembly 250A pivots relative to the second grinding wheel assembly 250B.

In the shown embodiment, the first grinding wheel assembly 250A pivots about axis 36A and the second grinding wheel assembly 250B pivots about the second axis 36B. However, as stated previously, axes 36A, 36B can be aligned coaxially to define a single pivot axis in which both the first grinding wheel assembly 250A and the second grinding wheel assembly 250B pivot about the same axis.

Figure 12:
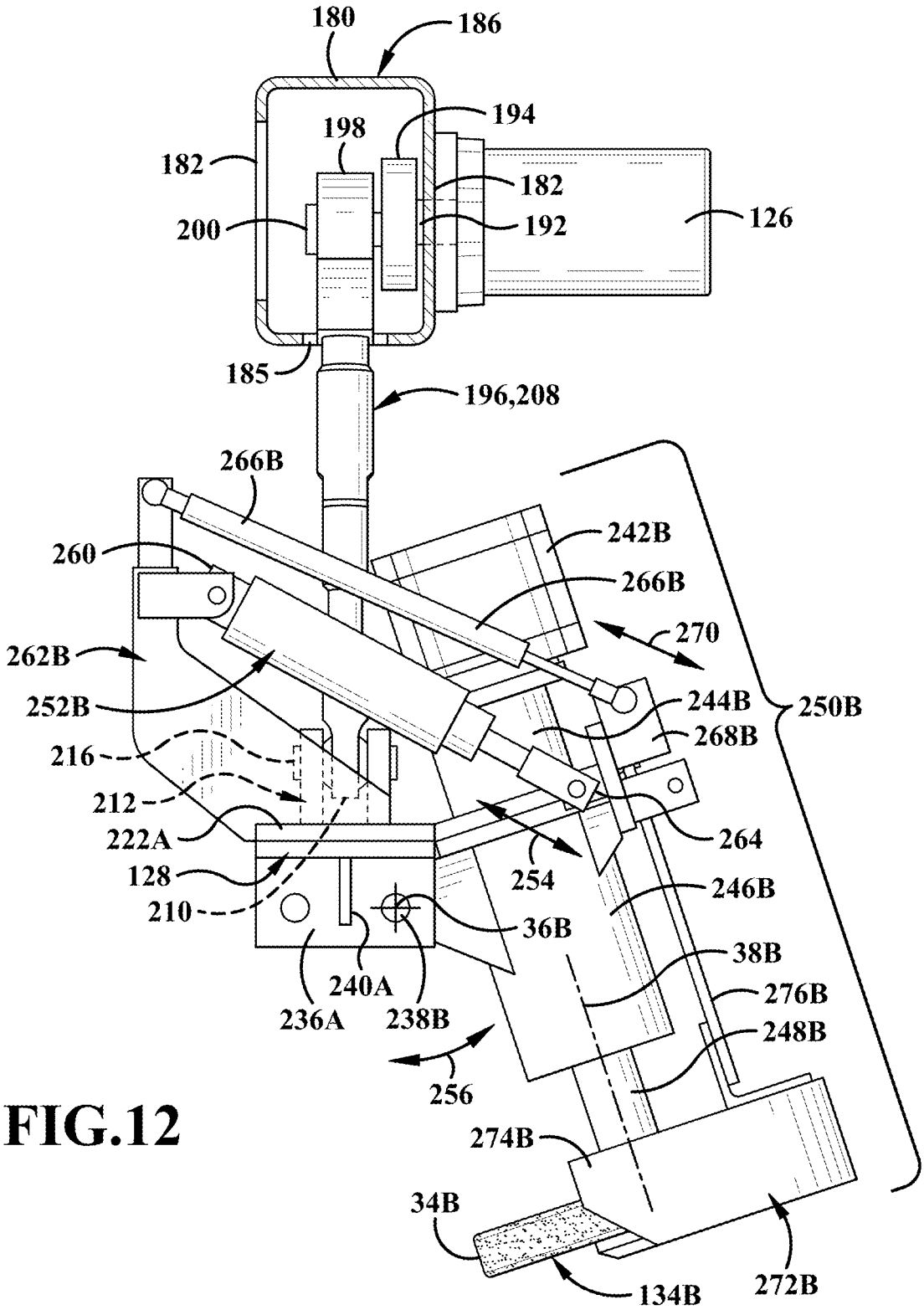
FIG. 12 is a rearward-looking partial elevational cross section view of the grinding assembly taken along line 12-12 in FIG. 10.
Figure 13:
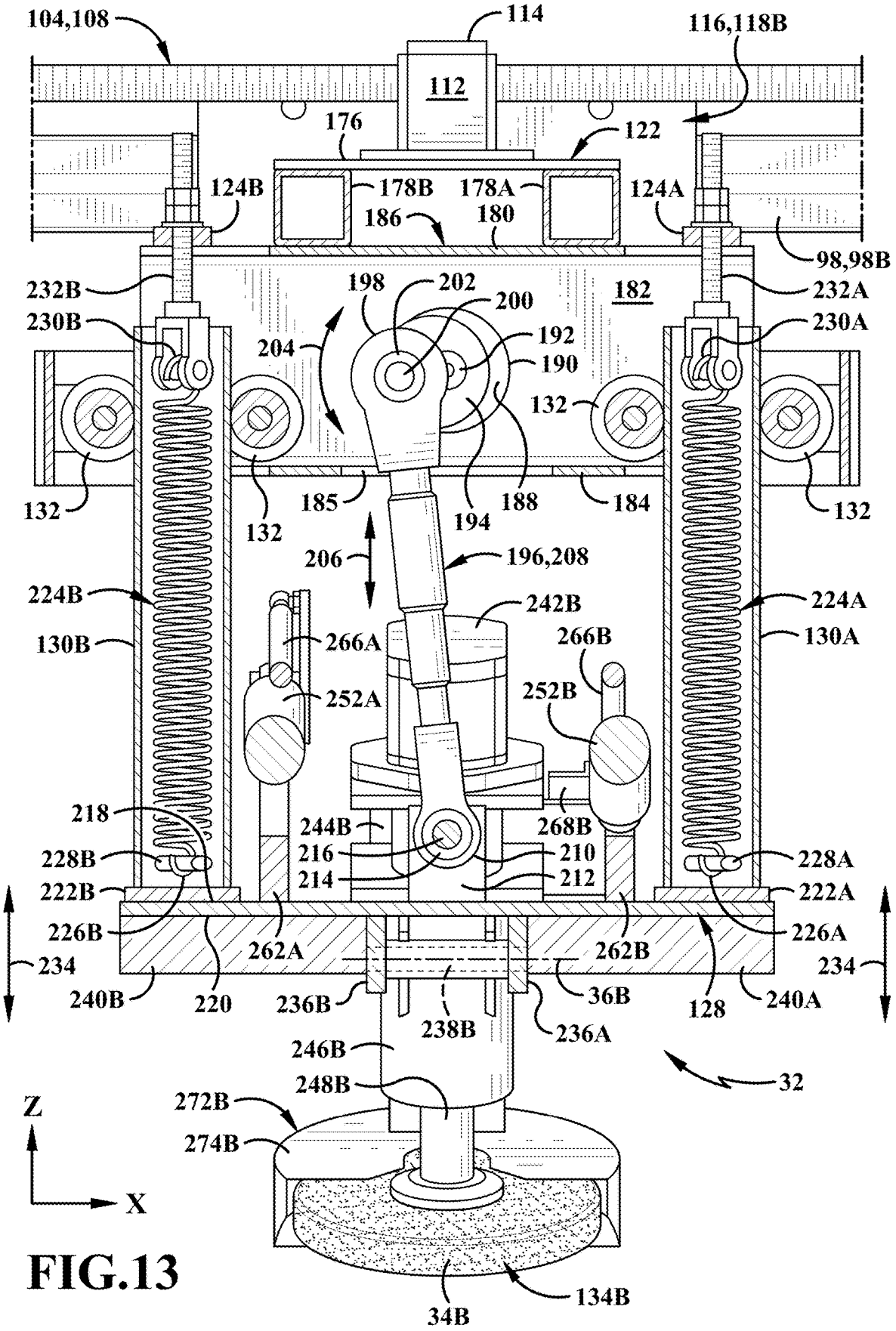
FIG. 13 is an elevational cross section view of the grinding assembly taken along line 13-13 in FIG. 11A.

The grinding assembly 32 utilizes actuators to effectuate or cause the pivoting or rotational movement of the first grinding wheel assembly 250A and the second grinding wheel assembly 250B. In one particular embodiment, a first actuator 252A has a first end 260 pivotably coupled with an actuator mount 262A. A second actuator 252B has an end that is pivotably coupled with a second actuator mount 262B. The actuator mounts 262A, 262B extend upwardly from the lower support 128A and are located between the vertical support members 130A, 130B. Additionally, actuators 252A, 252B are also located between the vertical support members 130A, 130B. First actuator 252A has a second end 264 that is connected to either the motor mount 244A or the bearing mount 246A on the first grinding wheel assembly. Similarly, the second actuator 252B has an end that is coupled to motor mount 244B or bearing mount 246B on the second grinding wheel assembly 250B. The second end 264 of the actuator 252A is pivotably connected to the component of the first grinding wheel assembly 250A. As shown in FIG. 12 the actuator 252B may move linearly between an extended and a collapsed position as indicated by arrow 254. Extending and collapsing the cylinder on the actuator 252B effectuates rotational or pivoting movement of the second grinding wheel assembly 250B about pivot axis 36B as indicated by arrow 256. Actuator 252 may be controlled and connected to the ECU and receive hydraulic power from the hydraulic assembly or source 48.

A first gas shock 266A may be connected and extend between the first actuator mount 262A and a portion of the first grinding wheel assembly 250A. In the shown embodiment, gas shock 266A connects with an upper end of the actuator mount 262A and extends to a mounting block 268A connected to the motor mount 244A. A similar configuration is provided with respect to the second grinding wheel assembly 250B in which a second gas shock 266B is connected to an upper end of the actuator mount 262B and is also connected to a mounting block 268B on the second motor mount 244B. The gas shock may also extend and collapse in a linear manner as indicated by arrow 270. The gas shock and the actuator cooperate together to effectuate the pivoting action of the grinding surfaces 34A, 34B relative to each other to move them towards and away from vertical web of the rail 28 that is to be grinded.

Figure 11A:
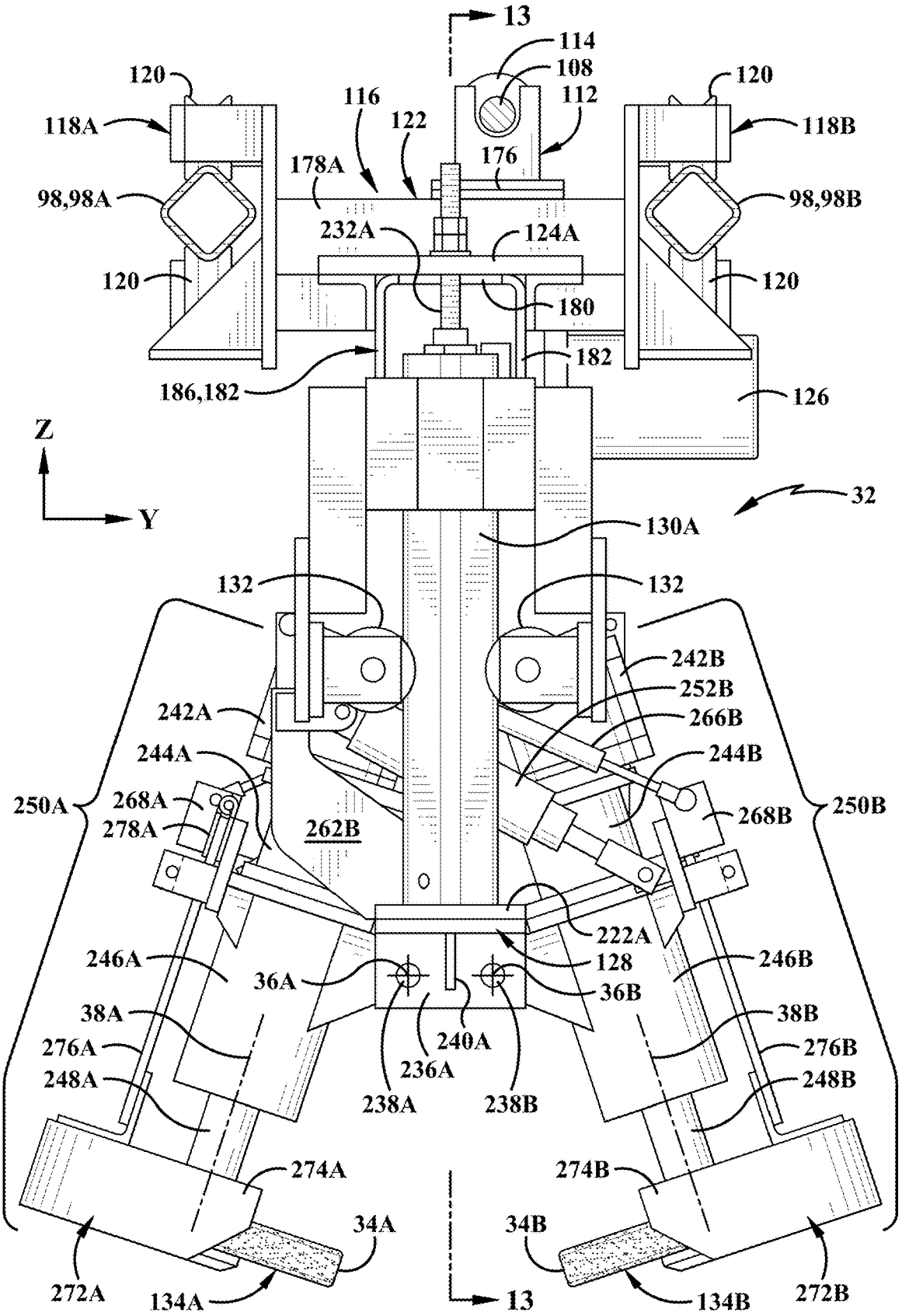
FIG. 11A is a rearward-looking elevational cross section view of the grinding assembly taken along line 11-11 in FIG. 10.
Figure 11B:
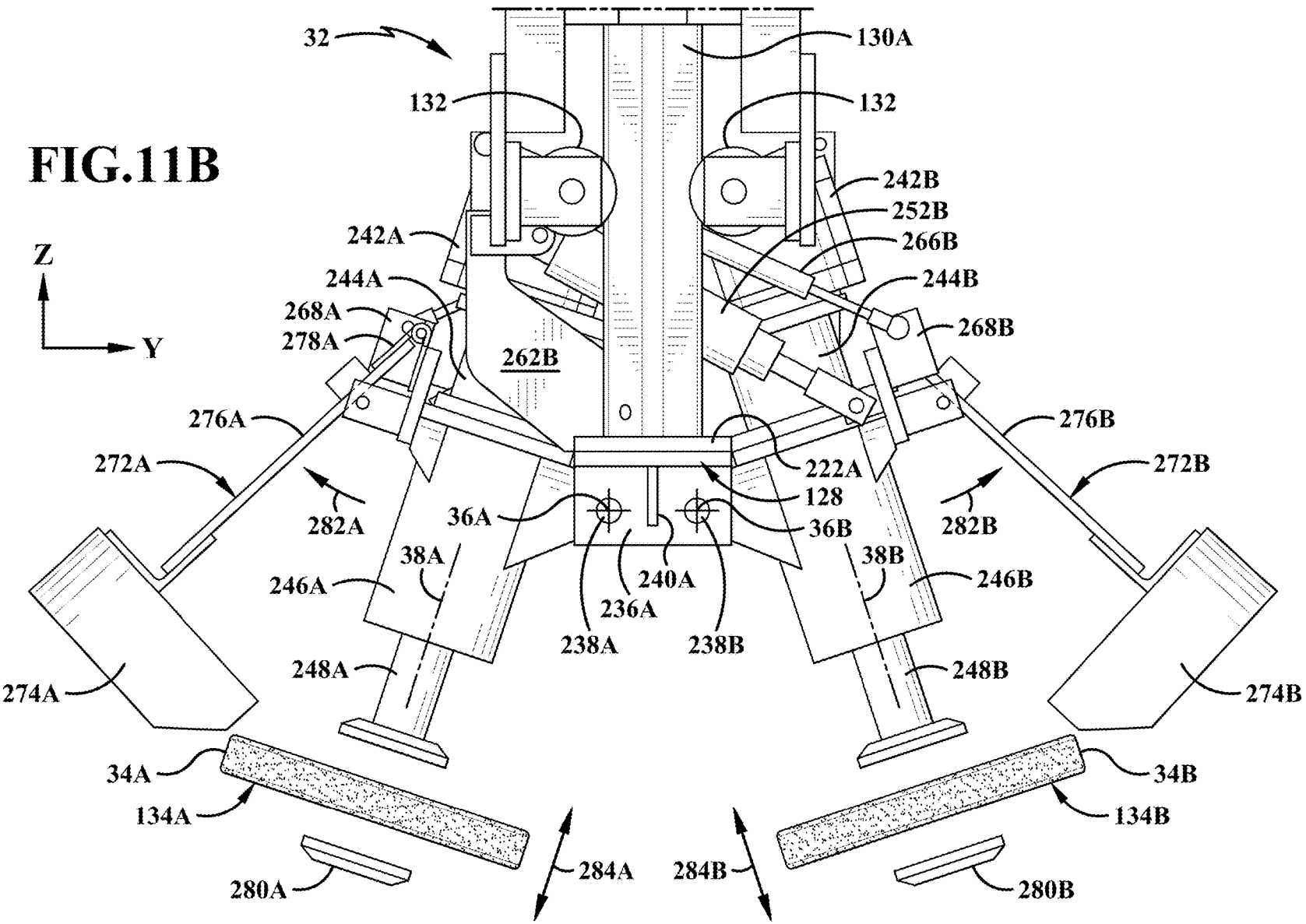
FIG. 11B is an exploded view of some of the components depicted in FIG. 11A.

FIG. 11B depicts that first grinding wheel assembly 250A and the second grinding wheel assembly 250B may further include a wheel cover assembly. First side cover assembly 272A includes a wheel cover 274A and a support member 276A. Similarly, second wheel cover assembly 272B includes a cover 274B and a support member 276B. Cover 274A is generally C-shaped and formed of a semi-cylindrical rigid member that is configured to surround at least a portion of the perimeter of the first wheel 134A. A similar structure is provided in cover 274B relative to second wheel 134B. Cover 274A is connected with support 246A. Support 276A extends vertically from an upper end of the cover 274A. Particularly, the lower end of support member 276A is coupled to the upper end of the cover 274A, which may be accomplished via an L-bracket. The upper end of the support 276A is pivotably coupled with a mount 278A. Mount 278A may be connected to one of or both of the motor mount 244A and/or the bearing mount 246A. A similar structural configuration is provided on the second side of the grinding wheel assembly 232 with respect to the support member 276B being pivotably connected to mount 278B.

With continued reference to FIG. 11B, each grinding wheel 134A, 134B may be coupled to the lower end of the drive shaft 248A, 248B, respectively. Particularly, first wheel 134A may be coupled to the first drive shaft 248A and the second grinding wheel 134B may be coupled to the second drive shaft 248B. A coupling washer 280A may be used to support the lower surface of the first grinding wheel 134A and a coupling washer 280B may be used to support the lower surface of the second grinding wheel 134B.

The wheel cover assembly 272A and the second wheel cover assembly 272B may move or pivot about the pivot axis defined by the respective mounts 278A, 278B. As indicated in FIG. 11B, the first wheel cover assembly 272A may pivot about a pivot axis defined by the mount as indicated by arrow 282A. This will cause the cover 274A to move away from the exterior surface of the first grinding wheel 134A. Similarly, the second wheel cover assembly 272B may pivot about a pivot axis defined by mount 278 as indicated by arrow 282B away from the exterior surface of the second grinding wheel 134B. Moving the first wheel cover assembly 272A and that second wheel cover assembly 272B away from the respective wheels 134A, 134B allows the covers to be moved out of position or out of the way for easy replacement of the wheels 134A, 134B relative to their respective drive shafts 248A, 248B as indicated by arrows 284A and 284B.

FIG. 12 depicts the second mount 262B relative to the second grinding wheel assembly 250B. It is to be understood that the first wheel grinding assembly 250A interacts with a similar first mount 262A. However, FIG. 12 only depicts the second grinding wheel assembly 250B with its reference numerals being designated with the suffix "B" shown. However, it is to be understood that similar reference numerals containing the suffix "A" correspond to the first grinding wheel assembly 250A and are not shown in FIG. 12 for brevity.

FIG. 12 depicts the second grinding assembly 250B in its open position in which the actuator 252 is in its linearly retracted state. To move the grinding surface 34B toward the vertical web of rail 28 the actuator 252B would be actuated to linearly extend the piston downwardly and outwardly in the direction indicated by arrow 254. The downward and outward extension of the piston of actuator 252B will cause the grinding surface 34B along with the rest of the second grinding wheel assembly 250B to pivot about the pivot axis 36B towards the closed position or the engaged position in which the second grinding surface 34B will be moved closer to the vertical web of the rail 28 at is to be grinded. The gas shock 266B will be used to assist the movement of the second grinding wheel assembly 250B from its engaged position back to its open position. Hydraulic pressure may be released from the actuator 252B so that it may flow back to the source 48 and the gas shock 266B is used to dampen the retracting force as the actuator 252B pulls the second grinding wheel assembly 250B in a pivoting motion about axis 36B. The first actuator 252A and the first gas shock 266A operate in a similar manner for the first grinding wheel assembly 250A.

Having thus described some of the exemplary configurations of the rail grinding machine 10, reference is now may to some exemplary advantages thereof. For example, using the self-propelled cart 12 of the rail grinding machine having the grinding wheel assembly 32 for grinding the vertical web region of a rail 28 offers some exemplary advantages in terms of efficiency, precision, and adaptability. For example, the use of the dual grinding wheel assemblies 250A, 250B each having its own wheel 134A, 134B allows for the simultaneous grinding on both the field face and the gauge face of the rail's vertical web prior to the end of the rail being welded to an adjacent rail. This dual wheel setup enhances the efficiency of the grinding process and reduces the time required to complete the operation. Furthermore, the ability of the grinding wheel assembly 250A, 250B to move in three linear directions (vertically, laterally, and longitudinally) provides exceptional flexibility of operation. This allows the rail cart 12 to adapt to various rail configurations and ensure comprehensive coverage for grinding the vertical web surface. Additionally, the ability of grinding wheel assembly to pivot or rotate about two axes, including the wheel axis 38A, 38B enables the grinding wheels 134A, 134B to maintain optimal contact with the rail 28. The pivoting action or scissoring action of the grinding assembly 32 established by the first grinding wheel assembly 250A and the second grinding wheel assembly 250B relative to each other facilitates the controlled movement of the two grinding wheels 134A, 134B toward and away from the vertical web of rail 28. This scissoring action ensures that the grinding force is applied evenly, preventing uneven wear and maintaining a uniform grinding profile along the length of the rail in the section or portion of the rail that is to be grinded. By incorporating the grinding wheel assembly 32 with multiple degrees of freedom, the rail cart 12 streamlines the preparation process for flash welding. The precisely ground vertical web on rail 28 provides an ideal surface for the application of the copper plates or platens, thereby optimizing the flash welding operation for strong and reliable rail connections. Furthermore, the efficiency and adaptability of the self-propelled rail cart 12 can contribute to minimized downtime during maintenance operations. The cart can seamlessly navigate the mail network, address specific grinding needs, and continue to the next location, thereby reducing overall impact on rail traffic and operational schedules.

Having thus described some exemplary advantages and structural configurations of the rail grinding machine 10, reference is now made to its operation.

Figure 14:
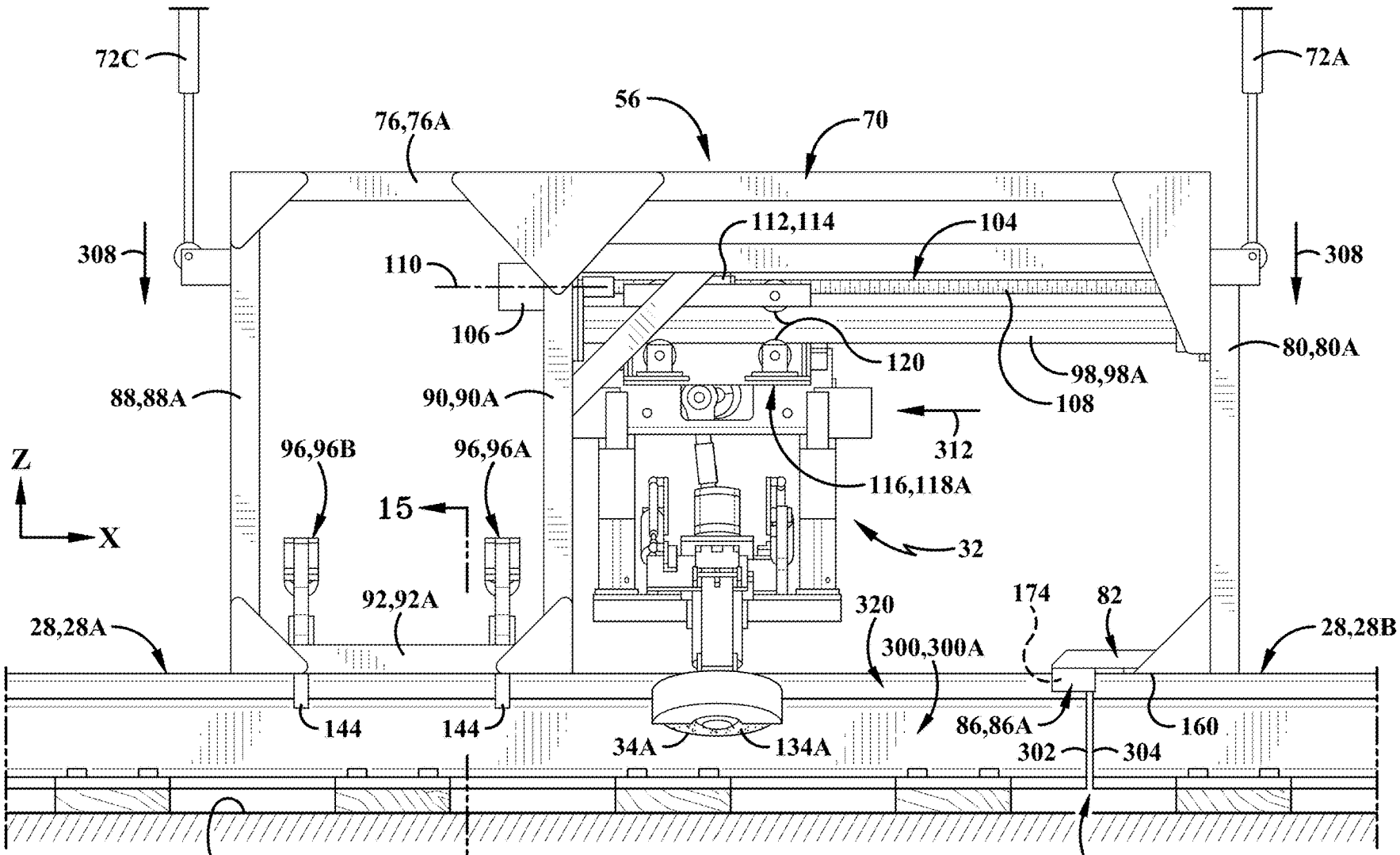
FIG. 14 is an operational first side elevation view of the rail grinding machine depicting the trolley being lowered onto the rail.

FIG. 14 depicts one aspect of the operation of the rail grinding machine 10. Although not shown in FIG. 14, it is to be understood that the rail cart 12 will have been towed to a location along the railway 28 or will have moved under its own self-propelled power/locomotion to a location along the railway 28. When towing the rail grinding machine 10 to a location along the railway the towing may occur by disengaging the dog clutch that is operative communication with the engine 46 on the rail cart 12. As previously discussed, the rail grinding machine 10 is configured to grind the vertical web 300 on the first rail 28A on both the field face 300A and the gauge face 300B of the vertical web. The grinding shall occur simultaneously at a location near the terminal end 302 of the first rail 28A. The terminal end 302 of the first rail 28A is positioned closely adjacent or abutted with a terminal end 304 of another rail 28B that is to be welded together with first rail 28A in an end-to-end orientation or relationship. The welding of the rails, which occurs subsequent to the grinding operation depicted herein, enables the two rails 28A, 28B to be joined to create an overall or collective rail for the railway 28. When the end 302 of first rail 28A is adjacent the terminal end 304 of the other rail 28B a slight gap 306 may be formed between the ends 302 and 304 which will be filled with welding material during the subsequent welding operation.

When the cart 12 is moved into position, either by self-propelled locomotion or towing, the forward wheels 30 on the rail cart 12 are positioned forwardly relative to the longitudinal direction X from the gap 306 or the terminal end 304 of the other rail 28B. The rear wheels 30 on the cart frame 14 are positioned rearward relative to the longitudinal direction X from the terminal end 302 of the first rail 28. With the rail cart 12 in this position, the operation may begin to lower the trolley 56. The trolley is moveable from a raised first or home position to a lowered second or operating position. FIG. 14 depicts the movement after having moved from the raised first position to the lowered second position.

Lowering the trolley 56 is accomplished by the ECU sending control signals to cause the hydraulic source or hydraulic assembly 48 to move the actuators 72A-72D. Actuating that actuators 72A-72D is accomplished by extending the length thereof to lower the trolley 56 as indicated by arrows 308 in FIG. 14. When the trolley 56 is lowered to its second position, the space between the upper frame members 40 of the cart 12 and the upper member 76 of the trolley 56 is increased. The trolley 56 is lowered until it makes contact with the upper surface or the crown 310 of the rail. Toward the rear end of the trolley 56, the lateral lower members 92C and 92D contact and extend lateral across the crown 310 of the rail 28A. Toward the forward end of the trolley 56, the lower end of the vertical members 80A and/or the cross member 156 contact the crown 310 on the other rail 28B. The lower surface 160 of the forward lower member 82 also contacts the crown 310 of the other rail 28B. The shoe plates 86A, 86B of shoe 86 are disposed on the respective field side and gauge side faces of the head of the rail. This helps center the rail in position in the rail region 174 between the plates 86A, 86B.

The clamp assemblies 96A, 96B are lowered down in conjunction with the trolley 56 while the jaws of each clamp assembly 96A, 96B are in the open position. This allows the open jaws of each clamp assembly 96A, 96B to extend below a portion of the head of the rail.

With continued reference to FIG. 14, after the trolley has been lowered into contact with the rail as indicated by arrow 308, the grinding assembly may be moved rearward in the longitudinal direction X as indicated by arrow 312. Longitudinal movement or linear movement or the grinding assembly 32 may be accomplished with the grinding assemblies 250A, 250B in their open position. Linear movement of grinding assembly 32 may be accomplished by the ECU sending control signals to the motor 106. The motor 106 is operatively connected with the threaded shaft 108 and rotates the same about the axis 110. Rotation of the threaded shaft 108 about axis 110 engages the nut 114 that is retained by the receiver 112 on the carriage 116. The threads on the threaded shaft 108 engage corresponding complimentary threads in the nut 114 to move the carriage 116 that carries the grinding wheel assembly 250A and grinding wheel assembly 250B linearly in the longitudinal direction X as indicated by arrow 312. Notably, arrow 312 represents the same linear longitudinal movement as arrow 102 in FIG. 6. The linear longitudinal movement of the grinding assembly 32 may occur forward and backward depending on the rotation of the threaded shaft 108. Thus, to move the carriage in the opposite direction, the rotation of the threaded shaft may be reversed to impart longitudinal movement in the direction of the longitudinal direction X as will be described in greater detail herein.

Figure 15:
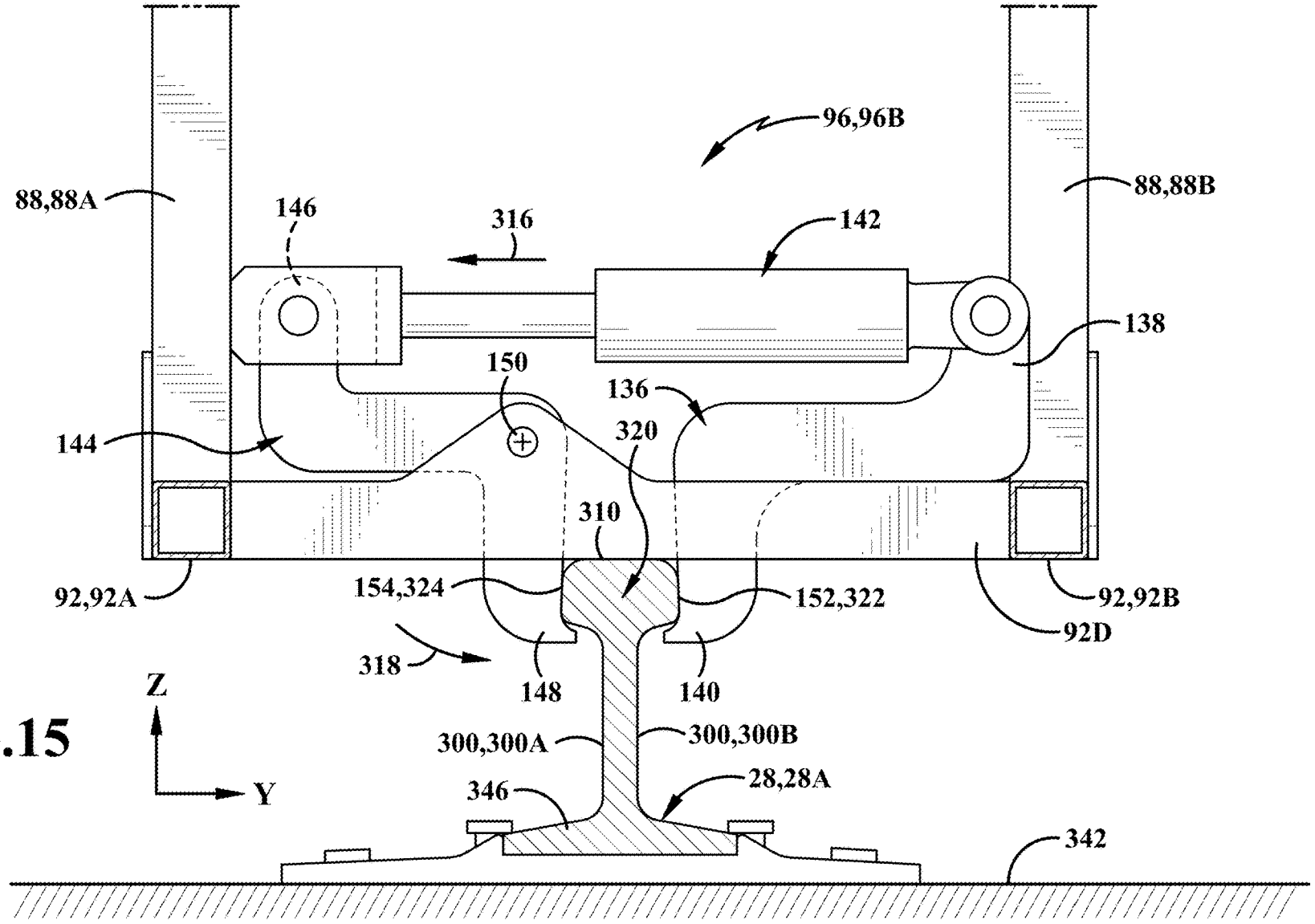
FIG. 15 is an operational cross section view of the clamp assembly clamping the rail.

FIG. 15 depicts the operation of clamping the trolley 56 and the overall cart 12 to the railway 28, namely first rail 28A, by activating the clamp assembly 96. Previously, the clamp assembly 96B was shown in its open position or unclamped position in FIG. 5. Now, FIG. 15 depicts the second clamp assembly 96B having moved from its open position to its closed/clamped position. Particularly, the hydraulic source 48 received receives a control signal from the ECU to actuate the actuator 142 or an element thereon, such as piston 314 to linearly extend the piston 314 from a collapsed position to an extended position as indicated by arrow 316. The extension of piston 314, coupled with the pivoting connection of the ends of the actuator 142 with the upper end 138 of fixed jaw 136 and the upper end 146 of moveable jaw 144 cause the moveable jaw to rotate. Particularly, force applied to the upper end 146 of the moveable jaw 144 causes the moveable jaw to pivot or rotate about the axis defined by pivot 150 as indicated by arrow 318. The pivoting action indicated by arrow 318 about the pivot 150 causes the fixed jaw 136 and the moveable jaw 144 to engage the head of the rail 28A. Particularly, the flat surface 152 on the fixed jaw 136 engages the flat gauge face 322. The flat surface 154 on the moveable jaw 144 engages the field face 324 of head 320. The hooked lower ends of each jaw 136, 144 extend below and inwardly towards each other below the head 320 to effectively hook or clamp the lower ends of each jaw 136, 144 below the head 320 adjacent a fillet defining the head-to-web transition.

The clamp assembly 96 remains in the clamped position (shown in FIG. 15) during the grinding of the vertical web 300 of rail 28A. The purpose of clamping the clamp assembly 96, and thereby effectively clamping the trolley 56 to the rail 28A, is to enable stability for the grinding assembly 32 when the grinding wheel assemblies 250A, 250B are simultaneously grinding the vertical web 300 on each respective face 300A, 300B. After the grinding wheel assemblies 250A, 250B have completed their grinding operation, details of which are provided herein in greater detail, the clamp assembly will then return to its open position, in response to instructions received from the ECU at the hydraulic source 48, to unclamp the trolley from the rail 28. When the clamp assembly 96 is unclamped from the rail 28, then the rail grinding machine 10 can move along the length of the railway 28.

Figure 16A:
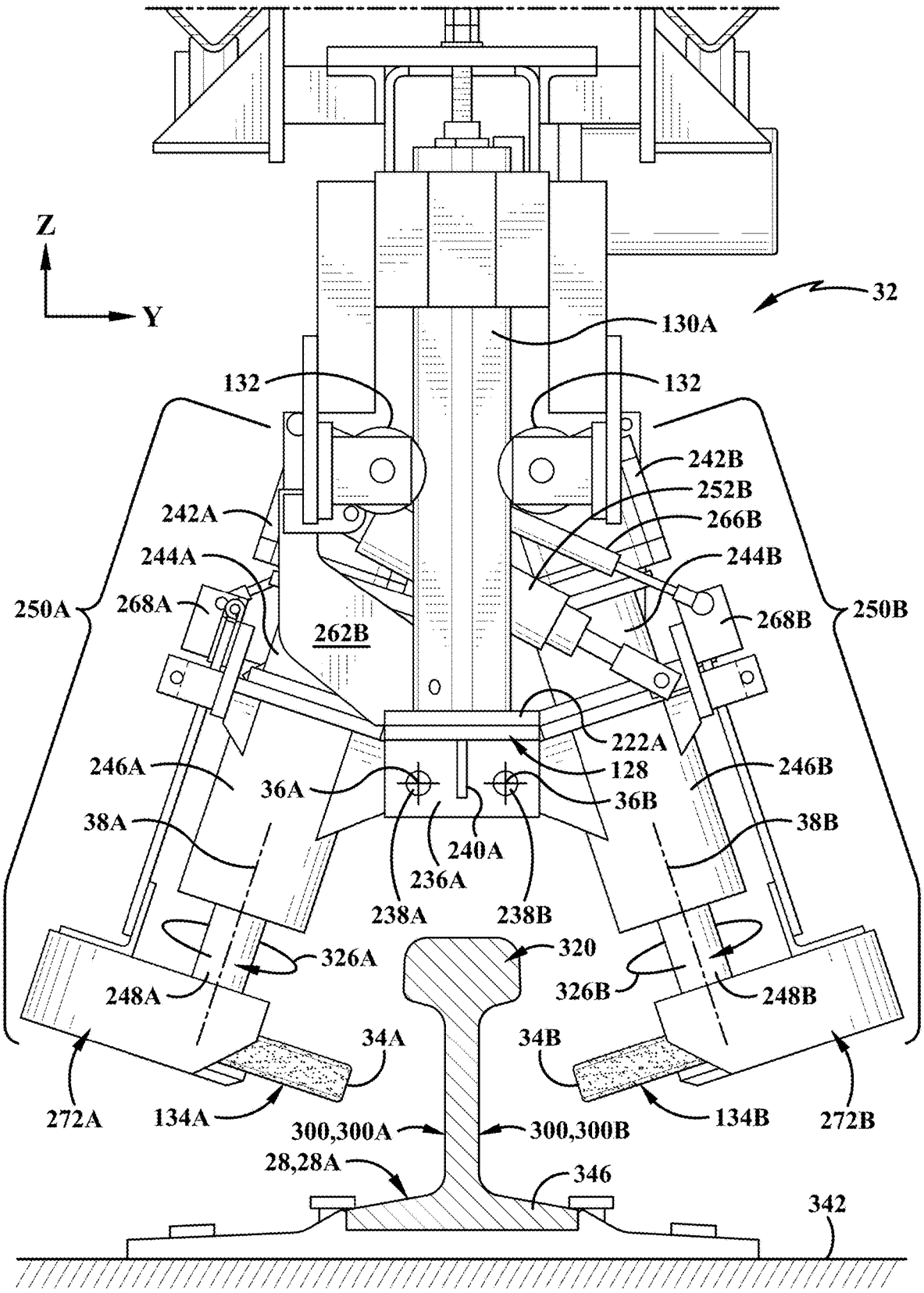
FIG. 16A is an operational cross section elevation view of the grinding assembly depicting rotation of the grinding wheels prior to engaging the rail.

FIG. 16A depicts the grinding assembly 32 as its operation is initiated. More particularly, motor 242A on the first grinding wheel assembly 250A is initiated in response to receiving control signals from the ECU. Rotation or activation of the motor 242A effectuates the drive axle 248A to begin rotating about axis 38A. Rotation of the drive axle 248A about the axis 38A effectuates similar rotational movement of the grinding wheel 134A about axis 38A as indicated by arrow 326A. A similar rotational action occurs with respect to the second grinding wheel assembly 250B that is activated and driven by motor 242B about axis 38B. The rotation of the second wheel 134B about axis 38B is shown by arrow 326B. In one particular embodiment, the first wheel 134A and the second wheel 134B rotate about their respective axes 38A, 38B is the same direction as indicated by arrows 326A, 326B. When the each wheel is rotating about its respective drive axis, when it rotates in a first direction the wheel will impart forces that have a tendency to loosen the bolt holding the wheel and when it rotates in an opposite second direction, the wheel will impart forces that have a tendency to tighten the bolt holding the wheel. However, by maintaining the rotation of both wheels in the same direction allows one wheel to operate in a tightening bias and the other to operate in a loosening bias depending on the direction of travel in of the grinding assembly in the longitudinal direction X. Thus, by rotating both of the wheels in the same directions it provides the advantage of never having both wheels grinding in a direction that is a loosening bias at the same time.

The rotation of the grinding wheels 134A, 134B can achieve their operating revolutions per minute (RPM) in a relatively short timeframe. Namely, the time in which it takes for the wheels 134A to achieve their operational RPM is less than the amount of time it takes for the grinding wheel assemblies 250A, 250B to pivot from their open position (as shown in FIG. 16A) to their closed and engaged position (as seen in FIG. 16B).

Figure 16B:
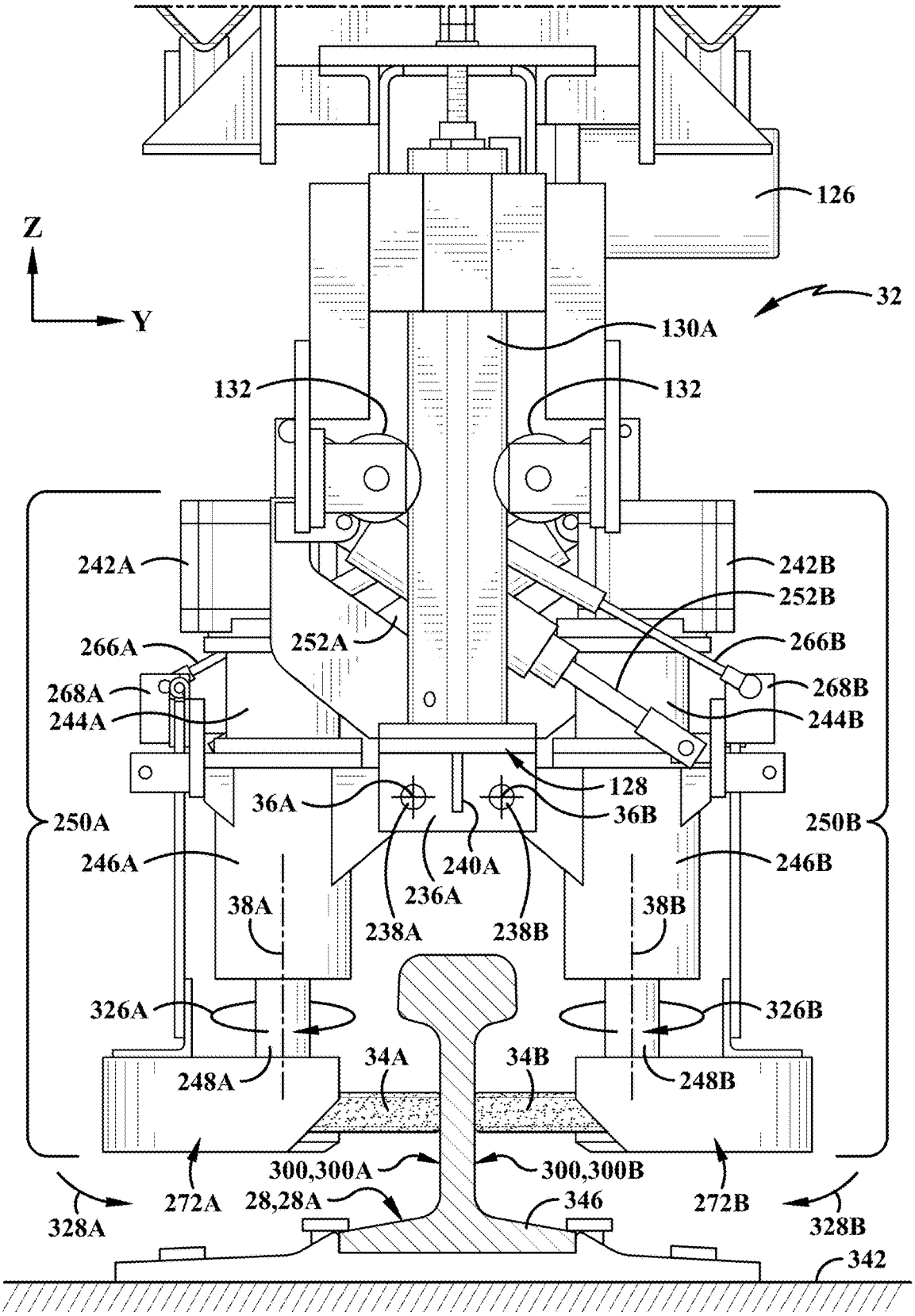
FIG. 16B is an operational cross section elevation view of the grinding assembly depicting the grinding wheels having been pivoted to engage the vertical web of the rail.

FIG. 16B depicts the grinding assembly 32 having moved from its open position (as shown in FIG. 16A) to its engaged or closed position. As referenced above in FIG. 12, actuators 252A, 252B each respectively engage the grinding wheel assemblies 250A and 250B. The actuators 252A, 252B extend their pistons linearly. The pivot connection of the end of the piston of the actuators 252A, 252B to the respective grinding wheel assemblies 250A, 250B causes a pivoting or scissoring action of the grinding wheel assemblies 250A, 250B relative to each other. Particularly, the first grinding wheel assembly 250A pivots about axis 36A as indicated by arrow 328A. Similarly, extension of the second actuator 252B causes the end thereof to extend linearly outward and communicate with the pivot connection of the second grinding wheel assembly 250B to effectuate the pivoting of the second grinding wheel assembly 250B about axis 36B as indicated by arrow 328B. While the pivoting action occurs, represented by arrows 328A and 328B, the grinding wheels are rotating at their operating RPMs by the time the first grinding surface 34A engages the face 300A and the second grinding surface 34B engages vertical web face 300B. The gas shocks help hold the grinding wheels 134A, 134B in contact with the vertical web 300. Effectively, the gas shock provides the force to clamp or contact the grinding wheels 134A, 134B with the vertical web 300. Using the gas shock to apply the force for the wheels 134A, 134B to contact the vertical web 300 enables constant or near-constant pressure to be applied against the rail.

Figure 16C:
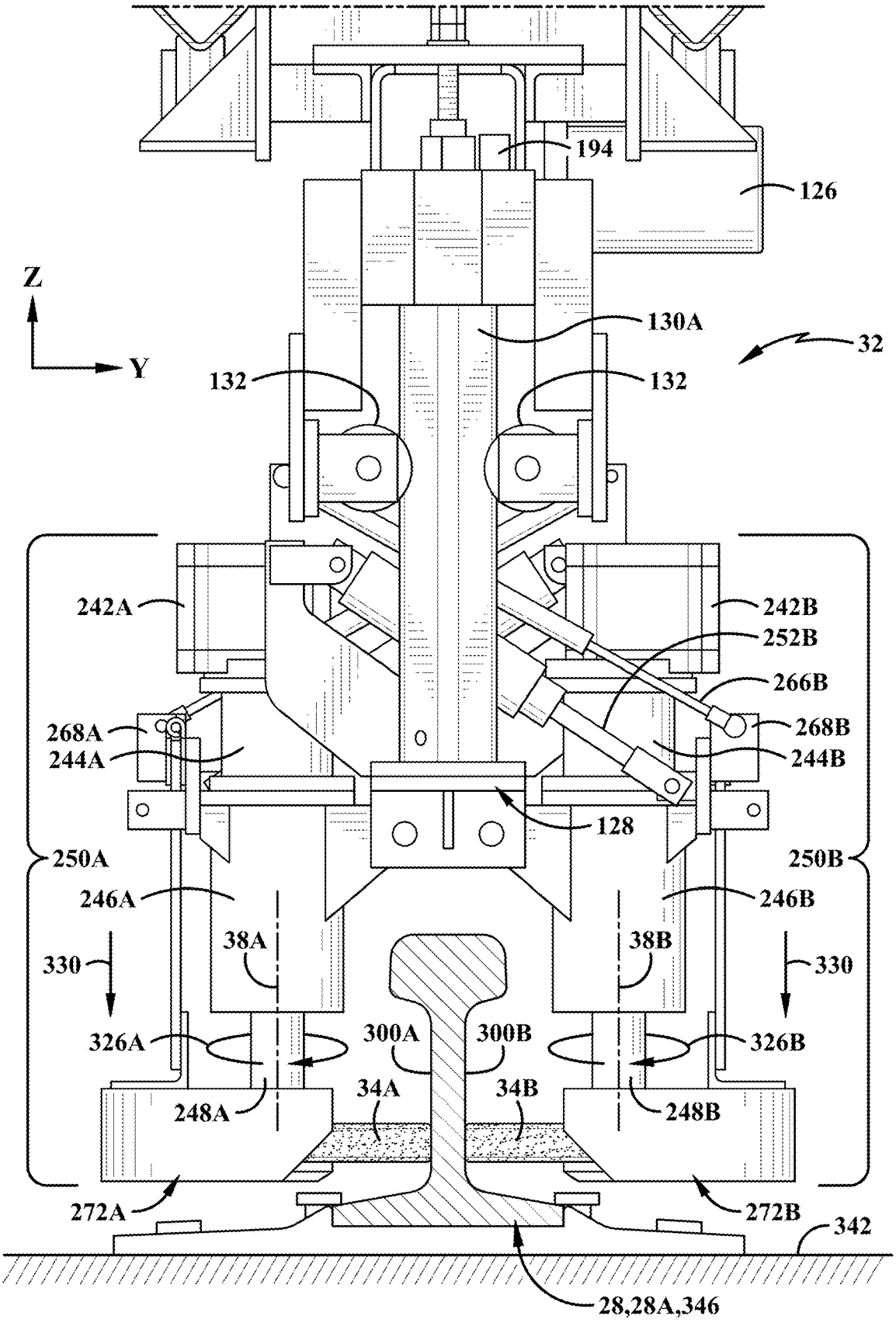
FIG. 16C is an operational cross section elevation view of the grinding assembly depicting the grinding wheels during the downward stroke of the oscillation movement while grinding the vertical web of the rail.

FIG. 16C depicts that as the grinding wheels 134A, 134B are rotating about their respective axes 38A, 38B the motor 126 may be activated by control signals or instructions sent from the ECU to effectuate the up-and-down or oscillation movement of the grinding assembly 32. Particularly, FIG. 16 represents the downward stroke of the oscillation movement or oscillatory movement as indicated by arrow 330. Downward stroke of the oscillation movement represented by arrow 330 is accomplished by rotation of the drive shaft of the motor 126 causing rotation of the eccentric disc 194. The eccentric disc 194 being connected with the arm 196 drives the upper end 198 of arm 196 as indicated by arrow 204 in FIG. 13. The upper end 198 of arm 196 revolves or rotates about the crank shaft axis defined by motor 126 thereby causing the lower end 210 of arm 196 to move upward and downward.

Figure 16D:
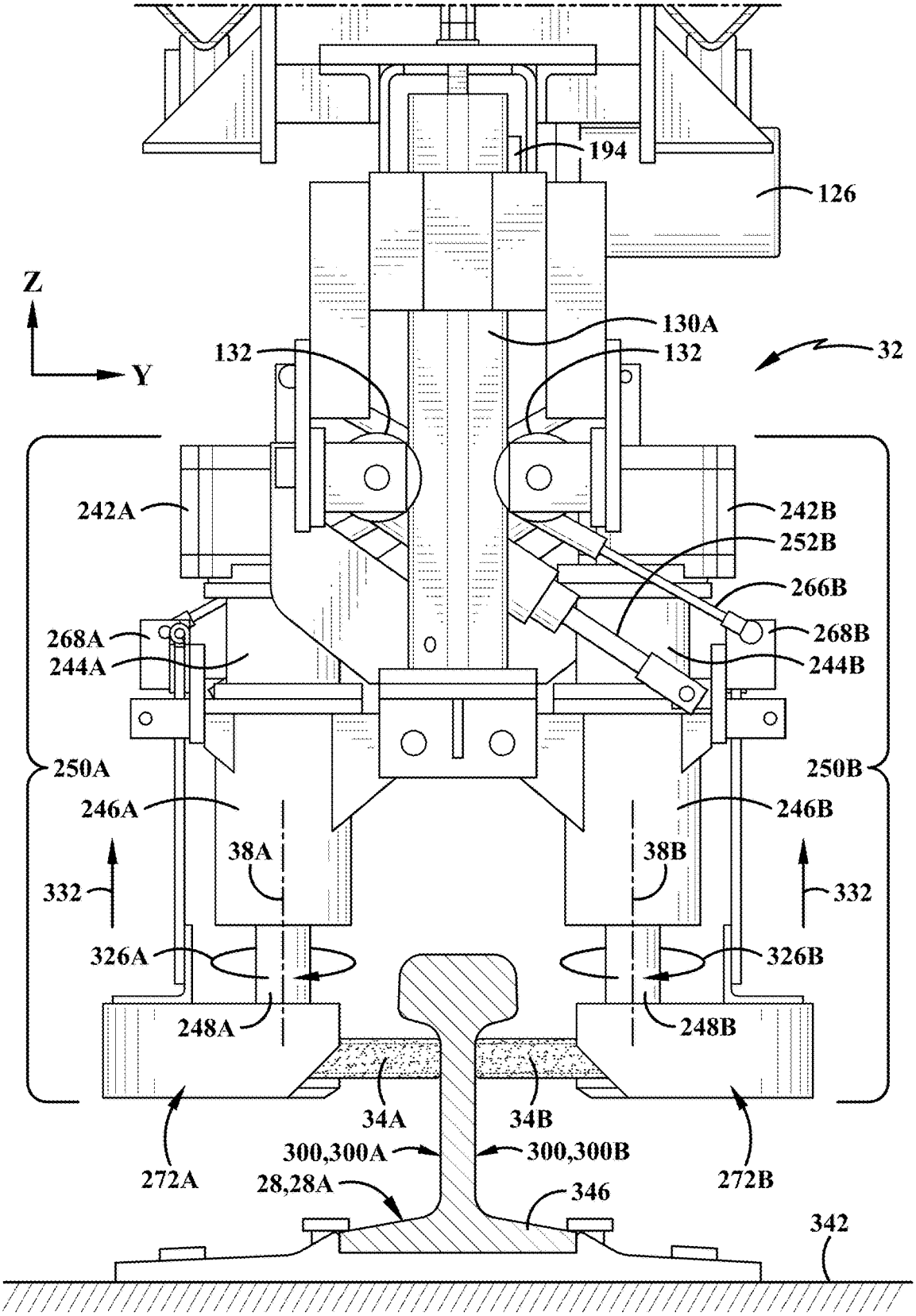
FIG. 16D is an operational cross section elevation view of the grinding assembly depicting the grinding wheels during the upward stroke of the oscillation movement while grinding the vertical web of the rail.

FIG. 16D depicts the upward stroke of the oscillator movement or oscillation movement of the grinding assembly 32. The upward stroke of the oscillation movement is represented by arrow 332. In the upward stroke of the oscillation movement is represented by arrow 332, the springs assist with pulling the grinding assembly 32 upward against the force of gravity. The up-and-down cycle of oscillation occurs repeatedly while the grinding surfaces 34A, 34B are engaging the respective vertical web faces 300A, 300B of the vertical web 300 of first rail 28. The grinding surfaces thereby grind the vertical web of the rail 28A to remove rust, debris, or other surface features of the vertical web of the rail to thereby expose a clean and grinded metallic material forming the rail, which can then be utilized to apply the copper plates or platens for the flash welding process that occurs subsequent to the grinding.

In one other exemplary embodiment, there may be selector valves within the hydraulic system that allow the operator to unclamp one of the grinding wheel assemblies 250A or 250B (either one). This is advantageous when one face of the rail has raised letters or numbers indicating the name of the manufacturer, size and the year in which the rail was produced. During grinding, these raised letters or numbers can cause issues because the grinding wheel 134A or 134B does not contact the web face at this location but rather contacts the raised numbers or letters. To avoid this issue, the selector valve can be used to selectively disengage one of the grinding wheel assemblies at the location where the raised numbers or letters are present. After the grinding assembly 32, and more particularly either the first grinding surface 34A or 34B passes the location of the raised numbers or letters on the rail, then the selector valve can be actuated to selectively reengage the vertical web.

Figure 17:
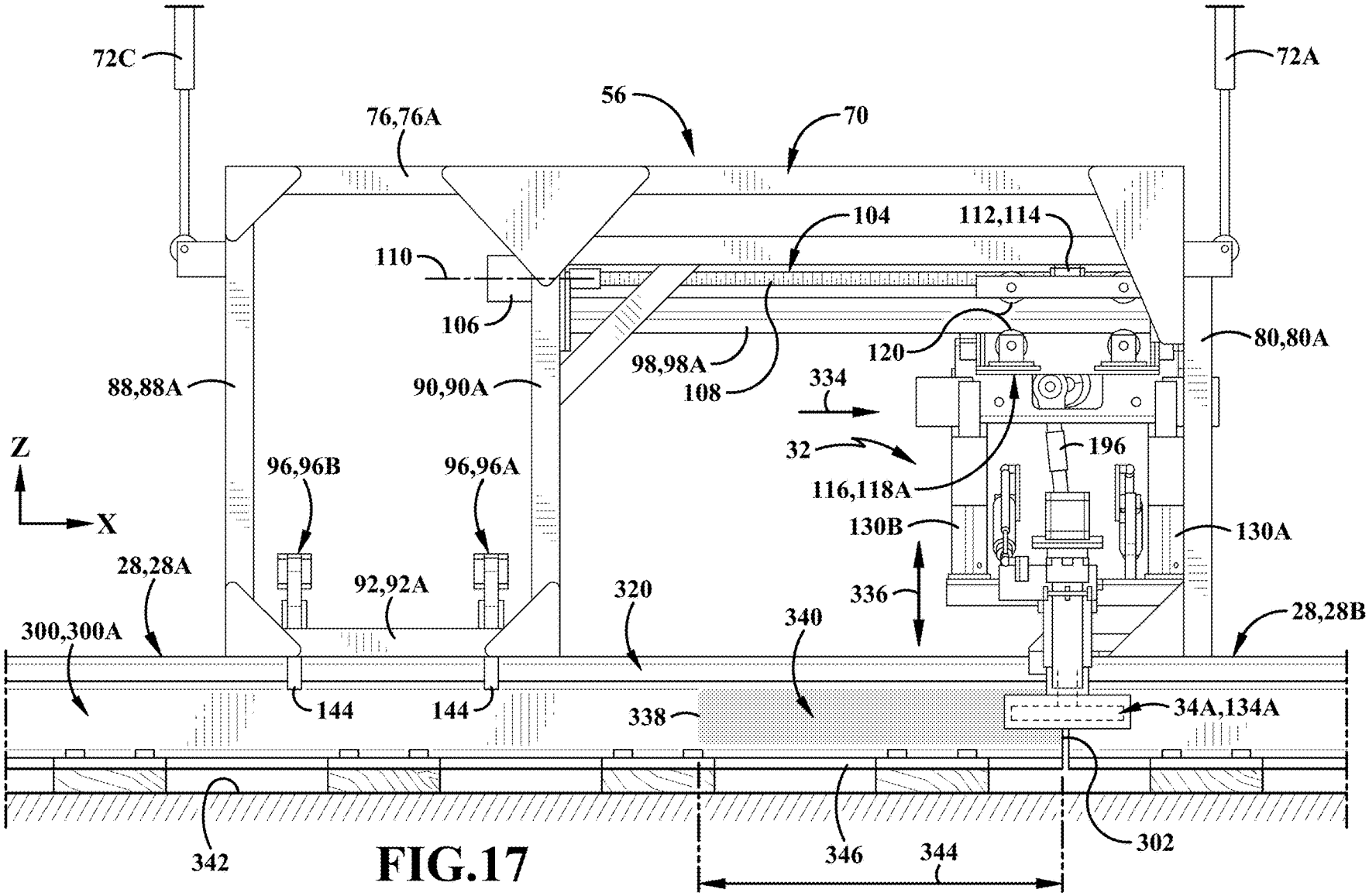
FIG. 17 is an operational first side elevation view of the grinding assembly having been moved forwardly in the lateral direction to create a ground surface on the vertical web of the rail prior to welding.

FIG. 17 depicts the grinding operation of grinding assembly 32. The grinding assembly 32 is depicted as having moved from a starting position and is now in its end position. The movement of the grinding assembly 32 in the longitudinal direction is represented by arrow 334. The longitudinal movement is accomplished by rotating the threaded shaft 108 simultaneous to the grinding rotation of wheels 134A, 134B. During the grinding operation in which the first grind wheel assembly 250A and the second grind wheel assembly 250B engage the vertical web 300 of the rail 28A, the grinding wheel assemblies 250A and 250B are oscillating and being moved up and down as indicated by arrow 336 in the manner described above with respect to FIG. 16.

FIG. 17 depicts that the rail 28A is ground or grinded starting from a starting position 338 and extends longitudinally in the longitudinal direction X to the end 302 of the rail 28A. The ground surface 340 is represented by a shaded region in some of the Figures. In this context, the past tense of "to grind" in describing the surface of the vertical web 300 for this scenario is "ground." Therefore, it is to be understood that that the term "ground surface 340" represents the past particle form of "grind" and is used to indicate the surface after having performed the action of grinding or smoothing. However, colloquially, it is to be understood that sometimes the term "grinded surface" could also be used. Thus, the term ground surface and grinded surface are equivalent for the purpose of this disclosure when referring to the rail. Yet, this term is not to be confused with the ground 342 upon which the railway rails are supported.

The linear length of the ground surface 340 of the vertical web of rail 28A is measured in the longitudinal direction X from the start 338 to the end 302 of the rail is in a range from about five feet to about six inches. In one specific embodiment, the length 344 or dimension 344 representing the linear distance of the start 338 to the end of the rail 302 is in a range from about 27 inches to about 30 inches. The provided range of dimension 344 may have some specificity and is used based on the length dimensions of the copper plates that are necessary for the flash welding process with occurs subsequent to the creation of the ground surface 340. Thus, some embodiment of the present disclosure may impart some criticality to the claimed ranges of the ground surface 340 and its dimension 344.

The clamp assembly 96, namely first clamp assembly 96A and second clamp assembly 96B, is shown as being in its clamped and closed position during the entirety of the process of grinding the ground surface 340 while the grinding assembly 32 moves linearly in the longitudinal direction X as indicated by arrow 334 (by rotating the threaded shaft 108, and moving roller mounts along the guide tubes). The clamp assembly 96 stabilizes the trolley 56. Further, during the grinding operation performed by the grinding surfaces 34A, 34B engaging respective vertical webs 300A, 300B of web 300 on rail 28A, the trolley remains in its lowered position engaged upon the top surface of the rail 28A.

In one embodiment, the vertical dimension of the ground surface 340A may extend substantially or entirely between the head 320 and the foot or base 346 or rail 28A. In other embodiment however, it is possible for the grinding surfaces 34A, 34B to only partially grind the vertical web 300 between the head 320 and the base or foot 346 of rail 28. The vertical dimension of the ground surface 340 should be large enough or greater than the vertical dimension a copper plate or platen that is to be applied to the vertical web prior to welding. Thus, a partially ground vertical dimension of the ground surface 340A is possible so long as the vertical dimension of the grind exceeds a maximum vertical dimension of the copper plate when laid horizontally parallel to the longitudinal direction X associated with the railway 28.

Figure 18:
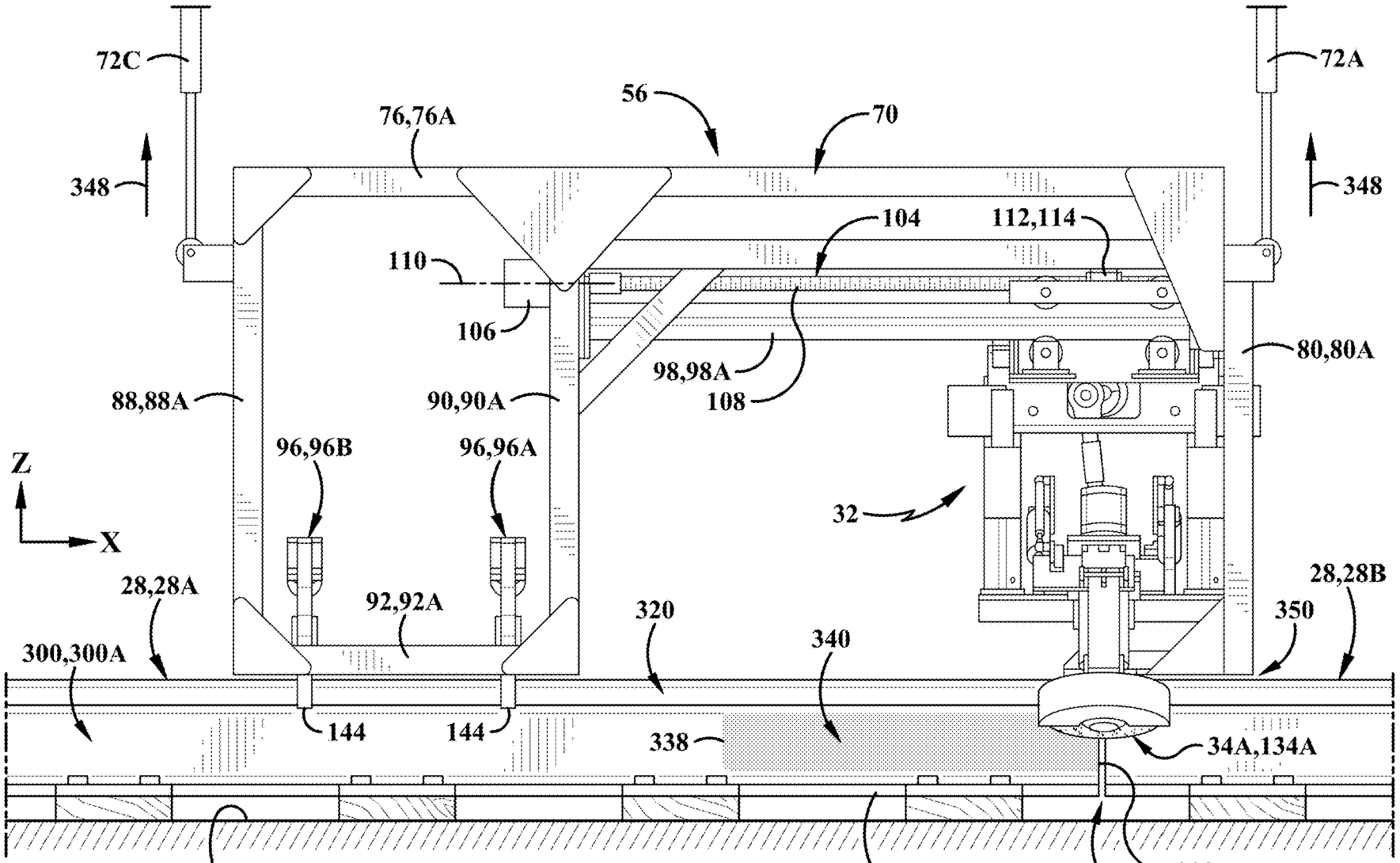
FIG. 18 is an operational first side elevation view of the grinding assembly having moved to the open position and the trolley being lifted to raise the trolley slightly above the rail.

FIG. 18 depicts the operation in which, after having completed the grinding to create the ground surface 340, the grinding assembly 32 in moved from its closed and engaged position to its open position. With the first grinding wheel assembly 250A and the second grinding wheel assembly 250B having pivoted via the hydraulic actuators to the open position the trolley may then be lifted upwardly as indicated by arrows 348. The lifting of the trolley 56 occurs by the ECU sending a signal that causes the actuators 72A-72D to raise the trolley. Raising the trolley is shown in FIG. 18 by a slight gap that is shown between the bottom end of the trolley 56 and the crown 310 or top of the rail 28. The gap 350 does not need to be a significant distance and can be as small as one or a few inches. The gap 350 simply has to be large enough to provide a clearance which will allow the grind machine 10 to move linearly along the railway 28 to another position.

Prior to lifting the trolley 56, the rail clamp assembly 96 is disengaged or otherwise moved to the unclamped position. The ECU will send control signals to cause the clamp assembly to move it from its clamped engagement to an unclamped position. Similarly, the ECU will send control signals to cause the grinding assembly 32 to move the first grinding wheel assembly 250A and second grinding wheel assembly 250B to the open or extended position. With the trolley 56 slightly lifted above the crown 310 of the rail 28 thereby establishing gap 350, the entirety of the rail cart 12 may be moved, usually by self-propelled locomotion.

Figure 19:
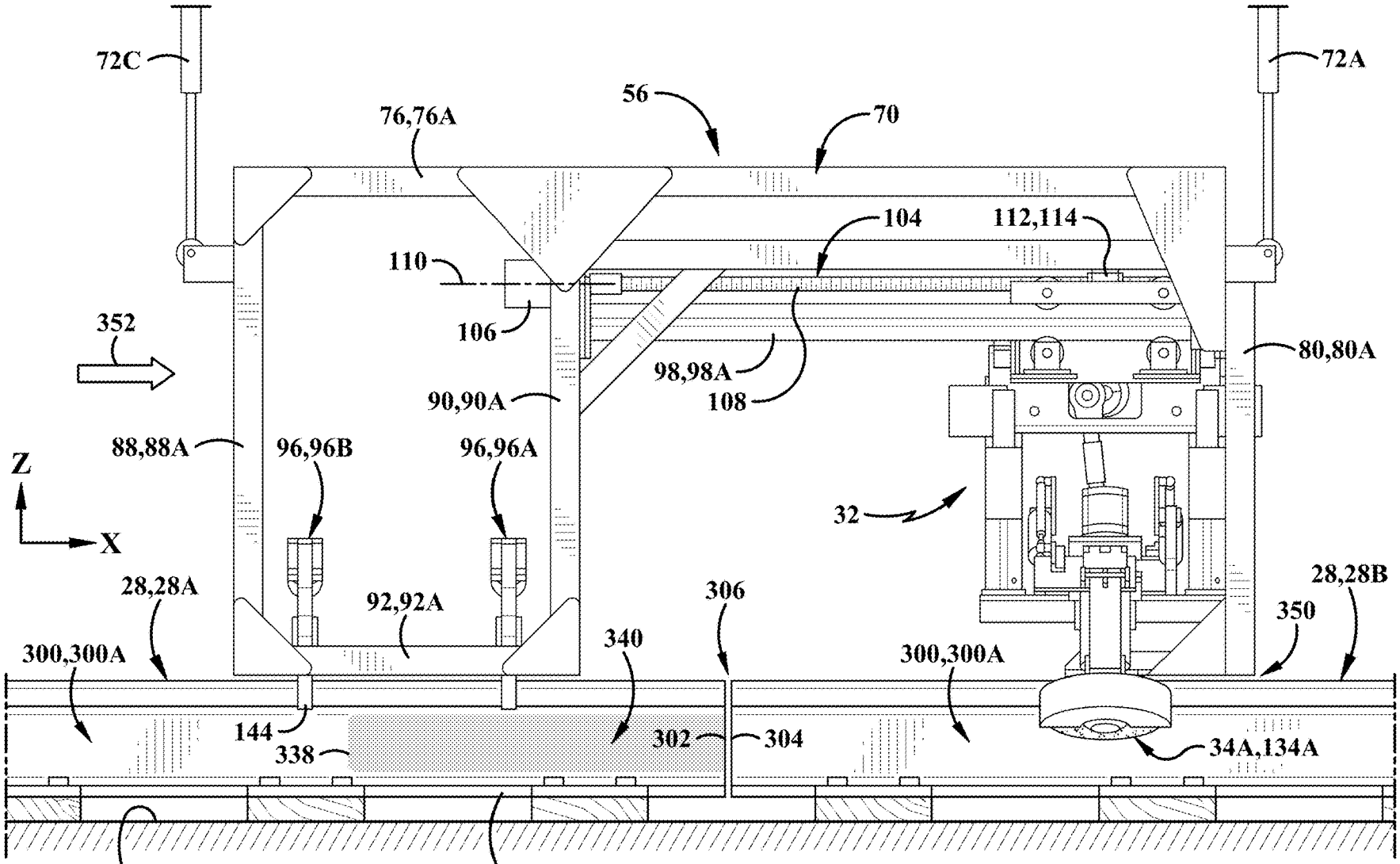
FIG. 19 is an operational first side elevation view of the rail grinding machine having been moved in the longitudinal direction to position the grinding assembly adjacent the end of an adjacent rail.

FIG. 19 depicts the linear movement of the rail cart 12 in the longitudinal direction X with the trolley 56 slightly lifted position above the crown 310 of the rail. The linear movement of the rail cart in the longitudinal direction is represented by arrow 352. During the movement in the direction of arrow 352, the trolley 56 maintains the gap 350 above the top of the rail 28A and further establishes a gap above the crown or top of the other rail 28B which is adjacent and aligned end-to-end with first rail 28A. When moving the rail cart 12 in the linear direction as indicated by arrow 352 the grinding wheel assembly remains in its forwardmost position when it ends during the first grinding cycle operation with respect to rail 28A. Thereafter, to grind the second rail 28B, the grinding cycle operation will be performed in reverse such that the grinding assembly 32 will be driven rearward towards the end 304 of the second rail 28B based on an opposite rotation of threaded shaft 108.

Figure 20:
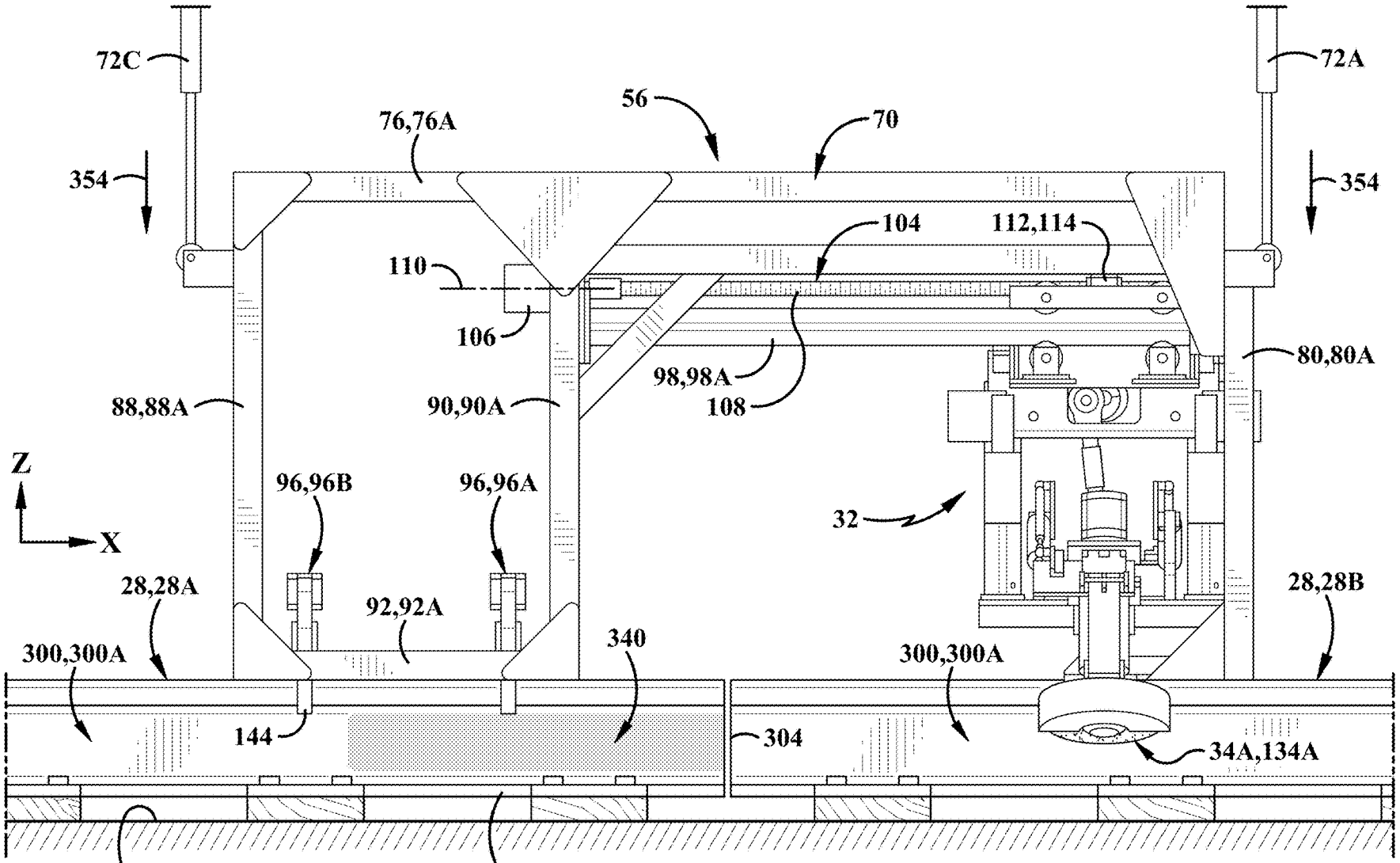
FIG. 20 is an operational first side elevation view of the trolley being lowered to position the grinding assembly near the vertical web of the adjacent rail prior to grinding.

FIG. 20 depicts the operation of lowering the trolley 56 onto the crown of both the first rail 28A and the second rail 28B. The lowering of the trolley 56 is shown by arrows 354. The lowering of the trolley is accomplished by the ECU sending control signals to cause the actuators 72A-72D to linearly extend them in the vertical direction Z to engage the lower portion of the trolley 56 with the crowns 310 of rails 28A, 28B. Thereafter, the clamping assembly 96 may be clamped on to one of the rails 28. In this embodiment, the clamping assembly is located on and connected with the first rail 28A, however it is to be understood that an alternative embodiment could clamp the clamp assembly 96 with the second rail 28B. When the clamp assembly 96 is clamped, the ECU may receive a control signal or otherwise know that it is able to start the second grinding operation for the vertical webs 300 on the second rail 28B.

Figure 21:
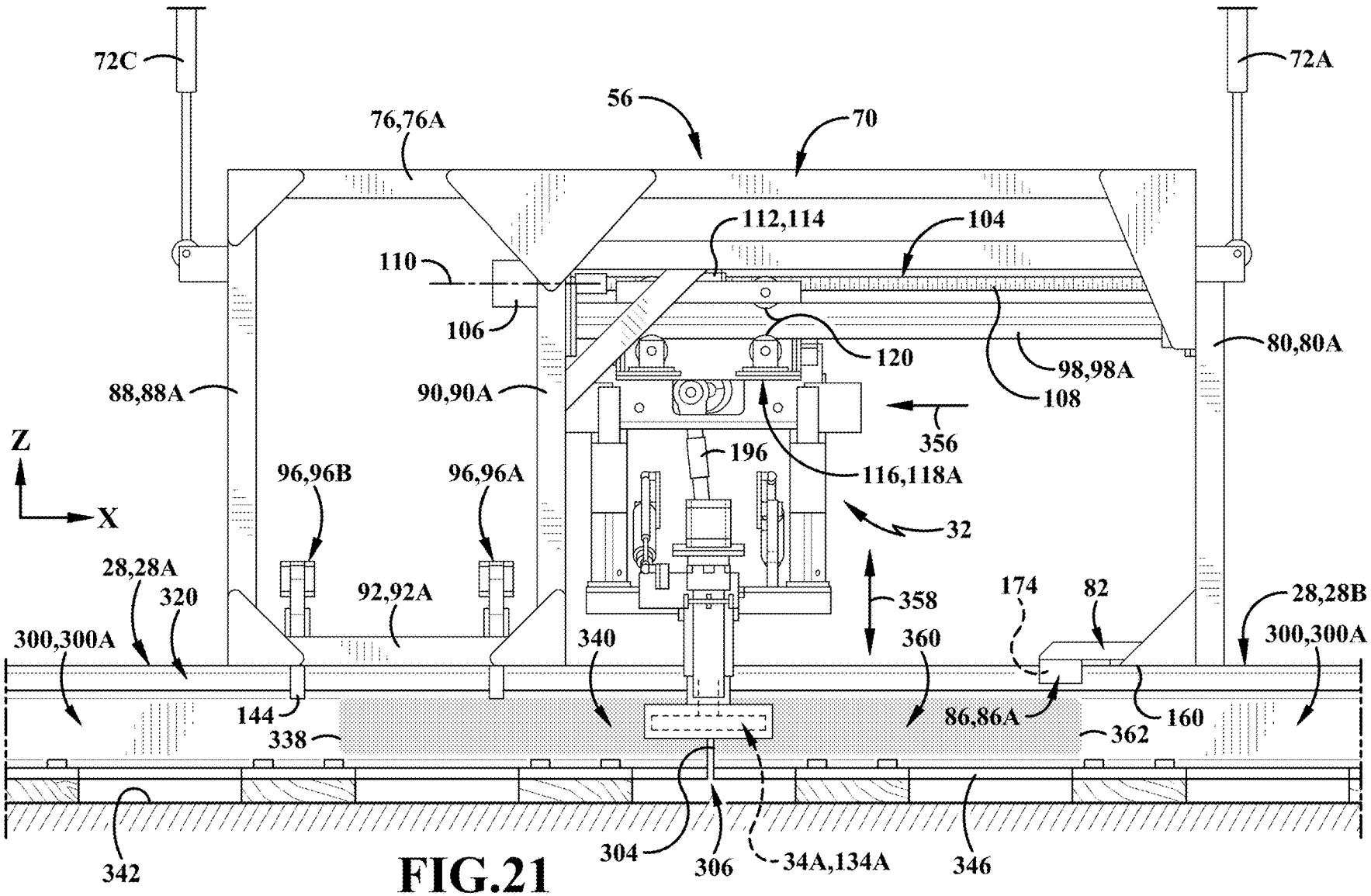
FIG. 21 is an operational first side elevation view of the grinding assembly having created a ground surface on the adjacent rail by reversing direction of the grinding assembly.

FIG. 21 depicts the grinding operation performed by the grinding assembly 32 to grind the vertical web on the second rail 28B. The grinding operation for the second rail 28B occurs in a manner similar to that of the first rail 28A but in a reverse direction. Particularly, the rotation of the thread shaft 108 controlled by motor 106 is reversed to pull or move the grinding assembly 32 linearly rearward as indicated by arrow 356 after having engaged the grinding surfaces 34A, 34B with the vertical web 300 of rail 28B. During the grinding operation performed by the grinding assembly 32 moving in the direction of arrow 356, the grinding surfaces 34A. 34B may be oscillated up and down in the vertical direction Z as indicated by arrow 358. The ground surface 360 on the second rail 28B may extend from its starting position 362 and extend rearward towards the end 304 of rail 28B. The dimensions of the second ground surface 360 may be similar to that of the dimension 344 of the first ground surface 340. However, it is entirely possible for ground surface 340 and ground surface 360 to have differing dimensions or length measured in the longitudinal direction X. Once the grinding operation is completed or establishes the ground surface 340 on the second rail 28B, the clamp assembly 96 may be unclamped and the grind assembly 32 may be moved to its extended position. Thereafter, the trolley 56 may be raised to establish another gap 350 above the crowns of the respective rails 28A, 28B. Then, the rail grinding machine 10, namely the cart 12 may be self-propelled forwardly to an adjacent end on rail 28B wherein the grinding process repeats itself by grinding the other end of the second rail 28B and ultimately with an adjacent third rail (not shown). This process may continue and repeat until the desired number of rail grinds are performed along the length of the railway 28.

Figure 22:
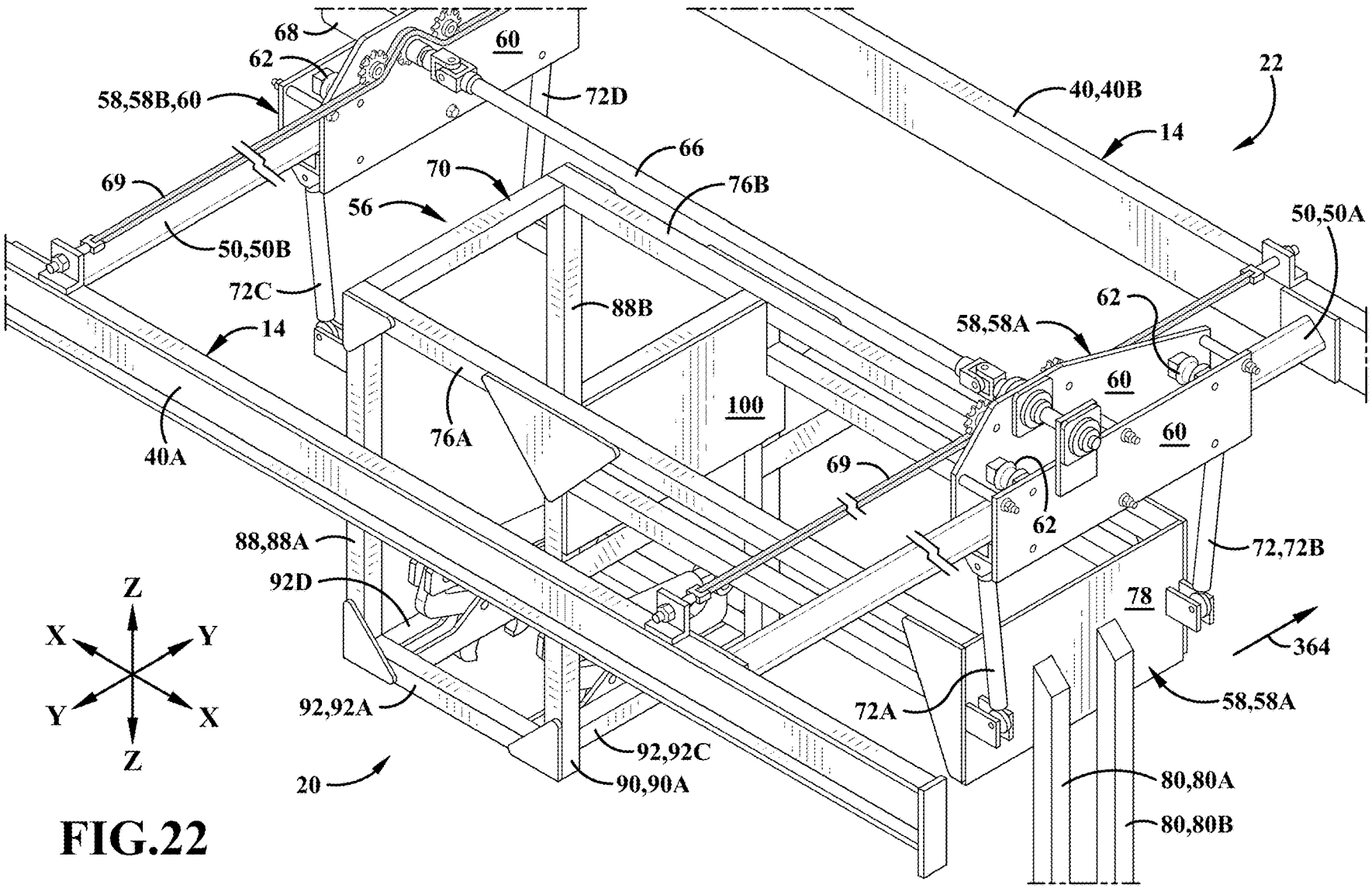
FIG. 22 is an operational perspective view of the trolley being moved in the lateral direction.

FIG. 22 depicts the linear movement of the trolley 56 in the lateral direction Y. This is advantageous as it allows the trolley assembly to be lifted in the manner previously described and then moved in the lateral direction Y from one of the rails on the right side of the railway to another rail on the left side of the railway. This allows for the grinding operation to not only occur on the right side rail, but the grinding operation described herein to occur on the left side rail as well.

As indicated in FIG. 22, to move the grinding assembly 32 from the first side 20 of the rail grinding machine 10 to the second side 22 of the rail grinding machine 10, the trolley will be lifted in the manner previously described. Then, the motor 68 will receive a control signal from the ECU to drive the drive shaft 66. The interaction of the drive shaft 66 will engage sprockets with the chain or belt 69. The sprockets will drive via the chain or belt to move the trolley in the lateral direction Y as indicated by arrow 364. As the drive shaft 66 effectuates the lateral movement in the lateral direction Y indicated by arrow 364 the forward rolling mount 58A and the rear rolling mount 58B will cause its roller wheels 62 to move along the exterior surface of the transverse beams 50A, 50B respectively, as shown in FIG. 4.

The rail grinding machine 10 of the present disclosure may additionally include one or more sensors to sense or gather data pertaining to the surrounding environment or operation of the rail grinding machine 10. Some exemplary sensors capable of being electronically coupled with the rail grinding machine 10 of the present disclosure (either directly connected to the rail grinding machine 10 of the present disclosure or remotely connected thereto) may include but are not limited to: accelerometers sensing accelerations experienced during rotation, translation, velocity/speed, location traveled, elevation gained; gyroscopes sensing movements during angular orientation and/or rotation, and rotation; altimeters sensing barometric pressure, altitude change, terrain climbed, local pressure changes, submersion in liquid; impellers measuring the amount of fluid passing thereby; Global Positioning sensors sensing location, elevation, distance traveled, velocity/speed; audio sensors sensing local environmental sound levels, or voice detection; Photo/Light sensors sensing ambient light intensity, ambient, Day/night, UV exposure; TV/IR sensors sensing light wavelength; Temperature sensors sensing machine or motor temperature, ambient air temperature, and environmental temperature; load sensors or scales to measure various weights of the machine, one of the assemblies, or environmental components that interact with the machine, and Moisture Sensors sensing surrounding moisture levels.

If sensors are utilized to gather data relating to the rail grinding machine 10, then sensed data may be evaluated and processed with artificial intelligence (AI). Analyzing data gathered from sensors using artificial intelligence involves the process of extracting meaningful insights and patterns from raw sensor data to produce refined and actionable results. Raw data is gathered from various sensors, for example those which have been identified herein or others, capturing relevant information based on the intended analysis. This data is then preprocessed to clean, organize, and structure it for effective analysis. Features that represent key characteristics or attributes of the data are extracted. These features serve as inputs for AI algorithms, encapsulating relevant information essential for the analysis. A suitable AI model, such as machine learning or deep learning (regardless of whether it is supervised or unsupervised), is chosen based on the nature of the data and the desired analysis outcome. The model is then trained using labeled or unlabeled data to learn the underlying patterns and relationships. The model is fine-tuned and optimized to enhance its performance and accuracy. This process involves adjusting parameters, architectures, and algorithms to achieve better results. The trained model is used to make predictions or inferences on new, unseen data. The model processes the extracted features and generates refined output based on the patterns it has learned during training. The results produced by the AI model are refined through post-processing techniques to ensure accuracy and relevance. These refined results are then interpreted to extract meaningful insights and derive actionable conclusions. Feedback from the refined results is used to improve the AI model iteratively. The process involves incorporating new data, adjusting the model, and enhancing the analysis based on real-world feedback and evolving requirements. Further, AI results can be used to alter the operation of the device, assembly, or system of the present disclosure based on feedback. For example, AI feedback can be used to improve the efficiency of the device, assembly, or system of the present disclosure by responding to predicted changes in the environment or predicted changes to the device, assembly, or system of the present disclosure more quickly than if only sensed by one or more of the sensors.

A sensor model may be employed, once trained, in the rail grinding machine 10 of the present disclosure. In one embodiment, the sensor data of the rail grinding machine 10 of the present disclosure can be used to teach a sensor model to predict future sensor data for a specific scenario. Alternatively, sensor models can be utilized to generate the data to train the AI. The sensor model can be trained for any type of sensor, such as those types of sensors described above, and/or other sensor types. The elements described herein may be implemented as discrete or distributed components in any suitable combination and location. The various functions described herein may be conducted by hardware, firmware, and/or software. For example, a processor may perform various functions by executing instructions stored in memory.

The AI model and/or sensor model can include a deep neural network (DNN), convolutional neural network (CNN), another neural network (NN) or the like and can support generative learning. For example, the sensor model can include a generative adversarial network (GAN), a variational autoencoder (VAE), and/or another type of DNN, CNN, NN or machine learning model (e.g., natural language processing (NLP)). Generally, the sensor model can accept some encoded representation of a scene as input using any number of data structures and/or channels (e.g., concatenated vectors, matrices, tensors, images, etc.).

In a particular embodiment, the rail grinding machine 10 of the present disclosure can use the sensors to acquire a representation of the real-world environment (e.g., a physical environment) at a given point in time. Data from these sensors may be used to generate a representation of a scene or scenario, which may then be used to teach a sensor model. For example, a representation of a scene can be derived from sensor data, properties of objects in the scene or surrounding environment such as positions or dimensions (e.g., depth maps), classification data identifying objects in the scene or surrounding environment or railway 28, properties or classification data of components of the rail grinding machine 10, or some combination thereof. Generally, the sensor model learns to predict sensor data from a representation of the scene, environment or operation of the rail grinding machine 10 of the present disclosure.

The sensor model architecture can be selected to fit the shape of the desired input and output data. Examples of architectures (e.g., DNNs) include, but are not limited to, perceptron, feed-forward, radial basis, deep feed-forward, recurrent, long/short term memory, gated recurrent unit, autoencoder, variational autoencoder, convolutional, deconvolutional, and generative adversarial. Some DNN architectures, such as a GAN, can include the CNN that accepts and evaluates an input image and may include multiple input channels, which may be used to accept and evaluate multiple input images and/or input vectors.

In one embodiment, training data for the sensor model may be generated using real-world (e.g., physical environment) data. To collect real-world training data, the rail grinding machine 10 may collect sensor data by fusing sensors as the rail grinding machine traverses a real-world environment. The sensors of the rail grinding machine may include, for example, one or more global navigation satellite systems sensors (e.g., Global Positioning System sensors (GPS)), RADAR sensors, ultrasonic sensors, LIDAR sensors, inertial measurement unit (IMU) sensors (e.g., accelerometer(s), gyroscope(s), magnetic compass(es), magnetometer(s), etc.), ego-motion sensors, microphones, stereo cameras, wide-view cameras (e.g., fisheye cameras), infrared cameras, surround cameras (e.g., 360 degree cameras), long-range and/or mid-range cameras, speed sensors (e.g., for measuring the speed of the rail grinding machine), vibration sensors, steering sensors, brake sensors (e.g., as part of the brake sensor system), and/or other sensor types.

In another embodiment, training data for the sensor model is generated based on simulated or virtual environments. The training data may then be used to train the sensor model for use in real-world autonomous driving applications, e.g., to control the maneuvering of autonomous or semiautonomous rail grinding machine 10. The training data may include virtual data based on photorealistic scenes (e.g., simulated 2D image data), depth-map realistic scenes (e.g., simulated 3D image data), and/or environment-object data (e.g., simulated data defining how objects or surfaces interact), each corresponding to the same virtual environment. For example, the environment-object data for a particular rail grinding machine in the virtual environment may relate to the rail grinding machine's motion (e.g., position, velocity, acceleration, trajectory, etc.). The virtual environment may be generated and/or rendered from the viewpoint of one or more autonomous or semiautonomous rail grinding machines) operating within the virtual environment. In some implementations, the training data may be updated with real-world data such that the training datasets include both simulated data and real-world data.

The rail grinding machine 10 may include hardware, software (e.g., a computer program product) and/or firmware responsible for managing the sensor data generated by the sensors. The autonomous hardware, software, and/or firmware being executed may manage different environments using one or more maps (e.g., 3D maps), positioning component(s), and the like. The autonomous hardware, software, and/or firmware may also include components to plan, control, and generally manage the rail grinding machine 10. In one example, the autonomous hardware, software, and/or firmware can be installed in and used to control the rail grinding machine 10 through the environment based on the sensor data, one or more machine learning models (e.g., neural networks), and the like. A training system may use the training data to train the sensor model to predict virtual sensor data for a given scene, environment, or operation of a component.

The training system can include one or more servers (e.g., a graphics processing unit server) and data stores and may use a cloud-based deep learning infrastructure with artificial intelligence to analyze the sensor data received from the rail grinding machine 10 and/or stored in the data store. The training system can also incorporate or train up-to-date, real-time neural networks (and/or other machine learning models) for one or more sensor models.

The sensor model may be employed, once trained, in an autonomous or semiautonomous rail grinding machine 10. In one embodiment, the system can be used to teach a sensor model to predict sensor data for a specific scene configuration. The sensor model can be trained for any type of sensor, such as those previously mentioned. The elements described herein may be implemented as discrete or distributed components in any suitable combination and location. The various functions described herein may be conducted by hardware, firmware, and/or software. For example, a processor may perform various functions by executing instructions stored in memory.

In a particular embodiment, an autonomous or semiautonomous rail grinding machine 10 can use the sensors to acquire a representation of the real-world environment (e.g., a physical environment) at a given point in time. Data from these sensors may be used to generate a representation of a scene, which may then be used to teach a sensor model. For example, a representation of a scene can be derived from sensor data (e.g., LIDAR data, RADAR data, ultrasonic sensor data, camera image(s), etc.), properties of objects in the scene such as positions or dimensions (e.g., depth maps), classification data identifying objects in the scene, or some combination thereof. Generally, the sensor model learns to predict sensor data from a representation of the scene.

In one exemplary embodiment, the AI-trained rail grinding machine 10 operates autonomously along railroad rails, utilizing advanced sensor models and machine learning algorithms to navigate and perform precision grinding on the vertical web of the rails. The sensor model, trained through a combination of real-world and virtual data, plays a role in enabling the machine's autonomous capabilities. This model may encompass various sensor types, including RADAR, LIDAR, ultrasonic, GPS, cameras, inertial measurement units (IMUs), and more, providing a comprehensive understanding of the rail environment.

In its autonomous operation, the rail grinding machine 10 may employ the deep neural network (DNN), potentially incorporating architectures such as perceptron, feed-forward, convolutional, or generative adversarial networks (GANs). The sensor model, integrated with the AI system, accepts encoded representations of the rail scene as input, derived from sensor data like LIDAR, RADAR, and camera images. This input is processed to predict sensor data, enabling the machine to comprehend its surroundings and make informed decisions.

Before embarking on autonomous grinding, the rail grinding machine 10 may use its sensors to acquire real-time representations of the physical environment or rail 28. These representations are generated from the sensor data, capturing details such as the topography, object positions, and classifications within the scene. The sensor model learns to predict sensor data based on these representations, enhancing the machine's ability to understand and respond to its environment dynamically.

Equipped with the knowledge gained from the AI sensor model, the autonomous rail grinding machine 10 navigates along the rail 28, grinding the vertical web with precision. The sensor-driven decision-making, informed by the machine's ability to predict and understand the environment, facilitates smooth and efficient grinding operations. This advanced AI-driven approach represents a significant leap in rail maintenance technology, combining real-world data with simulated scenarios to enhance the autonomy and efficacy of rail grinding processes.

In another example, an AI-driven sensor model can be employed in conjunction with various sensors to comprehensively evaluate the condition of the rail's vertical web and make informed decisions about the need for grinding. This integrated system involves the use of multiple sensor types, each contributing unique information to assess both the pre-grinding state and the quality of the grind. For example, image sensors, such as cameras, can be strategically positioned on the rail grinding machine 10 to capture visual information about the rail surface. The sensor model, trained on a combination of real-world and simulated data, can analyze these images to detect signs of rust or other surface imperfections on the vertical web. The AI can identify areas that require grinding based on the severity of rust or degradation. LIDAR and RADAR sensors can be utilized to create detailed profiles of the rail surface. By measuring distances and reflections, these sensors contribute valuable information about the topography of the rail. The sensor model can process this data to identify irregularities and determine the optimal areas for grinding, taking into account factors like wear, deformities, and surface deterioration. As the rail grinding machine autonomously moves along the rail, the sensor model may continuously process real-time data from various sensors. This includes feedback from image sensors confirming the removal of rust or other surface issues during the grinding process. The AI can dynamically adjust the grinding parameters based on the evolving conditions of the rail, ensuring that the vertical web is appropriately treated.

After grinding, the rail's vertical web may undergo further inspection using sensors to evaluate the quality of the grind. Image sensors may capture high-resolution images of the treated surface. The AI, through the sensor model, analyzes these images to assess the smoothness, uniformity, and overall quality of the grind.

Additionally, sensors measuring vibrations and acoustic signals can provide additional insights into the quality of the grind. Irregularities in vibration patterns or unexpected noises may indicate imperfections in the grinding process. The sensor model interprets this data to determine if the grind meets the expected standards and if any further grinding is required.

The sensor model may operate as part of a dynamic feedback loop, continuously learning from real-world experiences. If the post-grinding assessment indicates that certain quality standards are not met, the AI can adapt and adjust the grinding parameters for subsequent passes. This iterative process ensures that the rail grinding machine becomes increasingly adept at achieving the desired grind quality.

By integrating AI and diverse sensor types, this comprehensive system enhances the efficiency and precision of rail grinding operations. The AI-driven sensor model facilitates real-time decision-making, allowing the rail grinding machine to address specific needs and maintain optimal rail conditions.

The rail grinding machine 10 may include wireless communication logic coupled to sensors on the rail grinding machine 10. The sensors gather data and provide the data to the wireless communication logic. Then, the wireless communication logic may transmit the data gathered from the sensors to a remote device. Thus, the wireless communication logic may be part of a broader communication system, in which one or several devices, assemblies, or systems of the present disclosure may be networked together to report alerts and, more generally, to be accessed and controlled remotely. Depending on the types of transceivers installed in the device, assembly, or system of the present disclosure, the system may use a variety of protocols (e.g., Wi-Fi®, ZigBee®, MiWi, BLUETOOTH®) for communication. In one example, each of the devices, assemblies, or systems of the present disclosure may have its own IP address and may communicate directly with a router or gateway. This would typically be the case if the communication protocol is Wi-Fi®. (Wi-Fi® is a registered trademark of Wi-Fi Alliance of Austin, TX, USA; ZigBee® is a registered trademark of ZigBee Alliance of Davis, CA, USA; and BLUETOOTH® is a registered trademark of Bluetooth Sig, Inc. of Kirkland, WA, USA).

In another example, a point-to-point communication protocol like MiWi or ZigBee® is used. One or more of the rail grinding machines 10 may serve as a repeater, or multiple rail grinding machines 10 may be connected together in a mesh network to relay signals from one rail grinding machine 10 to the next. However, the individual rail grinding machine 10 in this scheme typically would not have IP addresses of their own. Instead, one or more of the rail grinding machines 10 communicates with a repeater that does have an IP address, or another type of address, identifier, or credential needed to communicate with an outside network. The repeater communicates with the router or gateway.

In either communication scheme, the router or gateway communicates with a communication network, such as the Internet, although in some embodiments, the communication network may be a private network that uses transmission control protocol/internet protocol (TCP/IP) and other common Internet protocols but does not interface with the broader Internet, or does so only selectively through a firewall.

The system that receives and processes signals from the rail grinding machine 10 may differ from embodiment to embodiment. In one embodiment, alerts and signals from the rail grinding machine 10 are sent through an e-mail or simple message service (SMS; text message) gateway so that they can be sent as e-mails or SMS text messages to a remote device, such as a smartphone, laptop, or tablet computer, monitored by a responsible individual, group of individuals, or department, such as a production/maintenance/construction department. Thus, if a particular rail grinding machine 10 creates an alert because of a data point gathered by one or more sensors, that alert can be sent, in e-mail or SMS form, directly to the individual responsible for fixing or constructing the item having generated the alert. Of course, e-mail and SMS are only two examples of communication methods that may be used; in other embodiments, different forms of communication may be used.

In other embodiments, alerts and other data from the sensors on the rail grinding machine 10 may also be sent to a work tracking system that allows the individual, or the organization for which he or she works, to track the status of the various alerts that are received, to schedule particular workers to repair a particular rail grinding machine 10 or repair a part of the track that has been ground by rail grinding machine 10, and to track the status of those repair jobs. A work tracking system would typically be a server, such as a Web server, which provides an interface individuals and organizations can use, typically through the communication network. In addition to its work tracking functions, the work tracker may allow broader data logging and analysis functions. For example, operational data may be calculated from the data collected by the sensors on the rail grinding machine 10, and the system may be able to provide aggregate machine operational data for the rail grinding machine 10 or group of rail grinding machines 10.

The system also allows individuals to access the rail grinding machine 10 for configuration and diagnostic purposes. In that case, the individual processors or microcontrollers of the rail grinding machine 10 may be configured to act as Web servers that use a protocol like hypertext transfer protocol (HTTP) to provide an online interface that can be used to configure the rail grinding machine 10. In some embodiments, the systems may be used to configure several rail grinding machines 10 at once. For example, if several rail grinding machines 10 are of the same model and are in similar locations in the same location, it may not be necessary to configure the rail grinding machines 10 individually. Instead, an individual may provide configuration information, including baseline operational parameters, for several rail grinding machines 10 at once.

As described herein, aspects of the present disclosure may include one or more electrical, pneumatic, hydraulic, or other similar secondary components and/or systems therein. The present disclosure is therefore contemplated and will be understood to include any necessary operational components thereof. For example, electrical components will be understood to include any suitable and necessary wiring, fuses, or the like for normal operation thereof. Similarly, any pneumatic systems provided may include any secondary or peripheral components such as air hoses, compressors, valves, meters, or the like. It will be further understood that any connections between various components not explicitly described herein may be made through any suitable means including mechanical fasteners, or more permanent attachment means, such as welding or the like. Alternatively, where feasible and/or desirable, various components of the present disclosure may be integrally formed as a single unit.

Unless explicitly stated that a particular shape or configuration of a component is mandatory, any of the elements, components, or structures discussed herein may take the form of any shape. Thus, although the figures depict the various elements, components, or structures of the present disclosure according to one or more exemplary embodiments, it is to be understood that any other geometric configuration of that element, component, or structure is entirely possible. For example, instead of the described shape or configuration of a component, that component could be semi-circular, triangular, rectangular or square, pentagonal, hexagonal, heptagonal, octagonal, decagonal, dodecagonal, diamond shaped or another parallelogram, trapezoidal, star-shaped, oval, ovoid, lines or lined, tear-drop-shaped, cross-shaped, donut-shaped, heart-shaped, arrow-shaped, crescent-shaped, any letter shape (i.e., A-shaped, B-shaped, C-shaped, D-shaped, E-shaped, F-shaped, G-shaped, H-shaped, I-shaped, J-shaped, K-shaped, L-shaped, M-shaped, N-shaped, O-shaped, P-shaped, Q-shaped, R-shaped, S-shaped, T-shaped, U-shaped, V-shaped, W-shaped, X-shaped, Y-shaped, or Z-shaped), or any other type of regular or irregular, symmetrical or asymmetrical configuration.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments. For example, the rail grinding machine 10 is primarily discussed herein as performing the pre-welding grinding operation. However, it could be possible to utilize machine 10 for post-welding grinding to remove the flash that builds up, is created, or is deposited during the welding process. Thus, unless explicitly claimed otherwise, the grinding machine could be utilized after a welding process has occurred.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, firmware or a combination thereof. When implemented in software, the software code or instructions can be executed on any suitable processor or collection of processors, whether provided in a single computer or distributed among multiple computers or in firmware. Furthermore, the instructions or software code can be stored in at least one non-transitory computer readable storage medium.

Also, the ECU may be in a computer or smartphone utilized to execute the software code or instructions via its processors may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers or smartphones may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "program" or "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically, the functionality of the program modules may be combined or distributed as desired in various embodiments. As such, one aspect or embodiment of the present disclosure may be a computer program product including least one non-transitory computer readable storage medium in operative communication with a processor, the storage medium having instructions stored thereon that, when executed by the processor, implement a method or process described herein, wherein the instructions comprise the steps to perform the method(s) or process(es) detailed herein.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Logic", as used herein, includes but is not limited to hardware, firmware, software, and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the methods or processes of the present disclosure, which may incorporate some aspects of natural phenomenon, the process or method steps are additional features that are new and useful.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

While components of the present disclosure are described herein in relation to each other, it is possible for one of the components disclosed herein to include inventive subject matter, if claimed alone or used alone. In keeping with the above example, if the disclosed embodiments teach the features of A and B, then there may be inventive subject matter in the combination of A and B, A alone, or B alone, unless otherwise stated herein.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under", or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

To the extent that the present disclosure has utilized the term "invention" in various titles or sections of this specification, this term was included as required by the formatting requirements of word document submissions pursuant the guidelines/requirements of the United States Patent and Trademark Office and shall not, in any manner, be considered a disavowal of any subject matter.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed is:

1. A rail grinding machine comprising:

a rail cart having a cart frame including a forward end and a rear end defining a longitudinal direction therebetween, a first side and a second side defining a lateral direction therebetween, and an upper end and a lower end defining a vertical direction therebetween, wherein the longitudinal direction, lateral direction and vertical direction collectively define three cartesian directions;

a plurality of wheels operatively coupled to the cart frame, wherein the plurality of wheels permit the rail cart to travel along rails of a railway;

a grinding assembly moveably carried by the cart frame, wherein the grinding assembly includes a first grinding surface, wherein the first grinding surface performs a grinding operation that grinds a first surface of a rail to expose a portion of that rail for future connection with a welding component when an end of the rail is to be welded with another end of an adjacent rail, wherein creation of a ground surface on the rail by the grinding assembly occurs prior to welding;

wherein the grinding assembly is linearly moveable, and linear motion of the grinding assembly occurs relative to the cart frame in at least two of the three cartesian directions; and wherein the first grinding surface is rotationally moveable around a pivot axis that extends parallel to the longitudinal direction and the first grinding surface is rotationally moveable about a drive axis for the first grinding surface.

2. The rail grinding machine of claim 1, further comprising:

a trolley moveably connected to the cart frame, wherein the trolley moves in at least the lateral direction and the vertical direction relative to the cart frame.

3. The rail grinding machine of claim 2, further comprising:

a clamp assembly on the trolley to maintain the trolley in a stationary position relative to the rail during the grinding operation.

4. The rail grinding machine of claim 3, wherein the clamp assembly is located closer to the rear end of the cart frame than the first grinding surface.

5. The rail grinding machine of claim 2, further comprising:

a carriage moveably connected to the trolley, wherein the carriage moves in at least the longitudinal direction relative to the trolley;

wherein the grinding assembly is connected to and suspended downward from the carriage.

6. The rail grinding machine of claim 2, further comprising:

a shoe plate on the trolley that couples with the rail to align the grinding assembly with the rail.

7. The rail grinding machine of claim 1, wherein the grinding assembly further comprises:

an eccentric disc that is driven by a motor, wherein rotation of the eccentric disc imparts oscillatory movement to the first grinding surface.

8. The rail grinding machine of claim 7, wherein the oscillatory movement occurs in the vertical direction.

9. The rail grinding machine of claim 7, wherein the grinding assembly further comprises:

an arm having a first end and a second end, wherein the first end of the arm is connected to the eccentric disc and the second end of the arm is located below the first end of the arm, wherein the second end of the arm is connected to a lower member of the grinding assembly.

10. The rail grinding machine of claim 1, wherein the grinding assembly further comprises:

at least one vertical member that interacts with rollers that permit movement of the first grinding surface in the vertical direction.

11. The rail grinding machine of claim 10, wherein the grinding assembly further comprises:

at least one spring at least partially disposed within a bore defined by the at least one vertical member, wherein the at least one spring assists with uptake of the grinding assembly in the vertical direction during oscillatory movement.

12. The rail grinding machine of claim 11, wherein the grinding assembly further comprises:

a lower end of the at least one spring located within the bore and coupled to the at least one vertical member;

an upper end of the at least one spring that is coupled to an anchor and not connected to the at least one vertical member.

13. The rail grinding machine of claim 10, wherein the grinding assembly further comprises:

a lower end of the at least one vertical member that is positioned vertically higher than the pivot axis about which the first grinding surface rotates.

14. The rail grinding machine of claim 10, wherein the grinding assembly further comprises:

a carriage moveably coupled to the cart frame;

an upper end of the at least one vertical member that is positioned vertically below the carriage by a distance greater than or equal to half an amount of total vertical travel during oscillatory movement of the first grinding surface.

15. The rail grinding machine of claim 1, wherein the grinding assembly further comprises:

at least one actuator that is moveable to effectuate pivoting movement of the first grinding surface about the pivot axis, wherein the at least one actuator is located between two vertical members that are parallel to each other and aligned in the vertical direction.

16. The rail grinding machine of claim 1, wherein the grinding assembly further comprises:

a first grinding wheel, wherein the first grinding surface is on the first grinding wheel;

a motor mount connected with a motor to rotate the first grinding wheel about the drive axis;

a bearing mount connected to the motor mount;

a driveshaft extending through the bearing mount and the motor mount;

wherein the first grinding wheel, the motor mount and connected motor, the bearing mount, and the driveshaft collectively define a first grinding wheel assembly;

wherein the first grinding wheel assembly is pivotable about the pivot axis.

17. The rail grinding machine of claim 1, wherein the grinding assembly further comprises:

a second grinding surface, wherein the second grinding surface is configured to grind a second surface of the rail to expose another portion of that rail for future connection with another welding component when the end of the rail is to be welded with the adjacent rail;

wherein the second grinding surface of the grinding assembly is rotationally moveable relative to two axes.

18. The rail grinding machine of claim 17, wherein the first grinding surface and second grinding surface are moveable between a disengaged position and an engaged position, wherein when the first and second grinding surfaces are in the disengaged position, the first and second grinding surfaces are spaced apart from each other a first distance and the rail is interposed between the first and second grinding surfaces, and wherein when the first and second grinding surfaces are in the engaged position, the first and second grinding surfaces are spaced apart from each other a second distance that is less than the first distance and the rail is interposed between the first and second grindings and in contact with the first and second grinding surfaces.

19. The rail grinding machine of claim 17, wherein the first grinding surface and the second grinding surfaces pivot relative to one another between an open and disengaged position and a closed and engaged position, wherein the grinding assembly grinds the rail surface in the closed and engaged position.

20. The rail grinding machine of claim 1, further comprising:

a guide tube on the cart frame, wherein the guide tube has a first end and a second end, wherein a length of the guide tube is defined between the first end and the second end of the guide tube, and the length of the guide tube is oriented parallel to the longitudinal direction;

a trolley having a trolley frame, the trolley in operative connection with the guide tube, wherein the trolley includes at least one wheel that operatively engages the guide tube to move the trolley along the guide tube parallel to the longitudinal direction, and trolley includes at least one other wheel that is oriented to permit rotational movement that effectuates vertical translational movement in contact with the at least one other wheel;

a tubular mount that extends downward from the trolley and operatively engages the at least one other wheel, wherein the tubular movement moves in upward and downward in the vertical direction while in contact with the at least one other wheel;

wherein the grinding assembly is carried by the trolley, wherein the trolley moves in a direction parallel to a length of the rail to move a grinding surface parallel to the length of the rail.

* * * * *